US005207727A

United States Patent [19]

Pearce et al.

[11] Patent Number: 5,207,727

[45] Date of Patent: May 4, 1993

[54] CAN END HANDLING SYSTEM

[75] Inventors: Ronald A. Pearce, Lakewood; Ira D. Hooker, Jr., Arvada, both of Colo.

[73] Assignee: Rapsco Incorporated, Denver, Colo.

[21] Appl. No.: 723,066

[22] Filed: Jun. 28, 1991

Related U.S. Application Data

[63] Continuation-in-part of Ser. No. 549,463, Jul. 6, 1990.

[51] Int. Cl.[5] ..... B65B 25/24; B65B 43/00; B65D 1/36; B65G 57/02

[52] U.S. Cl. ..... 414/792.7; 53/241; 53/254; 53/255; 53/258; 53/539; 53/542; 53/564; 206/443; 206/503; 206/564; 206/821; 414/417; 414/794.2; 414/928; 414/929

[58] Field of Search ..... 53/241, 247, 254, 255, 53/258, 260, 539, 542, 564, 585; 206/443, 503, 518, 562, 563, 564, 821; 220/555; 414/417, 786, 788.2, 788.7, 791.2, 792.7, 793.4, 794, 794.2, 928, 929

[56] References Cited

U.S. PATENT DOCUMENTS

| | | | |
|---|---|---|---|
| 2,802,227 | 8/1957 | Parsons | 414/417 X |
| 3,435,584 | 4/1969 | Prechter | 53/542 X |
| 3,517,478 | 6/1970 | Winch et al. | 53/539 X |
| 3,719,020 | 3/1973 | Talbot et al. | 53/542 |
| 3,732,665 | 5/1973 | Pitts | 53/542 X |
| 4,543,768 | 10/1985 | Nishikawa et al. | 53/260 X |
| 4,568,231 | 2/1986 | Czajka et al. | 414/929 X |
| 4,748,798 | 6/1988 | Udaka et al. | 53/542 X |
| 4,808,057 | 2/1989 | Chiappe et al. | 414/626 X |
| 4,943,206 | 7/1990 | Watanabe et al. | 414/786 |

FOREIGN PATENT DOCUMENTS

| | | | |
|---|---|---|---|
| 62-46805 | 2/1987 | Japan | 206/564 |

*Primary Examiner*—Michael S. Huppert
*Assistant Examiner*—Janice Krizek
*Attorney, Agent, or Firm*—John E. Reilly

[57] ABSTRACT

A system for storing and transporting can end members comprising multiple tray units having multiple parallel rows of elongated compartments for receiving and supporting stacks of end members. The tray units are nestable and stackable one upon another to provide palletized loads of both empty and filled tray units. End loading and unloading apparatus is provided to enable simultaneous loading and unloading full tray compartments by simultaneous lateral movement of all of the stacks of end members between the tray compartments and a shuttle tray unit whereat all the stacks of end members are stored prior to loading and unloading of the tray unit. The shuttle tray unit is loaded and unloaded by stacking units of a lesser number than the number of tray compartments. The stacking units have elongated upper and lower jaw members which grip and carry a stack of end members between the shuttle tray unit and end member feed and track apparatus for conveying continuous strings of end members to and from the stacking units. Elevator and conveyor apparatus is provided to deliver stacks of empty tray members on a pallet to can end loading station and to stack and palletize loaded trays in a palletizing mode of operation; and to deliver stacks of filled tray members on a pallet to an end unloading station and to stack and palletize empty trays in a depalletizing mode of operation.

32 Claims, 55 Drawing Sheets

CAN END HANDLING SYSTEM

This application is a continuation-in-part application of prior copending application Ser. No. 549,463, filed Jul. 6, 1990.

FIELD OF INVENTION

In general, this invention relates to a system for handling can end members, and, more particularly, to a system for palletizing and/or depalletizing tray member units which carry multiple rows of can end members.

BACKGROUND

Steel and aluminum lids for beverage and food cans are called "ends" in the can industry. Two piece cans comprise a can body member and an end member which is fixedly attached to the can body member by a seamer machine after the can body member has been filled by a filler machine. Due to the cross-sectional shape of the ends, they nest together when stacked or conveyed and form a continuous string, referred to as a snake. In order to transport and store ends, segments or stacks of this string (sometimes referred to as "sticks") containing a known count of ends (around 500) are divided from the string manually by an individual called a "bagger" and inserted into a paper tube called a sleeve. The sleeves are then sealed and the bagger stacks the sleeves on a pallet in a nested fashion. The nested sleeves of ends are maintained in relationship on the pallets by threading a paper or net ribbon back and forth around the layers. The pallet loads are hand assembled at the end manufacturing facility for shipment to the user (bottler-filler) facility. The beverage filler operator at the bottling plant opens the sleeves and feeds the stack of ends to the seamer machine.

This delivery system has been the industry standard for many years. During this time end manufacturing lines have become highly automated and greatly improved in speed. There have been a number of attempts at improving the delivery system but most have only improved the ability of the bagger and filler operators to keep up with the system and have not truly automated the system.

Recently, there has been a machine developed called a "balancer". This machine has the ability to take segments of the string of ends being conveyed and transfer the segments into a multi-rowed steel tray or simply transfer from an incoming conveyor(s) to an outgoing conveyor(s). The device makes decisions based on line conditions to either off load ends to the tray, send ends on through the line, or load ends from the tray back into the line. In other words, the machine acts as a device to balance the flow of ends through the manufacturing line; hence, the name "balancer". A machine of the type is disclosed in U.S. Pat. No. 4,808,057.

The developer of the balancer has also developed a machine that places ends in plastic trays and then palletizes the trays for delivery to the filler-seamer line. The machine with modifications is also used as a depalletizer to unload the trays at the filler. A machine of this type is disclosed in U.S. Pat. No. 4,568,231.

SUMMARY OF INVENTION

In general, the present invention provides a system for receiving can end members from a supply of end members and automatically or manually loading end members in a plurality of empty tray "units" or "members" and stacking a plurality of loaded tray units on a pallet member for transport to another work station. The present invention involves the provision of a new and improved nestable and stackable tray means for holding and transporting multiple rows of stacks of container end members in multiple parallel rows of elongated compartments. Each tray unit or member has a quadrilateral peripheral configuration and is preferably made of one piece of relatively lightweight molded plastic material, but can be made of more than one piece of material. Each tray unit also comprises four peripheral side wall portions and a central wall portion located between the side wall portions. A plurality of parallel equally-spaced equal-length elongated slot-type compartment means of identical generally semi-circular, cross-sectional configuration extend between one pair of opposite side wall portions and are parallel to another pair of opposite side wall portions. The compartments are constructed and arranged to provide end wall abutment surfaces to engage opposite ends of the stacks of end members and side wall abutment surfaces for uniformly engaging and supporting each end member in each stack of end members in each compartment.

In a presently preferred form of the invention, the tray has a flexible cover means for covering each compartment. The cover means is selectively movable from a collapsed closed position within the compartment when the compartment is empty and an open covering position when the compartment is filled with end members.

In another embodiment, the tray means is provided with a continuous inclined flexible peripheral wall portion providing a skirt for protecting the end members in a stack of nested trays filled with can end members. The skirt includes sealing means in the form of rib portions which contact the inclined peripheral wall portions of adjacent nested and stacked trays in both a loaded condition and an unloaded condition.

Each compartment means comprises laterally spaced upwardly outwardly extending opposite wall portions which have side surfaces for supporting engagement with peripheral portions of an horizontally extending stack of can end members located in the compartment means; stack insertion and removal opening means in at least one of the one pair of opposite side wall portions for enabling horizontal movement therethrough of a stack of can end members during insertion in and removal from the compartment means of a stack of can end members; stack abutment means in each of the one pair of opposite side wall portions at opposite ends of the compartment means for supporting retaining engagement with opposite end portions of the stack of can end members received therein; and lifting tool access slot means associated with the stack abutment means and extending through the adjacent side wall portion for enabling insertion into the compartment means of a lifting tool device to engage and lift can end members above the stack abutment means for removal of the stack of can end members by horizontal movement through the stack insertion and removal opening means.

The system comprises a tray loading station for loading can end members in an empty tray unit; a palletizing station for stacking loaded tray units one on top of another on a pallet member; and a plurality of tray members. A plurality of pallet members support and transport tray members to the loading station and from the palletizing station. An empty tray supply elevator means at the loading station supplies empty tray members to the loading station supporting a pallet member with a plurality of stacked empty tray members mounted on the empty tray pallet member for sequentially transporting the empty tray pallet member and the stack of empty tray members toward the loading station.

Tray holding means at the loading station receive and hold one empty tray member at a time from the stack of empty tray members on the empty tray pallet member. Tray separation means operate at the loading station to separate and remove one empty tray at a time from the stack of empty tray members on the empty tray pallet member until all empty tray members have been removed from the empty tray pallet member.

Loading means at the loading station move stacks of end members into the compartment means on the empty tray member held by the holding means and fill the compartment means with stacks of end members to provide a loaded tray member. Conveyor means move a loaded tray member from the end loading station to a palletizing station.

The palletizing elevator means at the palletizing station supports a pallet member which has a plurality of loaded tray members mounted in stacked relationship thereupon. A stacking means at the palletizing station places loaded tray members one at a time in vertically stacked relationship on the palletizing elevator means to provide a pallet of multiple stacked loaded tray members. A pallet conveyor means removes a pallet of multiple stacked loaded tray members from the palletizer elevator means.

BRIEF DESCRIPTION OF DRAWING

Illustrative and presently preferred embodiments of the invention are shown in the accompany drawings in which.

DETAILED DESCRIPTION

Figure 1:
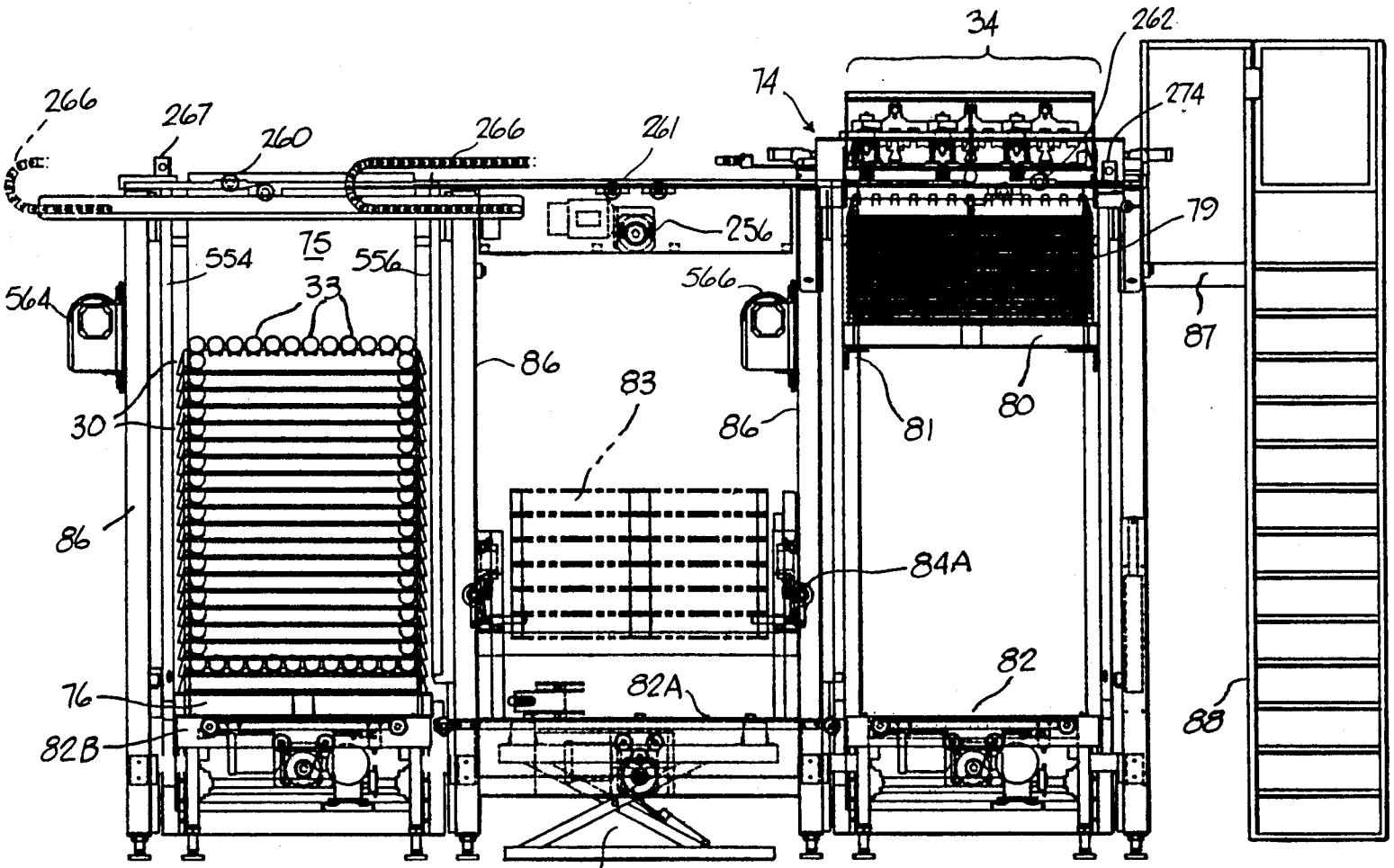
FIG. 1 is an end view of a palletizer system of the present invention.
Figure 2A:
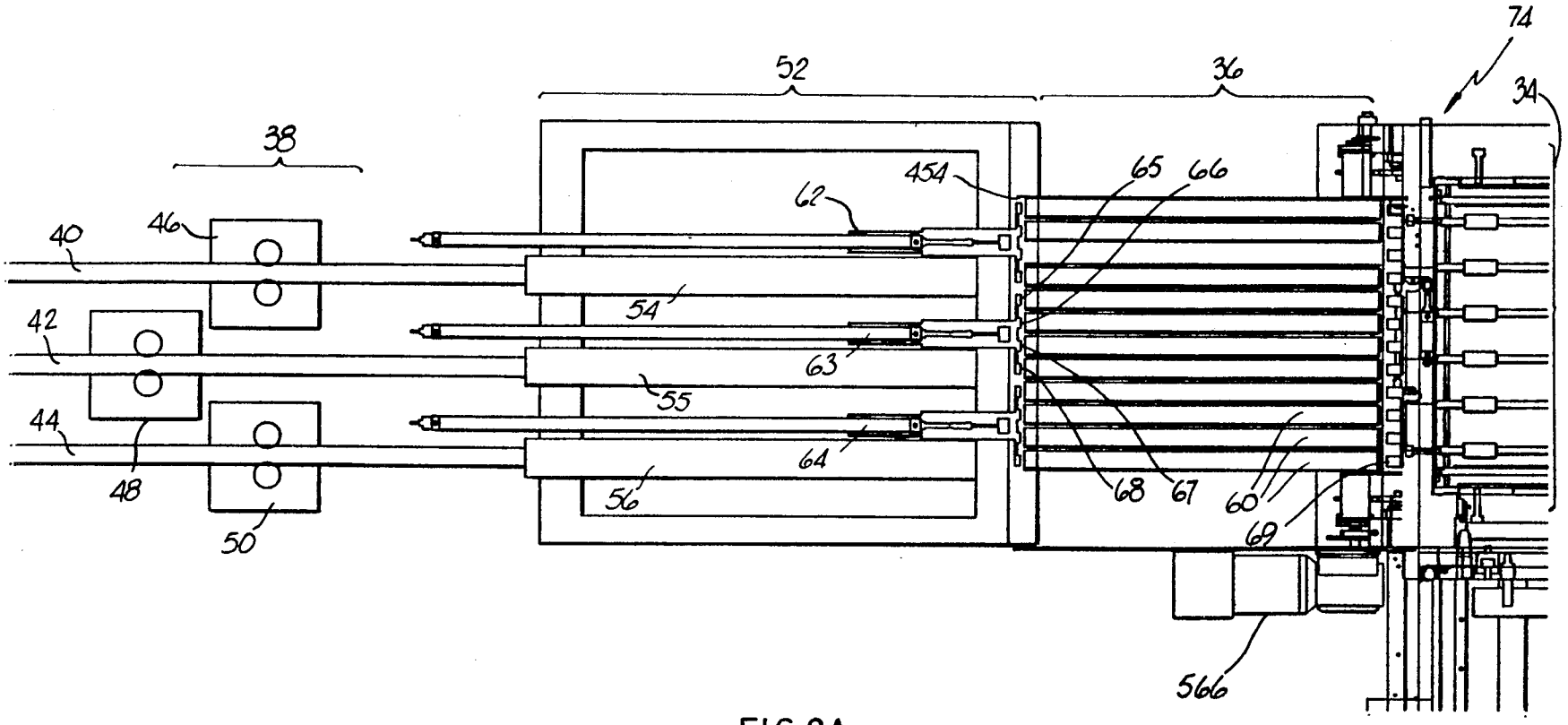
FIGS. 2A, 2B and 2C are portions of an enlarged plan view of the palletizer system of FIG. 1.
Figure 2B:
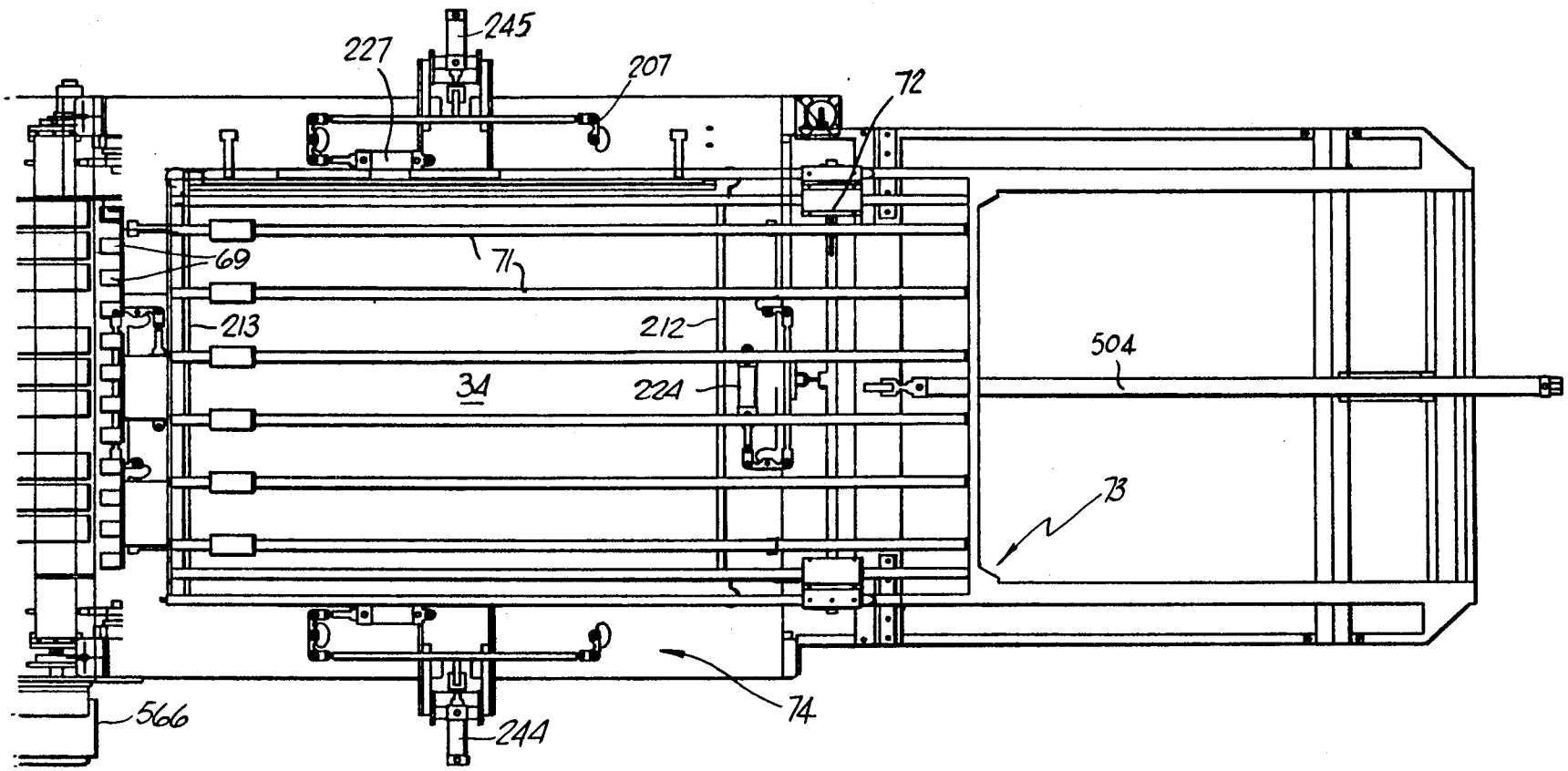
Figure 2C:
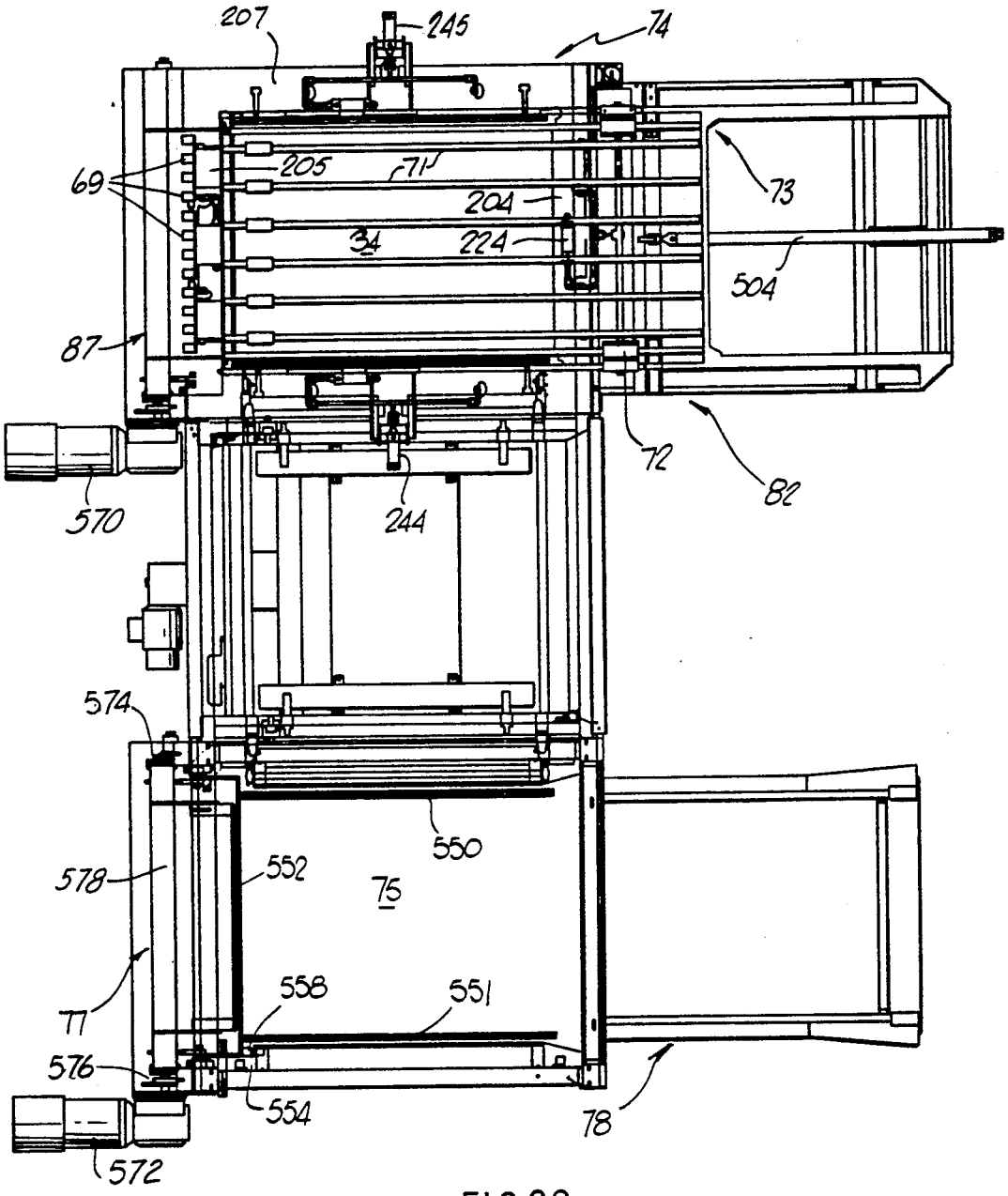
Figure 3A:
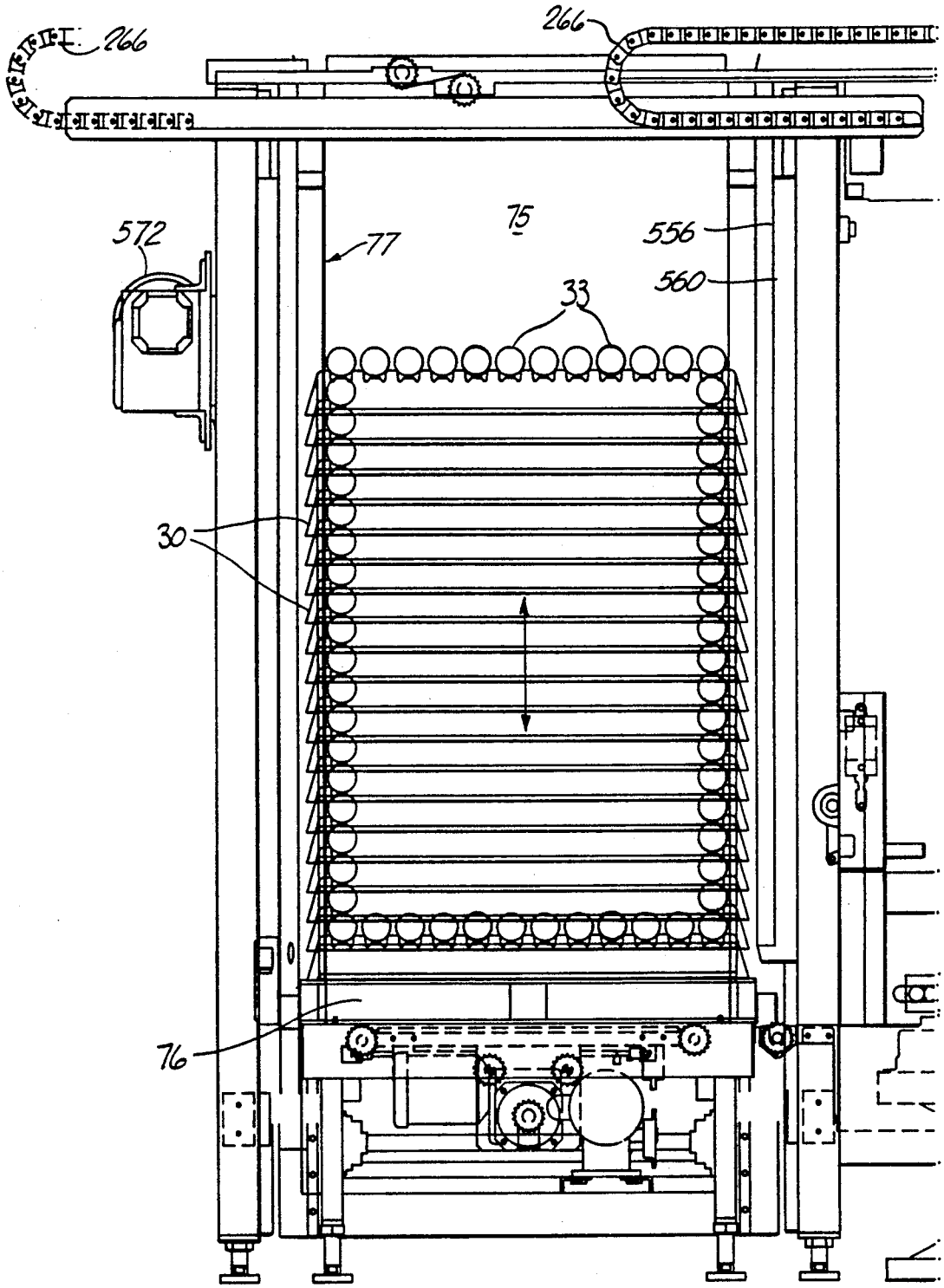
FIGS. 3A and 3B are enlarged end views and 3C is an enlarged side view of portions of the palletizer system of FIGS. 1 and 2.
Figure 3B:
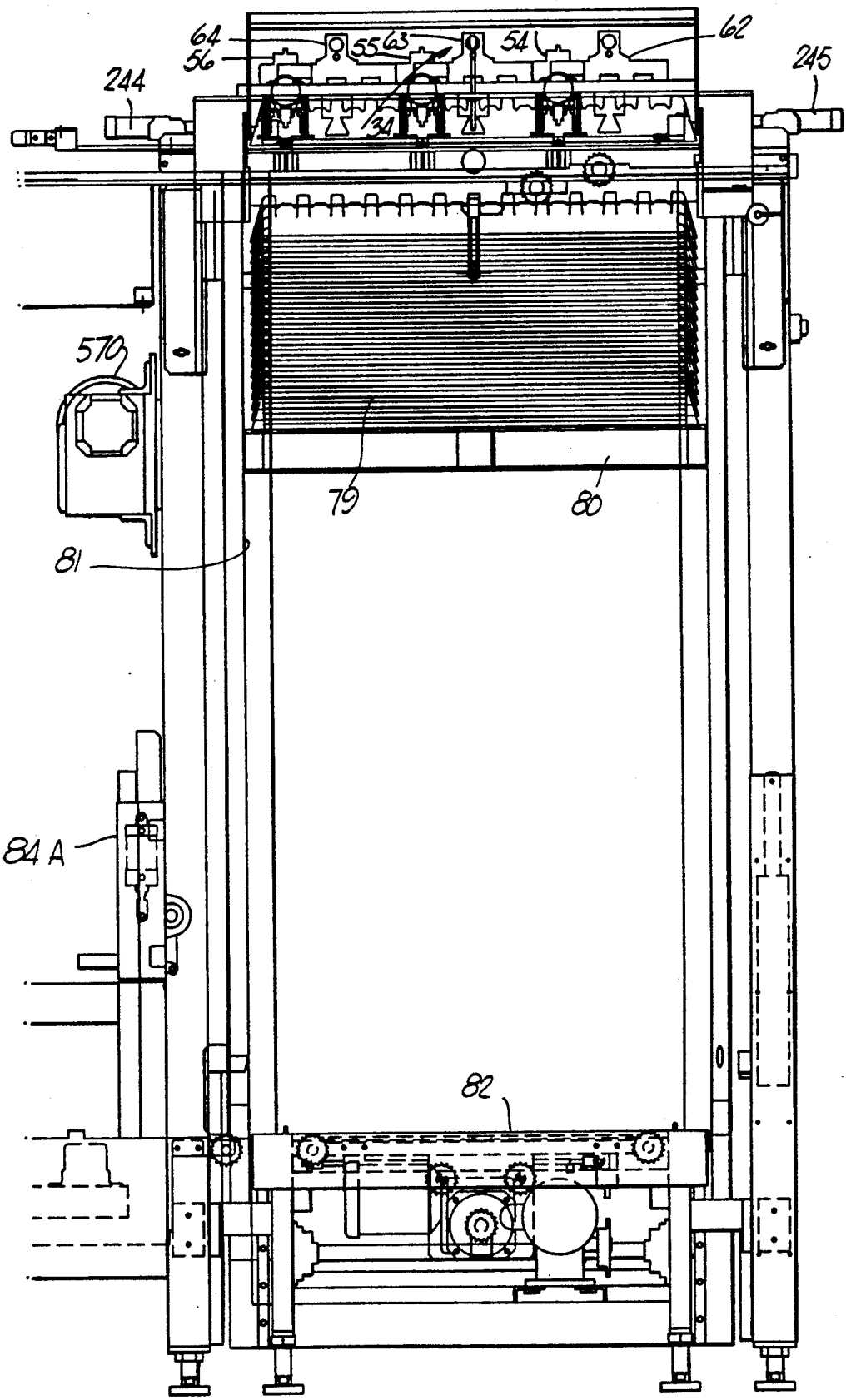
Figure 3C:
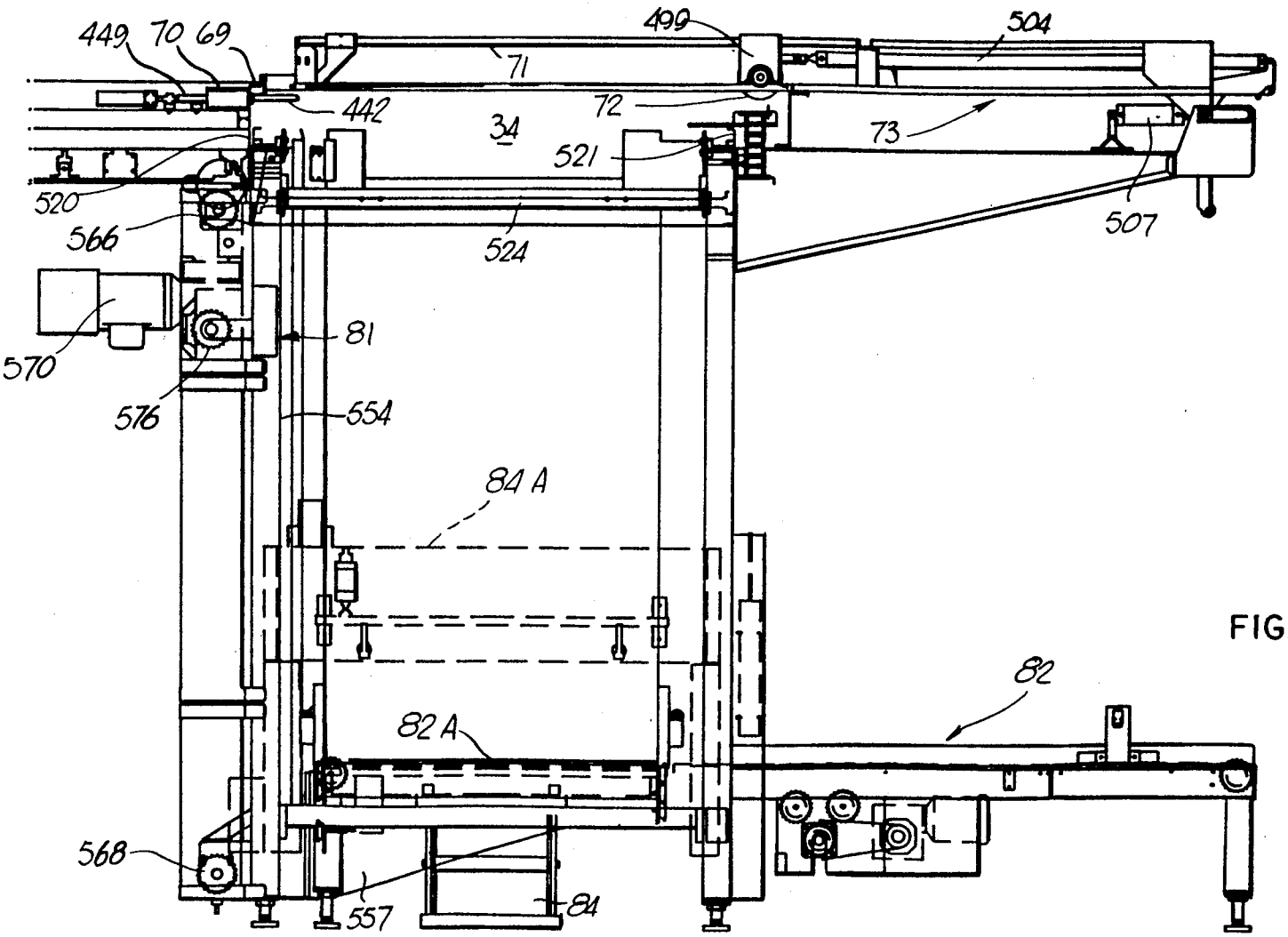
Figure 4:
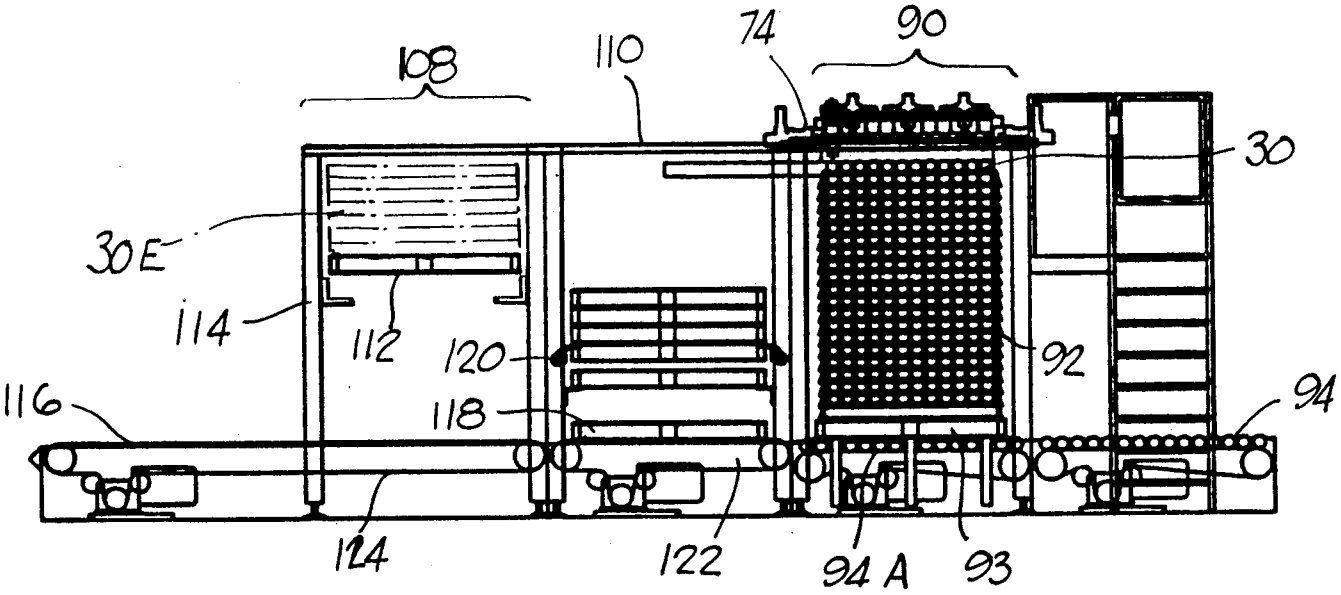
FIG. 4 is an end elevational view of a depalletizer system.
Figure 5:
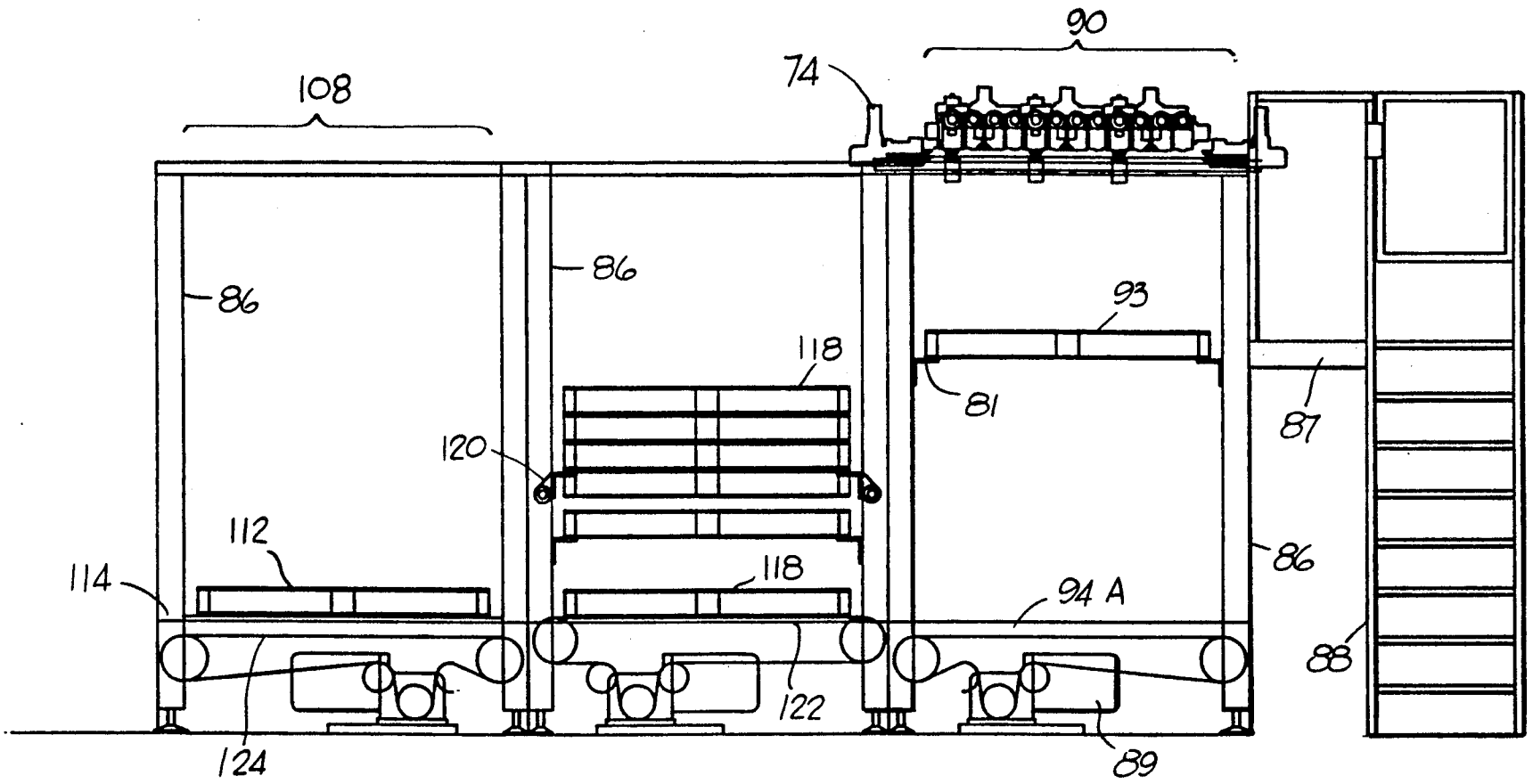
FIG. 5 is an end elevational view of the depalletizer system of FIG. 4.

In general, the can end handling system of the present invention may be constructed and arranged for use as a palletizer system as illustrated in FIGS. 1-3 or as a depalletizer system as illustrated in FIGS. 4 and 5 employing a tray means 30 having multiple horizontal parallel rows of trough-like compartments 31 for holding end members 32 in stacked abutting side-by-side vertically extending relationship (FIG. 7C) and providing multiple horizontally extending rows 33 of stacks of end members on each tray means. In the presently preferred embodiment, each tray means has 12 rows of compartments.

In general, as shown in FIGS. 1-3, the palletizer system comprises a tray loading station 34 whereat the empty compartments of a tray are filled with stacks of end members simultaneously transferred from a stack shuttle station 36 (FIG. 2A); a conventional end feed station 38 having one or more continuously operable conventional feed tracks 40, 42, 44 to which end members are continuously fed in string-like fashion from a source of supply of ends. Conventional can end drive means 46, 48, 50 drive the strings of end members forwardly at a uniform speed in abutting engagement with one another. The strings of end members are separated into substantially equal length stacks of end members at a separator stacking station 52 having one or more stack forming means 54, 55, 56 for forming one or more rows of stacks of substantially equal length and number of ends and separating the stack of ends from the other ends in the continuous feed line of the ends. In the presently preferred embodiment, there are three feed lines and three stack forming means. The stack forming means are reciprocably movable from an end receiving position next adjacent the end of feed track means 40, 42, 44 to an end unloading position located above the stack shuttle station 36 whereat the parallel spaced rows of stacks of end members are deposited in a plurality of elongated parallel laterally spaced horizontally extending trough means 60 of a shuttle tray means 61. There are twelve trough means 60 which are filled three at a time by the three stacker means. The shuttle table is movable laterally to sequentially align four sets of trough means with the stacker means until all twelve trough means have been filled. Then the 12 rows of parallel stacks of end members are simultaneously transferred to an empty tray means 30 at tray loading station 34 by pusher means 62, 63, 64 mounted above and associated with the stack forming means 54, 55, 56. Each pusher means has four head portions 65, 66, 67, 68 so as to provide one head portion for each of the twelve trough means 60. A releasable stop means 69 is provided at the opposite end of each trough means 60 to hold the stacks of end members in position until the pusher means are operated. The releasable stop means 69 are slidably mounted on rod means 71 (FIG. 2C) mounted above and extending across the loading station in parallel relationship to tray compartments 31. The releasable stop means 71 is associated with brush means 72 which may be provided to sweep the empty compartments in the tray means as the pusher means move forward to load the stacks of ends onto the tray means. A frame means 73 supports the stop means and the brush means. End guide and lift rod means 70 (FIGS. 6D and 14) are provided between the end of each trough means 60 and the end compartments 31 in the tray means to enable the stacks of end members to be transferred therebetween.

A tray holding and carrier means 74 is provided at the tray loading station 34 for receiving and holding an empty tray means 30 in a loading position during a loading operation; for transporting the loaded tray means from the loading station to a full tray palletizing station 75; and for releasing a loaded tray means for movement into supported relationship with a loaded tray pallet means 76 at the palletizing station which includes an elevator means 77 (FIG. 2C) for moving the loaded tray pallet means vertically upwardly and downwardly between an uppermost loading position, a lowermost position, and a plurality of intermediate positions whereat a series of individual loaded tray means received from the tray holding means is stacked on a pallet on the elevator means. When the stacking of loaded tray means on the pallet on the elevator means 77 has been completed, the palletized load of stacked loaded tray means may be removed from the elevator means by a lateral conveyor means 78.

Empty tray means are fed to the loading station 34 from a palletized load 79 (FIG. 1) of empty tray means which are supported on a pallet 80 on an elevator means 81. The palletized load 79 is transported to the elevator means 81 by a lateral conveyor means 82 located beneath the frame means 73. Elevator means 81 is incrementally movable upwardly and downwardly to sequentially associate uppermost ones of the empty tray means with the tray holding means and permit lateral movement of the tray holding means to the palletizing station after each tray means has been filled with can end members. An empty pallet 80 is conveyed to a central conveyor means 82A whereat it may be directly conveyed to elevator means 77 via a conveyor means 82B. In addition, empty pallets may be stacked above conveyor means 82A by elevator means 84 and stacking means 84A. The apparatus is mounted on suitable frame means 86 and platform means 87 accessible by stair means 88 (FIG. 1). The apparatus is automatically operable by suitable control and motor means 89.

Figure 4A:
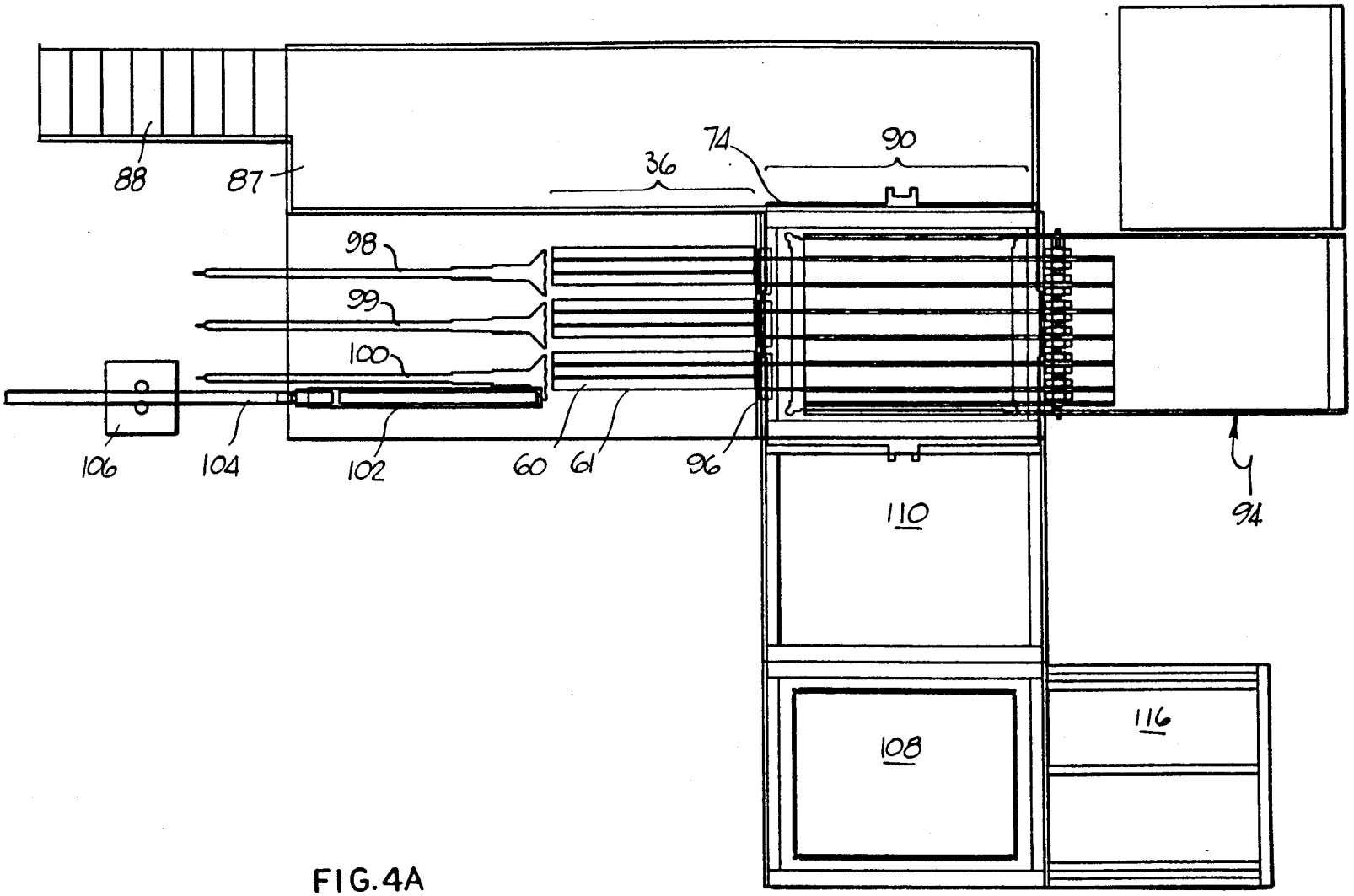
FIG. 4A is an enlarged plan view of the depalletizer system of FIG. 4.

As illustrated in FIGS. 4, 4A and 5, the aforedescribed apparatus may be rearranged and reversely operated as a tray depalletizing and unloading system comprising an unloading station 90 whereat the parallel horizontal rows of separate stacks of end members are removed from the loaded tray means. Individual loaded tray means 30 are fed to tray holding means 74 from a palletized stack of loaded tray means 92 (FIG. 4) on a pallet means 93 (FIG. 5) mounted on elevator means 81. The pallet of loaded tray means is fed onto the elevator means by suitable conveyor means 94, 94A. The uppermost one of the loaded tray means is raised into engagement with the tray holding carrier means 74 by upward and downward movement of the elevator means 81 as previously described. Then, the rows of the stacks of ends in the tray compartments are simultaneously lifted by guide rod lift means and moved horizontally into the trough means 60 on the shuttle table means 61 at shuttle station 36 by pusher means 96 which are generally similar to stop means 69, but operate in a different manner as hereinafter described. The rows of stacks of end members are removed from the tray means by use of the end guide and lift rod means 70 (FIGS. 6D and 14), pusher means 96, and a backup means 98, 99, 100 which hold the stacks together during movement of each row of a stack of end members into one of the plurality of parallel rows of elongated troughs 60 of shuttle means 61. Back-up means 98, 99, 100 are generally similar to pusher means 62, 63, 64 and operate in substantially the same manner as hereinafter described. The rows of stacks of end members are removed from the troughs 60 by clampable engagement with one or more stacker carrier means 102 which are of substantially the same construction and operate in substantially the same manner as stacker means 54, 55, 56, and transferred to continuously operable conveyor means 104 having end drive means 106 to form a string of end members. Empty trays 30E are carried to a palletizer station 108 by the tray carrier means 74 on a track means 110 and stacked on a pallet 112 (FIGS. 4 & 5) on an elevator means 114 in the same manner as the palletizer system. Full empty tray pallets may be removed by a conveyor means 116. Empty pallets 118 from unloading station 90 may be stored on a stacker means 120 and/or conveyed to the elevator means 114 by conveyor means 122, 124 in the same manner as the palletizing system.

THE TRAY MEANS

Figure 6:
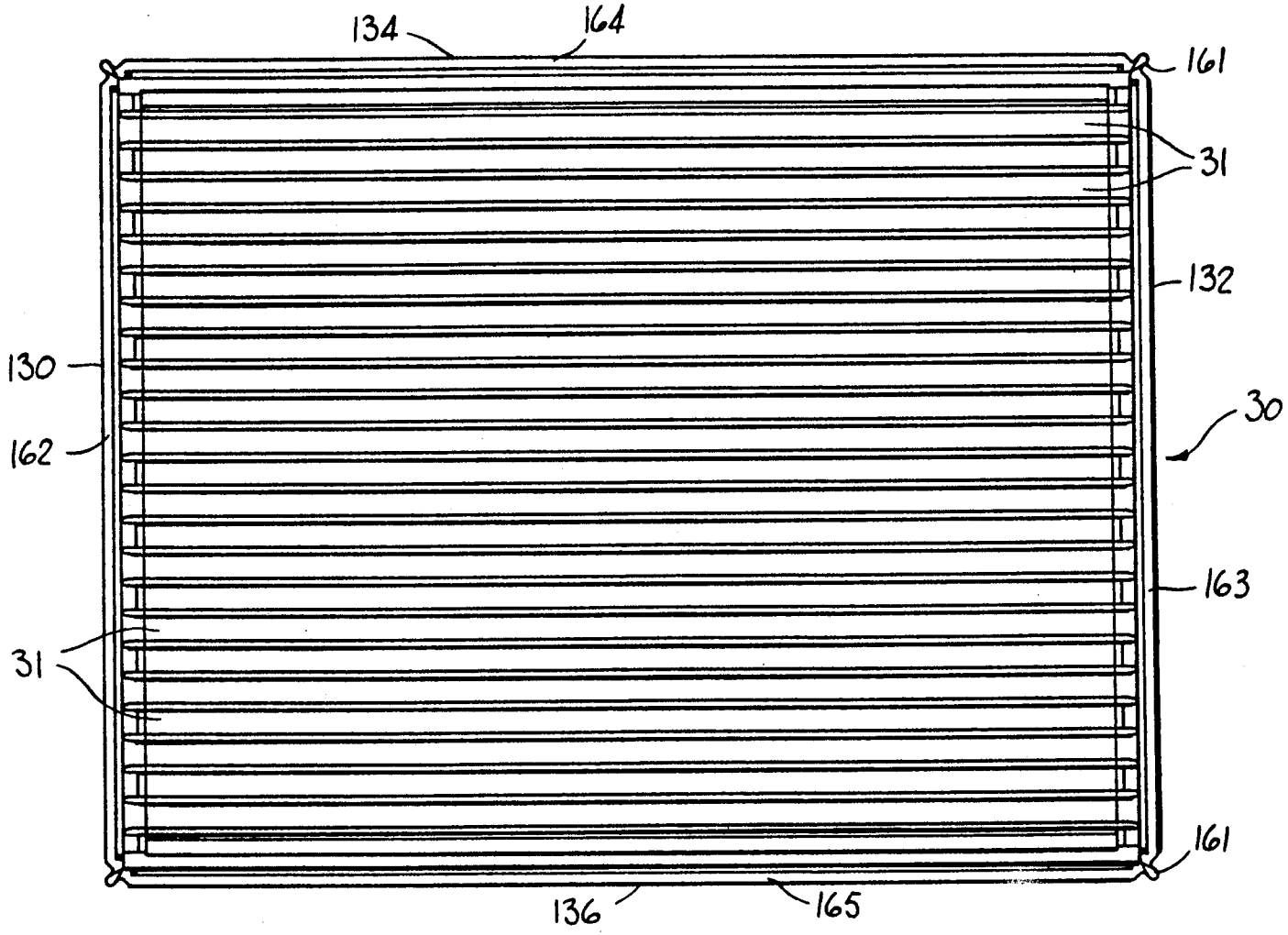
FIG. 6 is a plan view of a tray of the present invention.
Figure 6A:
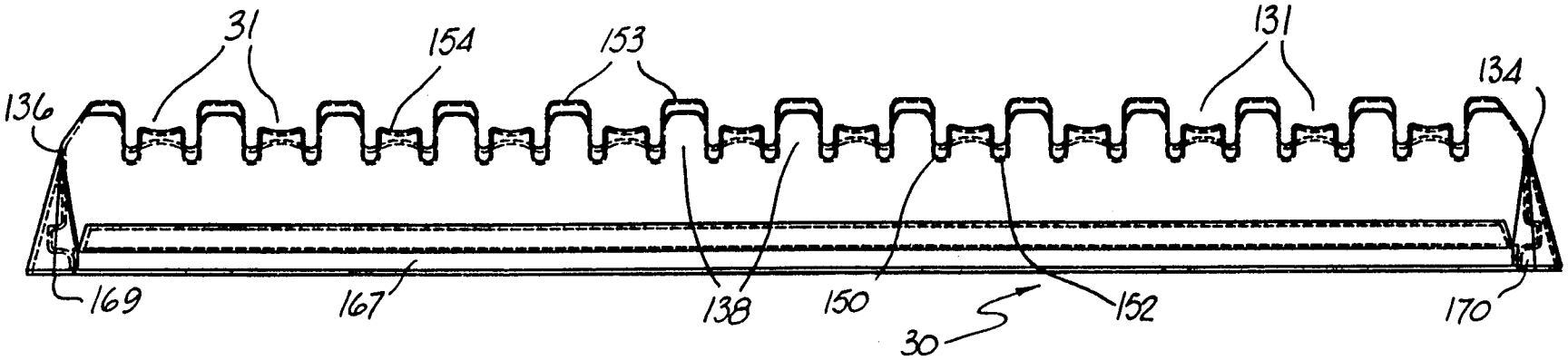
FIG. 6A is is an end view of the tray of FIG. 6.
Figure 6B:
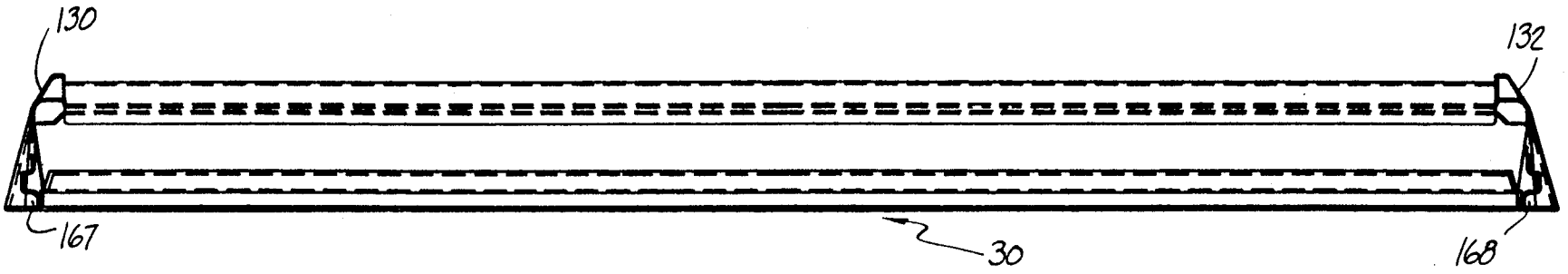
FIG. 6B is a side view of the tray of FIG. 6.

Each of the tray means 30 is preferably made of one or more pieces of molded plastic material, such as polyethylene, and is made by vacuum forming of plastic sheet material having a thickness of between 0.150 and 0.200 inch. The tray means have a quadrilateral peripheral configuration defined by relative short length opposite parallel side wall portions 130, 132 and relatively long length opposite parallel side wall portions 134, 136 surrounding a plurality (e.g. 12) of elongated parallel rows of can end holding compartments 31 separated by parallel rib portions 138. In the embodiment of FIG. 6D, each can end compartment 31 comprises a generally horizontal bottom wall portion 140 and vertically outwardly inclined side wall portions 142, 143 connected by curved upper wall portions 144. Side wall portions 142, 143 are connected to the bottom wall portions by reversely curved connecting portions 145, 146. The length of the end compartments is such as to receive and hold substantially equal numbers of end members in stacked relationship to provide a plurality of substantially equal length rows of stacks of end members.

Figure 6C:
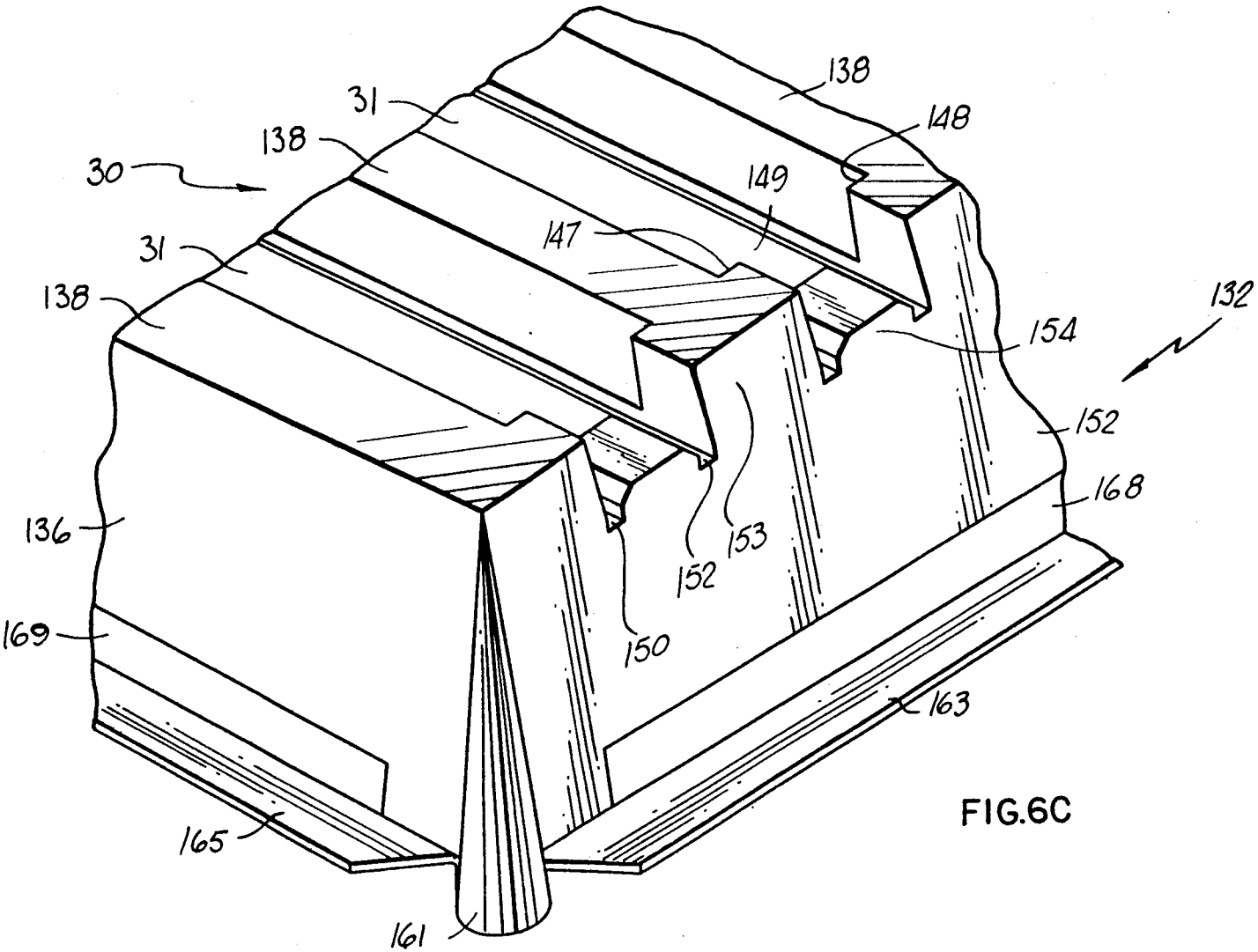
FIG. 6C is a partial perspective view of the tray of FIG. 6.
Figure 6D:
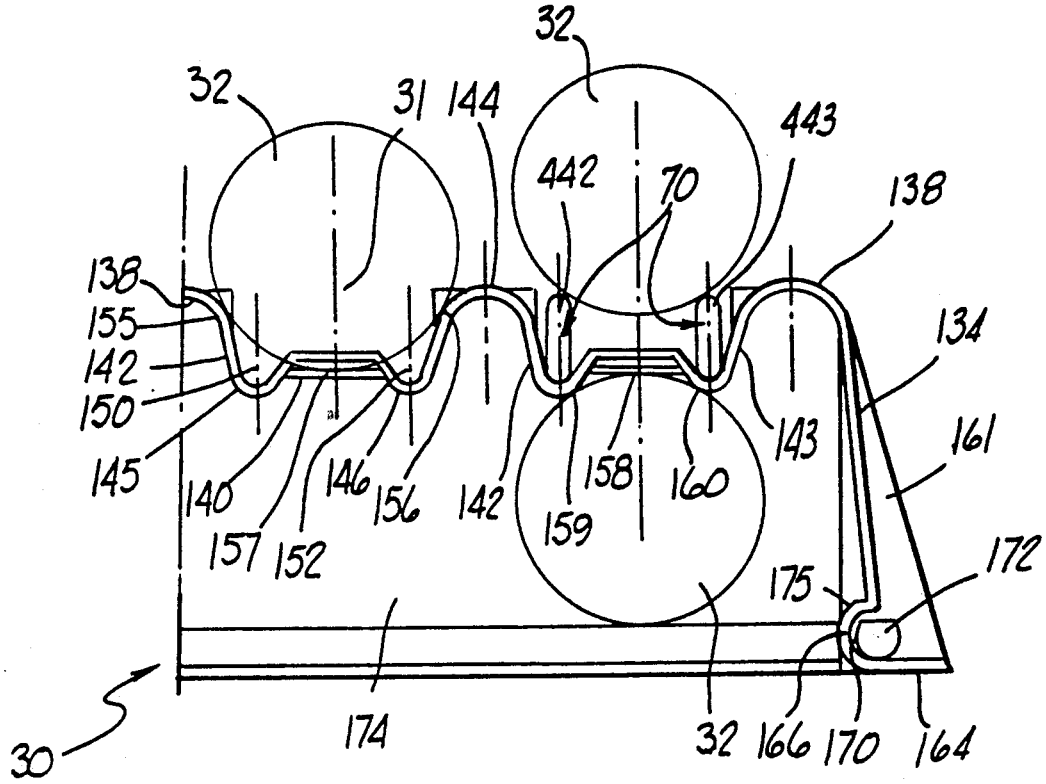
FIG. 6D is an enlarged partial cross-sectional view of the tray of FIG. 6.
Figure 8:
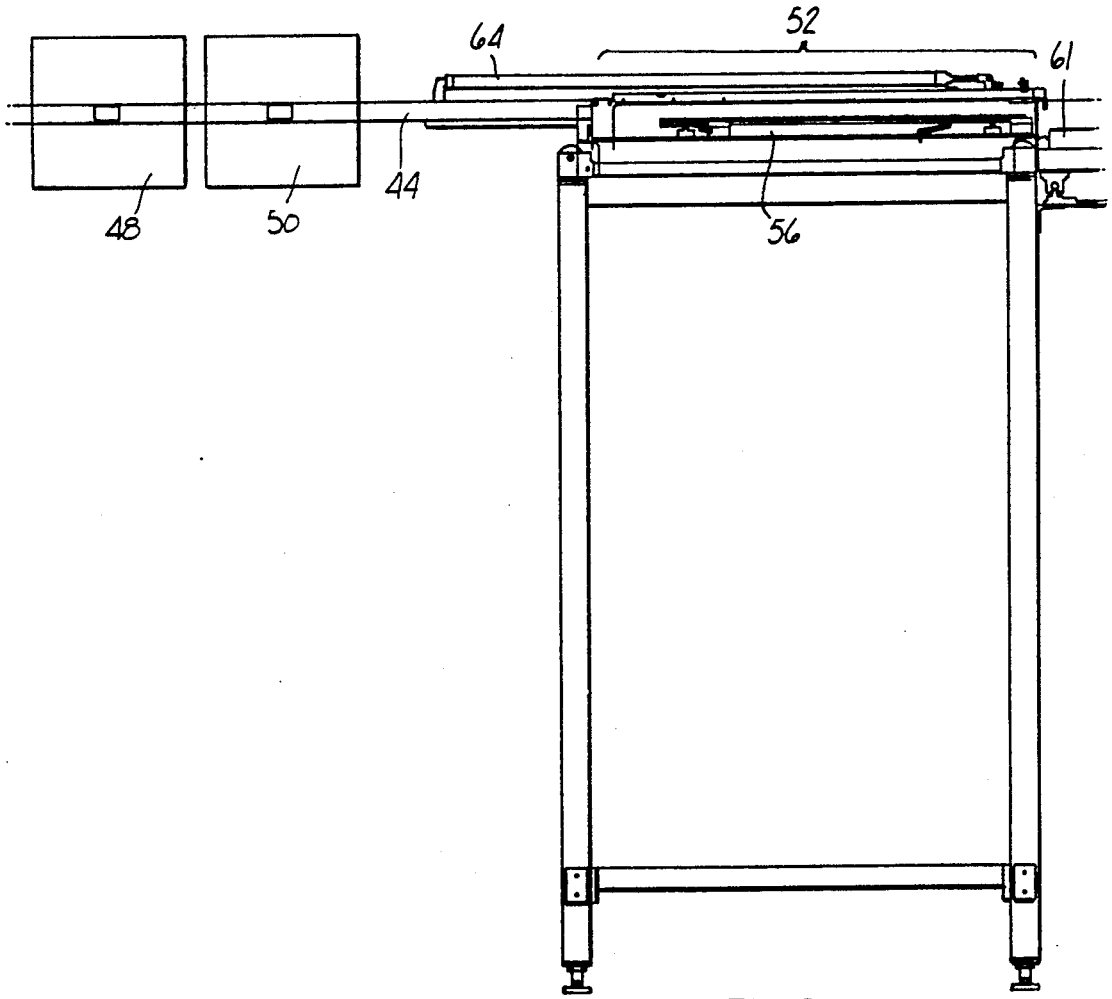
FIG. 8 is an enlarged side view of the segmenter apparatus of the palletizer system of FIG. 1.

As illustrated in FIG. 6C, the opposite end wall portions of each row comprise abutment wall portions 147, 148, 149 and a pair of spaced slot means 150, 152 for receiving end guide and lift rod means 70 (FIGS. 6D, 8D and 14) whereby the adjacent end portion of each stack may be lifted above the adjoining abutment wall portion during loading and unloading of the stacks of end members. The end portions 153 of ribs 138 have an enlarged generally cross-sectional configuration to provide coplanar laterally spaced end abutment surfaces. Central end wall portions 154 provide a relatively short height end abutment surface 149 which is coplanar with surfaces 147, 148. In the embodiment of FIG. 6D, curved wall portions 144 and bottom wall portions 140 provide upwardly facing abutment surfaces 155, 156, 157 which are tangent to an arc having a radius approximately equal to the radius of the can end members supported in the tray compartments. Bottom wall portion 140 and curved connecting wall portions 145, 146 provide downwardly facing abutment surfaces 158, 159, 160 which are tangent to an arc having a radius equal to the radius of the can end members supported in the tray compartments. Thus, filled trays may be nested and stacked one upon another with upper trays being supported by the end members in lower trays.

The side wall portions are downwardly outwardly inclined and connected to one another by corner hinge means 161 to enable limited inward and outward flexing of the side wall portions. Each side wall portion terminates in a laterally outwardly extending flange portion 162, 163, 164, 165 (FIG. 6) connected to the side wall portions by an inwardly curved wall portion 166 (FIG. 6D) which provides elongated slot means 167, 168, 169, 170 extending therealong for receiving a holding rod means and/or a release rod means 172 as hereinafter described.

The side wall portions provide a downwardly facing compartment means 174 for receiving and supporting another tray in stacked relationship with one another. The inwardly curved wall portions 166 provide an inwardly facing curved abutment surface 175 (FIG. 6D) which is engageable with the outer side wall surface of a lower tray in a stacked arrangement to create a dust seal therebetween. In the loaded condition, the stackable nestable trays are supported as shown in FIGS. 7B and 7C. In the empty condition, the trays are supported as shown in FIGS. 7 and 7A.

Figure 7:
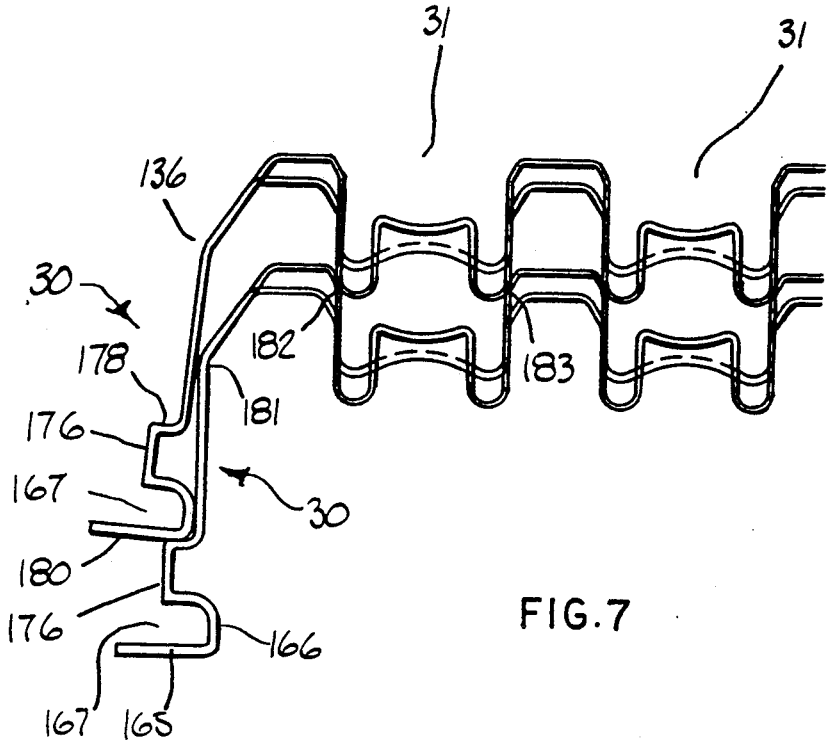
FIGS. 7-7C are partial cross-sectional views of an alternative tray embodiment showing a pair of unloaded and loaded trays in stacked relationship.
Figure 7B:
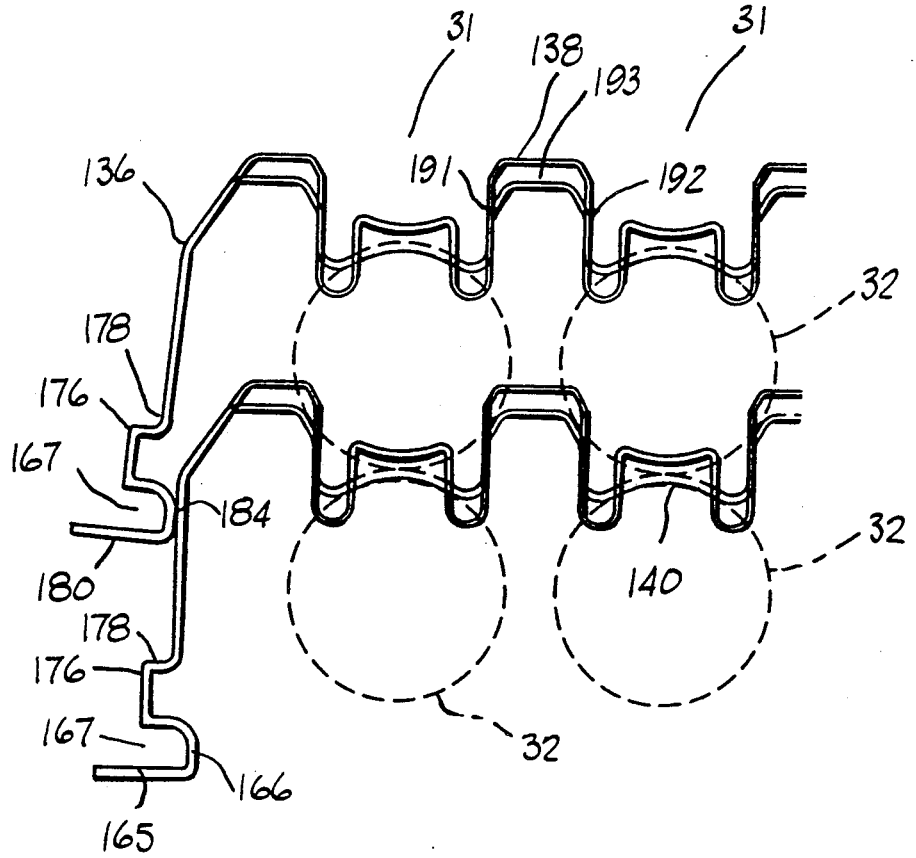
Figure 7A:
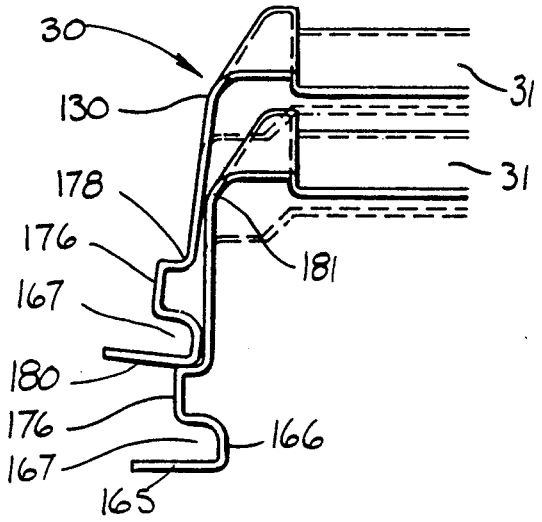
Figure 7C:
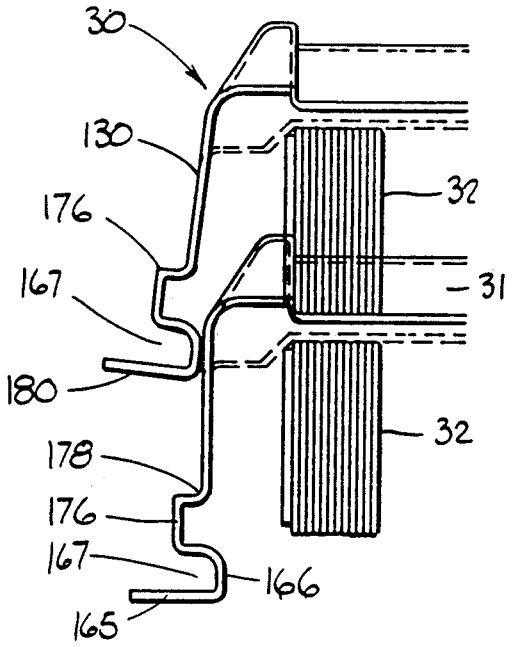

FIGS. 7–7B show an alternative form of the tray means which includes a reinforcement rib portion 176 in each of the side wall portions above the grooves 167–170 which also provides a shelf 178 to abuttingly support lower surface 180 in a stack of empty trays and provide a gap at 181 to prevent wedging in a stack of empty trays (FIGS. 7 and 7A) while tray surfaces are also abuttingly engaged at 182 and 83 as shown in FIG. 7. When loaded trays are stacked as shown in FIGS. 7B and 7C, the trays contact one another at 84 to provide a dust seal and are supported on the ends at 186, 188, 189, 190. The rib portions 138 have a generally rectangular shape defined by vertical side wall portions 191, 192 and a flat horizontal upper wall portion 193. Bottom wall portion 140 is arcuate.

FIGS. 26A–H show a presently preferred embodiment of the tray means which is hereinafter discussed in detail.

THE TRAY HOLDING AND TRANSFER MEANS

Figure 16:
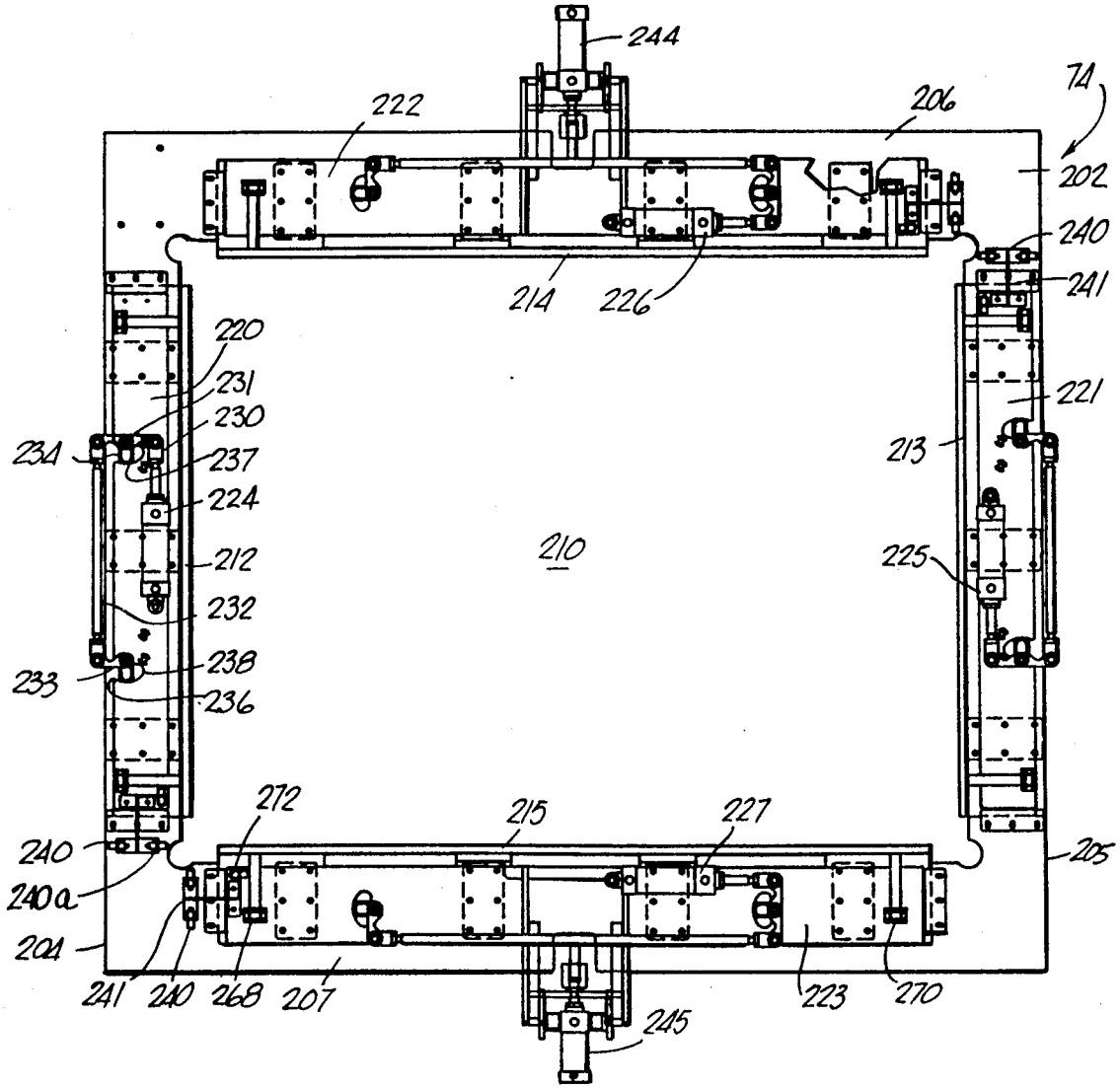
FIG. 16 is a plan view of a tray holding means assembly of the palletizer system of FIG. 1.
Figure 16A:
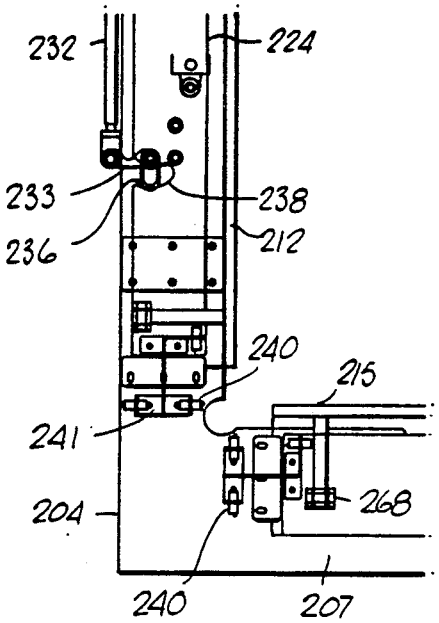
FIG. 16A is an enlarged plan view of a portion of the tray holding means assembly of FIG. 16.
Figure 17A:
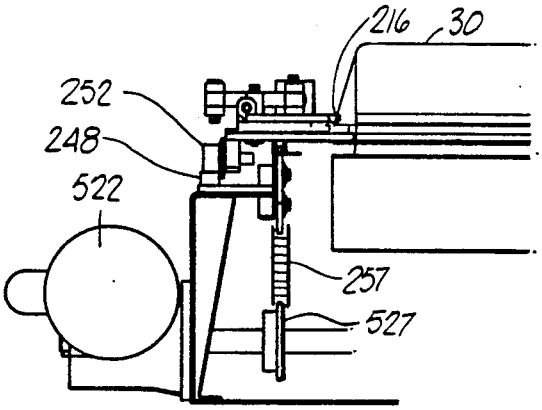
FIG. 17A is an enlarged side elevational view of a portion of the assembly of FIG. 17 showing a portion of the track means and drive means for the tray holding means.
Figure 18A:
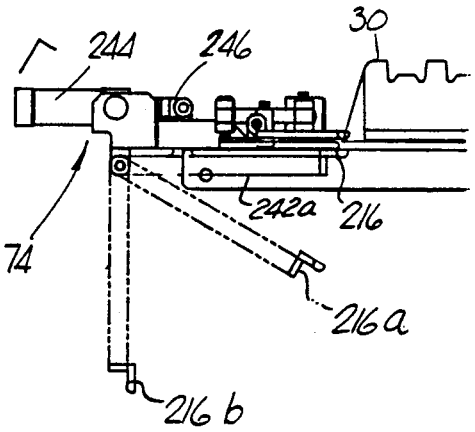
FIG. 18A is an enlarged end view of a portion of the assembly of FIG. 18.
Figure 17:
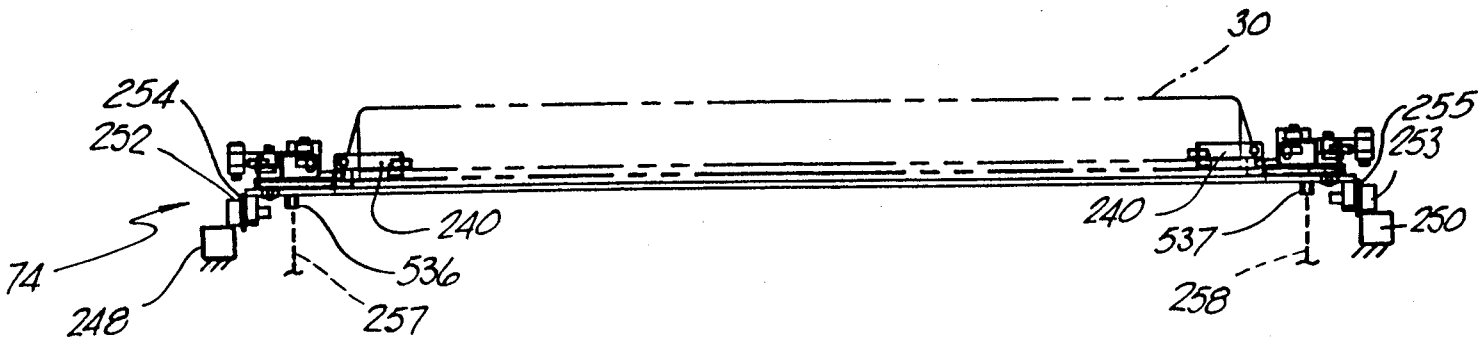
FIG. 17 is a side elevational view of the assembly of FIG. 16.
Figure 18:
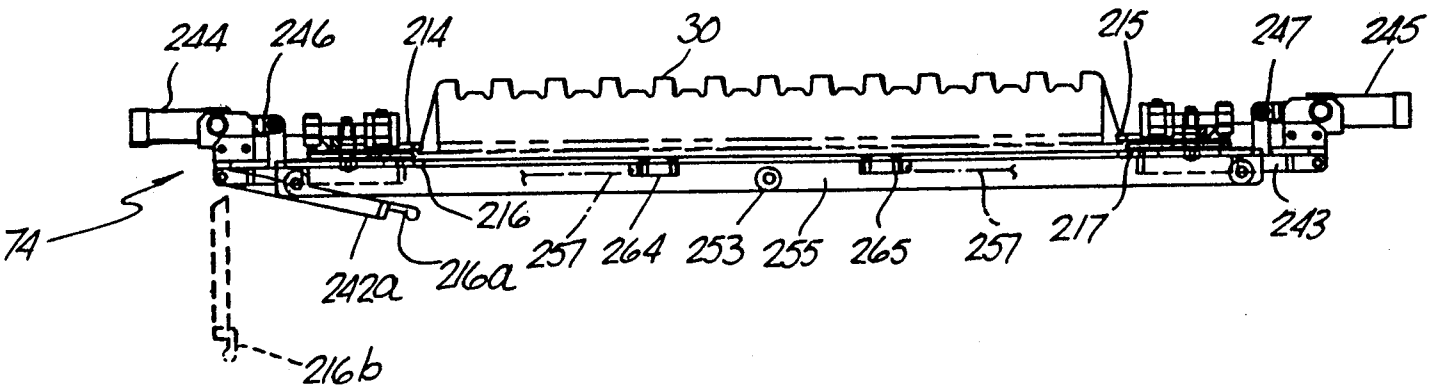
FIG. 18 is an end view of the assembly of FIG. 16.
Figure 19:
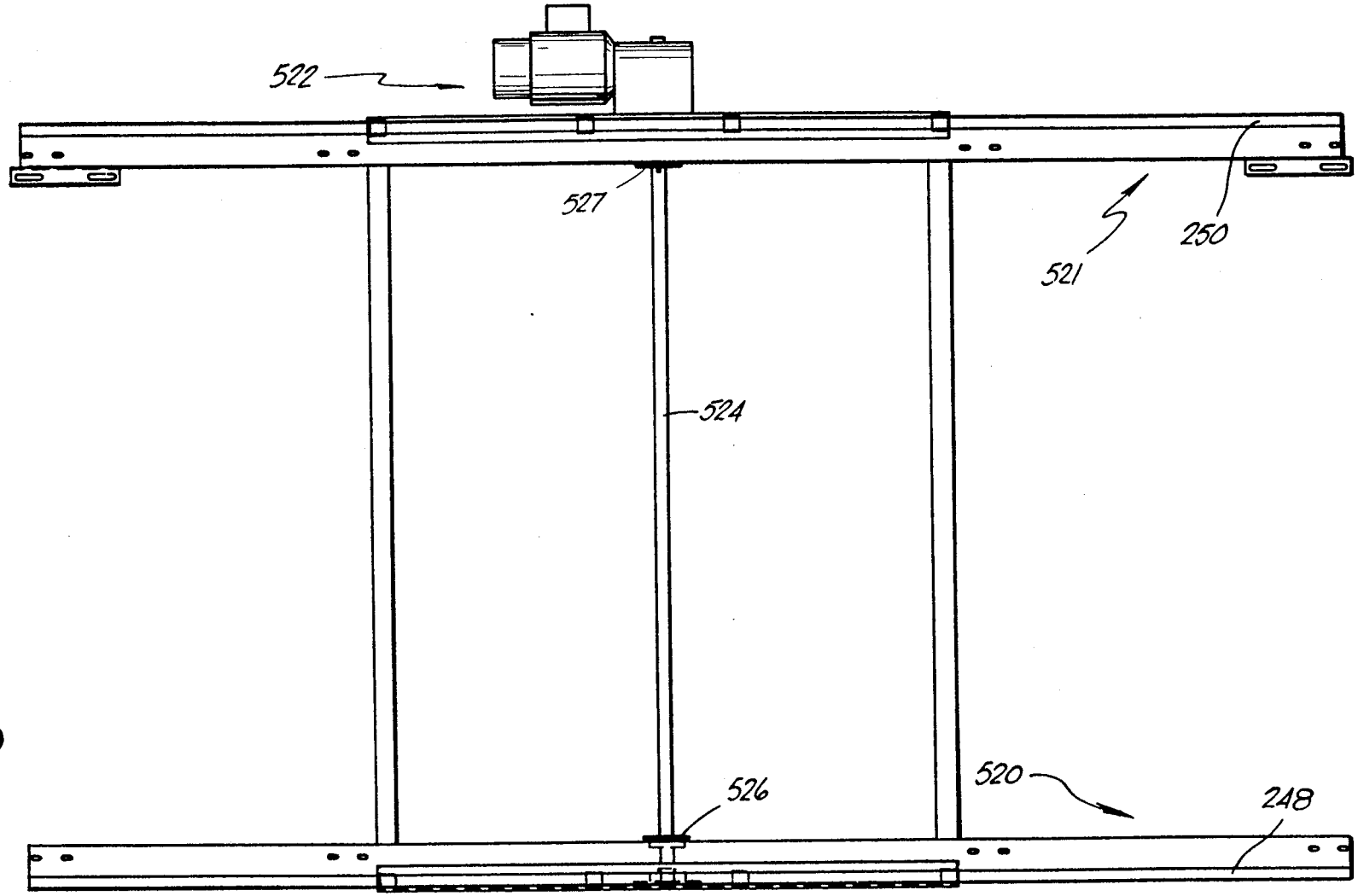
FIG. 19 is a plan view of the tray carrier conveyor.
Figure 20:
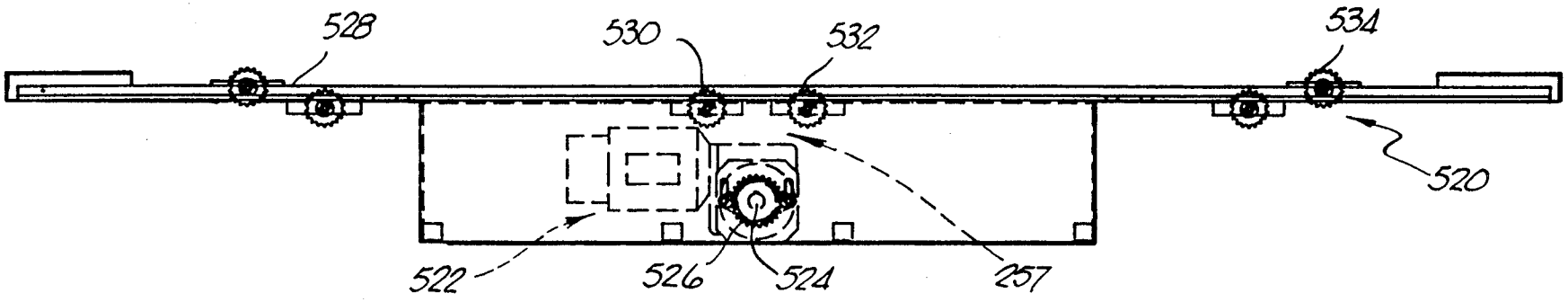
FIG. 20 is a side view of the tray carrier conveyor of FIG. 19.
Figure 21:
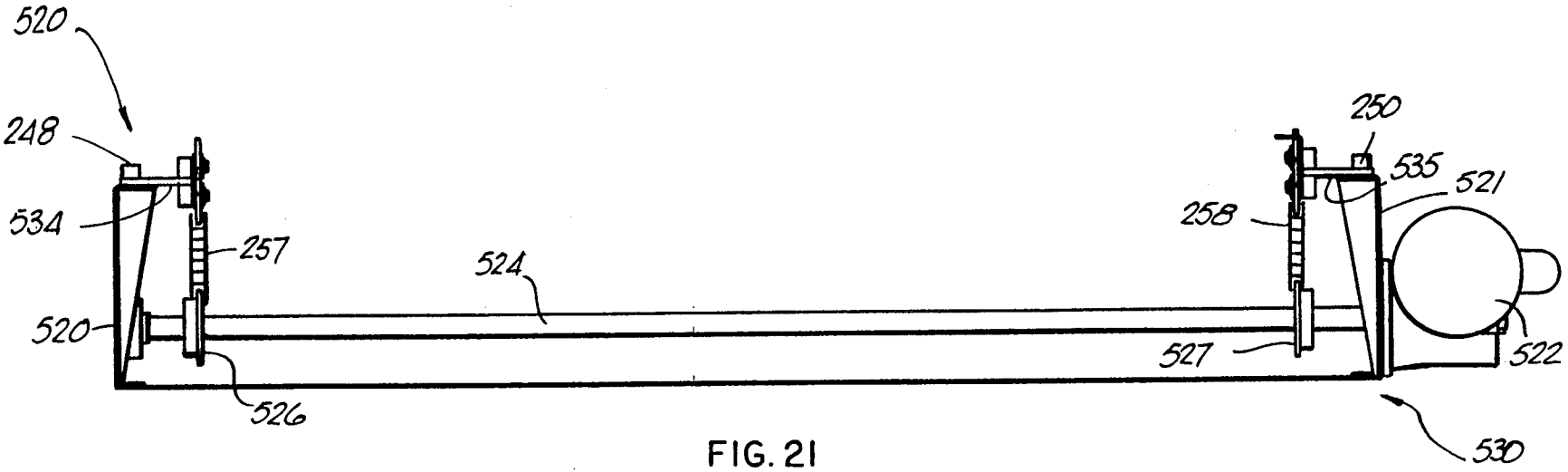
FIG. 21 is an end view of the tray carrier conveyor of FIG. 19.

As shown in FIGS. 16–18, the tray holding means 74 comprises a framework 202 of four sides 204, 205, 206, 207 having a central rectangular opening 210 for receiving a tray means 30 therewithin. Each side of the frame means has an uppermost elongated support rod means 212, 213, 214, 215 having a cross section such as to be receivable in the elongated groove means in the tray side walls as shown in FIG. 6D. In addition, each of the long sides 206, 207 of the frame means has another lowermost elongated support rod means 216, 217 (FIG. 18) for holding and flexing the elongated side wall portions of a tray means beneath an uppermost tray means to enable separation.

The support rod means 212–215 are mounted on slide plate members 220, 221, 222, 223. Each of the slide plate members are operable by air cylinders 225, 226, 227, 228 through linkages 230, 231, 233 and cam members 234, 236 operable in cam slots 237, 238. Slide plate members are slidably movable inwardly and outwardly relative to opening 210 and a tray means therewithin from a retracted outermost release position to an inwardly extended holding position. Each air cylinder is controlled by magnetic proximity switches 240, 240A and switch actuator fingers 241. Lowermost rod members 216, 217 are mounted on pivotal bracket **242*a* (FIG. 18A), 243 operated by air cylinders 244, 245 (FIG. 18) through linkage 246, 247**.

The tray holder means is movably supported on track means 248, 250 by roller means 252, 253 mounted on support side plate means 254, 255, FIG. 17, for movement between the loading position and the loaded tray stacking position. The tray holder drive means comprises a motor means 256 (FIG. 1) connected to a pair of chain means 257, 258 (FIG. 17). Each chain means is supported by spaced sprocket means 260, 261, 262 (FIG. 1). The ends of each chain means are connected to the tray sideplate means at 264, 265, FIG. 18. Electrical and pneumatic connections to the tray carrier operating apparatus are made through a conventional hollow cable tray chain means 266 which is moved back and forth with the tray carrier positioned as shown in FIG. 1.

In operation, when the tray carrier is at the loading position the uppermost empty tray from the stack of empty trays 79 is raised through opening 210 until the tray side grooves are aligned with the clamp rods 212, 213, 214, 215. Cylinders 224, 225, 226, 227 are actuated to move the clamp rods into the grooves. When the clamp rods are located in the grooves, sensors 240 generate a control signal to lower the elevator 81 and actuate cylinders 244, 245 to pivotally downwardly displace clamp rods 216, 217 (as illustrated in phantom at 216*a*—FIG. 18) into engagement with opposite side walls of the next lower tray to apply a downwardly directed force to assure separation from the tray held on the tray carrier. Clamp rods are returned to the retracted position by a control signal generated by a rotary encoder control unit associated with the elevator means to control up and down movement. Before the last tray on the pallet 80 is moved into the tray carrier, the brackets 242, 243 are pivoted to a fully vertical position indicated in phantom at 242*b* in FIG. 18 to avoid contact with the pallet in response to a signal from the rotary encoder. The release clamp bars 216, 217 are returned to the horizontal position while the tray is being loaded.

After the tray has been loaded, it is pulled along track means 248, 250 from the end loading position to the loaded tray palletizing position above elevator means at station 75 whereat a proximity sensor means 267 (FIG. 1) is activated to stop the carrier tray movement. The elevator means is controlled by a rotary encoder unit so as to be movable incrementally. Each of the tray clamping rods 212, 213, 214, 215 are pivotally supported by suitable pin and clevis means 268, 270 (FIG. 16) to enable limited pivotal upward movement from a horizontal clamping position to an upwardly inclined release position. When the palletizer elevator is raised, either an empty pallet or an uppermost full tray on the pallet engages and slightly lifts (e.g., approximately 1 inch) the full tray on the tray carrier causing upward pivotal movement of the clamping bars. Each of the clamping bars has an associated magnetic proximity sensor means 272, FIG. 16, which is actuated by the upward pivotal movement to generate a control signal to actuate the cylinders 224, 225, 226, 227 and retract the clamping bars whereupon a signal is generated to cause lowering of the elevator means to a position below the tray carrier which is then returned to the loading position in response to a signal generated by the elevator encoder unit. A proximity sensor unit 274 (FIG. 1) is actuated by the tray carrier to stop movement when the loading position has been reached.

Stacker Means

Figure 9A:
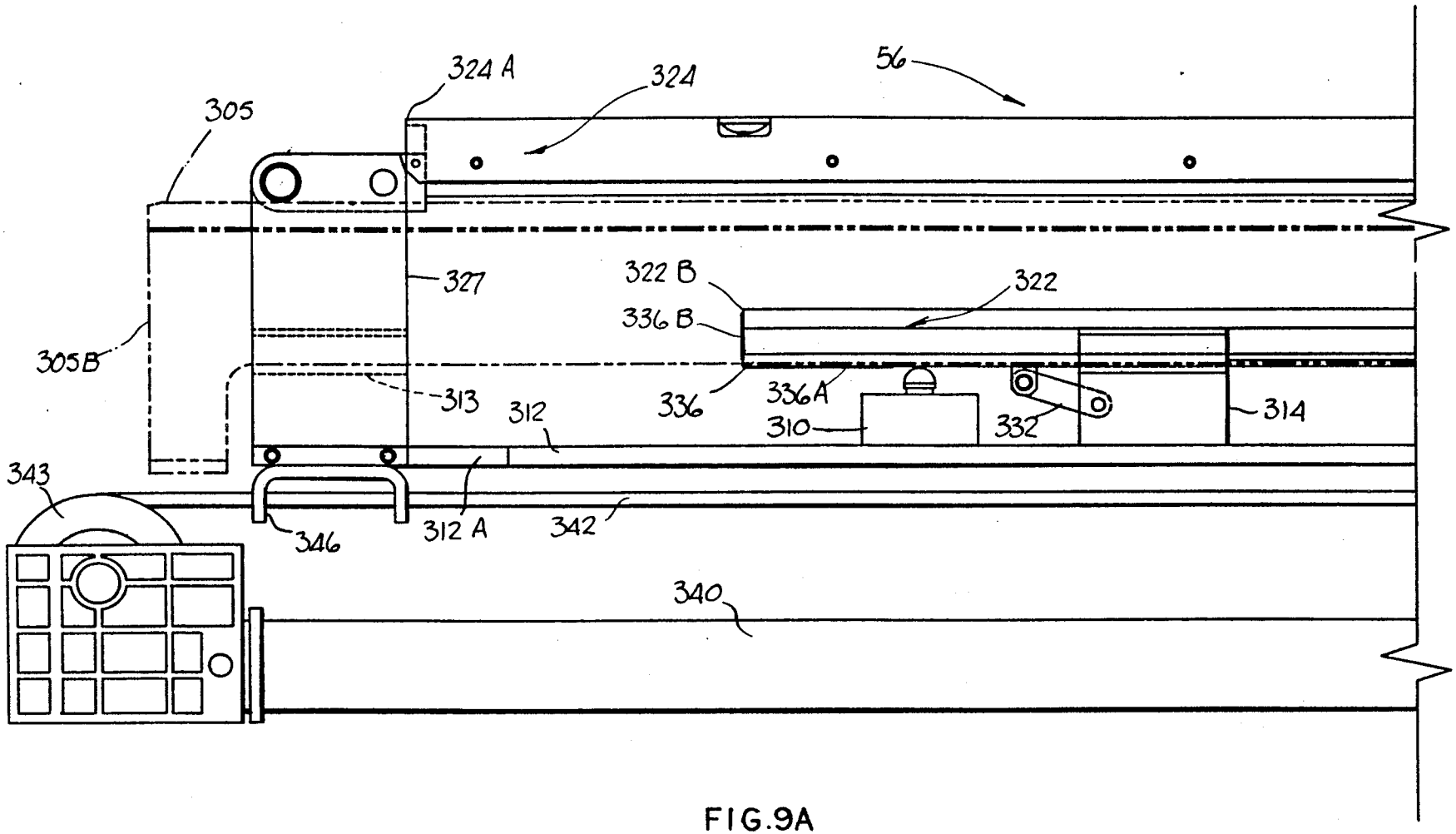
FIGS. 9A and 9B are partial side elevational views of a segmenter assembly of the palletizer system of FIG. 1.
Figure 9B:
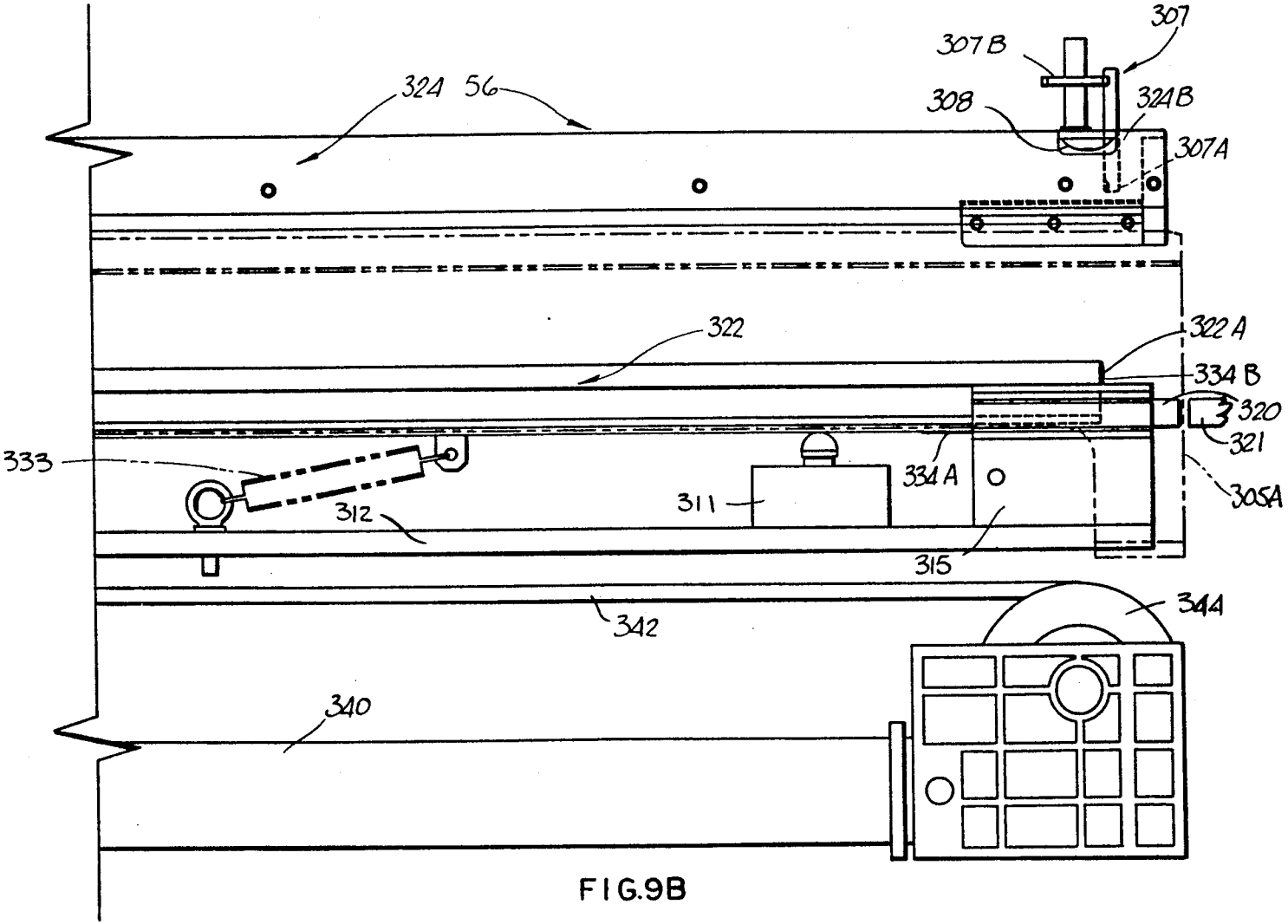
Figure 10:
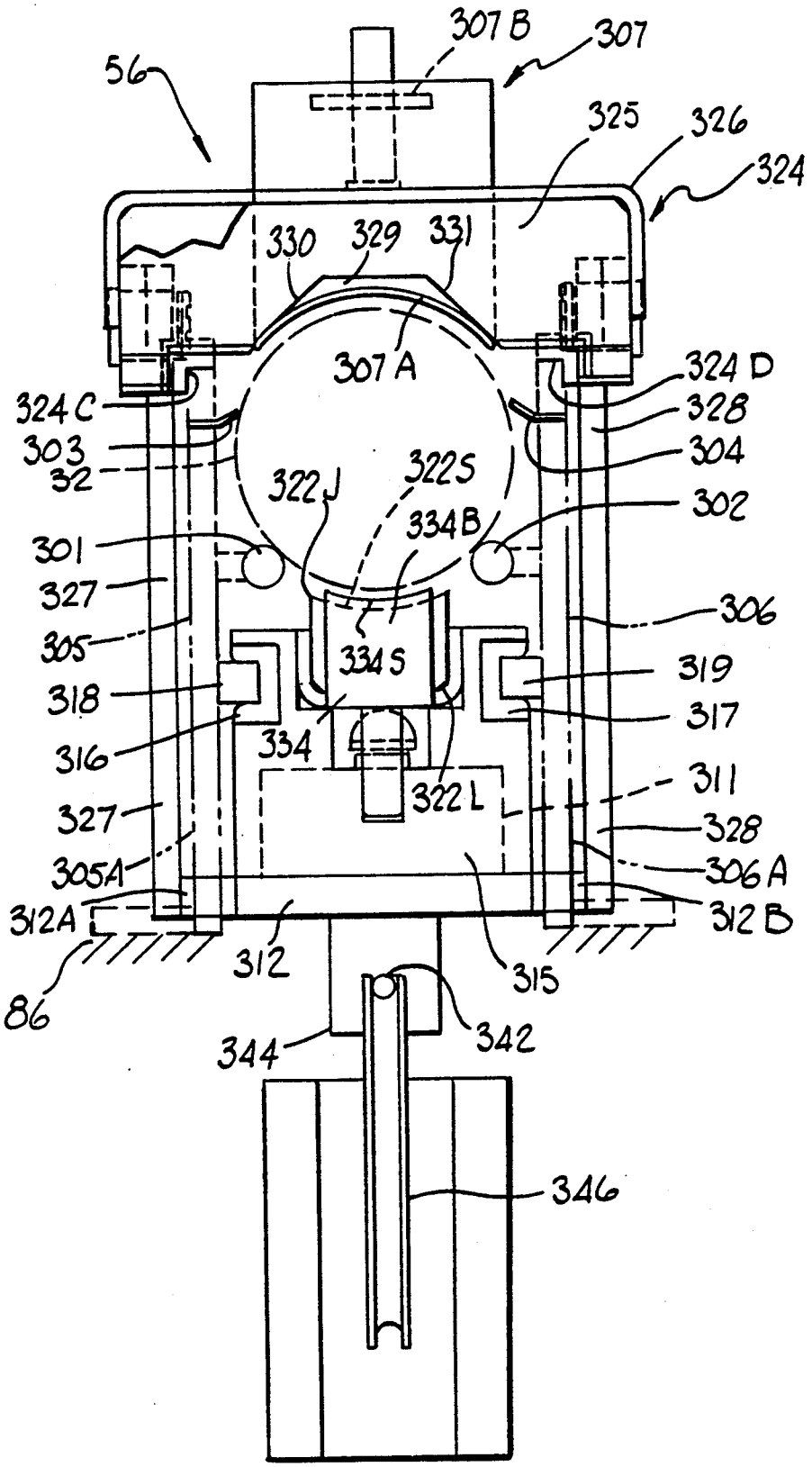
FIG. 10 is an end view of the segmenter assembly of FIG. 9.

As shown in FIGS. 9A–13, each of the stacker means 54, 55, 56 comprises a fixed elongated horizontal guide and support rail means, which forms a continuation of the associated feed track means for continuously receiving and movably supporting the continuously advancing string of end members. The guide rail means comprises a lowermost pair of guide rail members 301, 302 (FIG. 10) which support lower peripheral portions of the end members 32 and an uppermost pair of flexible rubber flap members 303, 304 which lightly engage upper peripheral portions of the end members. Members 301, 302, 303, 304 are fixedly mounted on elongated spaced vertical side plate members 305 and 306 (FIG. 10). Each side plate member is fixedly mounted on the frame means 86 by front and rear end downwardly extending support leg portions shown at 305A, 305B (FIG. 9A) and 306A (FIG. 10).

An adjustable end feed stop means 307 is provided to stop the flow of can end members. Stop means 307 comprises a metal plate member having a generally rectangular peripheral configuration with an arcuate lower surface 307A having a radius and a profile generally corresponding to the radius and profile of the end members so as to contact an abutting end member along an upper portion of its periphery when the plate member is lowered by an adjustment screw 307B into a set position in the path of movement during use. A sensor means 308 (FIG. 9B) is provided to generate a control signal when end members are located adjacent thereto to indicate that the guide rail means are filled with end members and actuate pancake-type air cylinder means 310, 311 for a purpose to be hereinafter described.

Cylinders 310, 311 are fixedly mounted on an elongated horizontal T-shape support plate member 312 located between and being movable relative to vertical plate members 305, 306 (shown by phantom lines) (FIG. 10) except for laterally outwardly extending rear end portions 312A and 312B. Support block members 313, 314, 315 (FIGS. 9A and 9B) are fixedly mounted on plate member 312. As shown in FIG. 10, each of the support block members 313, 314, 315 support opposed U-shaped plastic slide bearings 316, 317 which slidably receive elongated guide bars 318, 319 fixedly mounted on side plates 305, 306 and extending the full length of the apparatus. A front end portion 320 of each guide bar 318, 319 is aligned with a rear end portion 321 of corresponding guide bars on the shuttle tray apparatus.

An elongated lower clamping jaw means 322 is movably mounted on and supported by support block members 314, 315. Jaw means 322 comprises an elongated block of plastic material 322J having a generally rectangular cross-sectional configuration with an elongated curved upper abutment surface 322S corresponding to the periphery of the end members to engage a lowermost portion of the circular periphery of a length of abutting end members located between the front and rear end portions 322A, 322B thereof (FIGS. 9A and 9B). Jaw member 322J is preferably mounted in a metallic U-shape support member 322L supported in elongated slots in the support blocks 314 and 315. An upper elongated clamping jaw means 324 comprises an elongated jaw member 325 (FIG. 10) made of a block of plastic material having a generally rectangular cross-sectional configuration and fixedly mounted in an elongated U-shaped metallic cover member 326. A rear end portion 324A of the jaw means is mounted on a bracket pivotally mounted on spaced vertical plate members 327, 328 located on opposite sides of block member 313 and fixedly connected to and supported by plate portion 312A and 312B. L-shaped plastic bearing means 324C, 324D are mounted on upper jaw front end portion 324B and engage fixed side plates 305, 306. Upper jaw member 325 has an elongated jaw cavity 329 with spaced inclined abutment surfaces 330, 331 for abutting engagement with circumferentially spaced uppermost peripheral portions of the end members.

Lower clamping member 322 is supported in the lowermost position by spaced support block members 314, 315 and pivotally connected to at least one block member 314 by a link member 332 (FIG. 9A) to provide an upward and forward movement to lift and separate a stack of end members on the rail members 301, 302 from the string of end members when cylinder 310 is actuated by a track "full" signal from sensor 308. A return spring means 333 (FIG. 9B) is connected to the lower jaw means to cause return movement when cylinders 310, 311 are deactivated. The front cylinder 311 is preferably actuated slightly ahead of the rear cylinder 310 to effect an initial lift and clamping engagement at the front end of the stack.

Cut-off blade means 334, 336 are mounted adjacent the front and rear end portions 322A, 322B of the lower jaw means to engage end members at opposite ends of the stack. Each cut-off means comprises an L-shaped spring steel member having a base portion 334A, 336A fixedly mounted to the lower jaw member and an upwardly extending resiliently deflectable blade portion 334B, 336B located above the clamp surface 322S (FIG. 10) and having a curved upper end portion 334S so as to engage the bottom portion of the first end member of the stack during clamping and prevent tipping. Rear blade portion 336B has a curved upper surface for separating the last end member of the stack from the approaching string.

The clamping apparatus assembly is movably supported by the fixed support plate members 305, 306 and guide bar members 318, 319 for reciprocable forward and rearward movement relative to the shuttle tray means 64. The clamping apparatus assembly is moved by an air cylinder means 340 (FIGS. 9A and 9B), having a relatively long stroke (e.g. 54 inches) which operates a cable 342 supported by pulley members 343, 344 and attached to the rear portion of the clamping apparatus by connector means 346. The apparatus may be reversely actuated to receive a stack of ends from the shuttle tray means in the extended position and to carry a stack of ends from the shuttle tray means to the retracted position.

SHUTTLE TRAY MEANS

Figure 14:
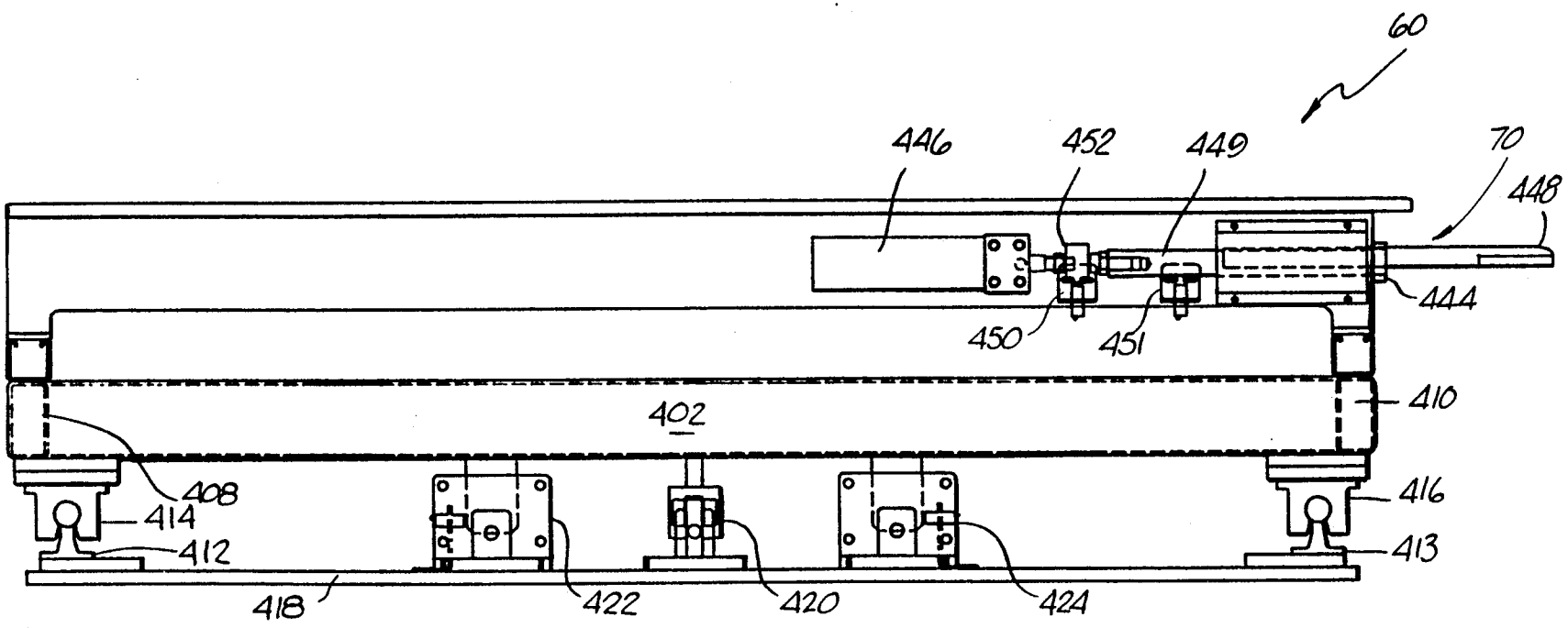
FIG. 14 is a side elevational view of a shuttle tray assembly of the a palletizer system of FIG. 1.
Figure 15:
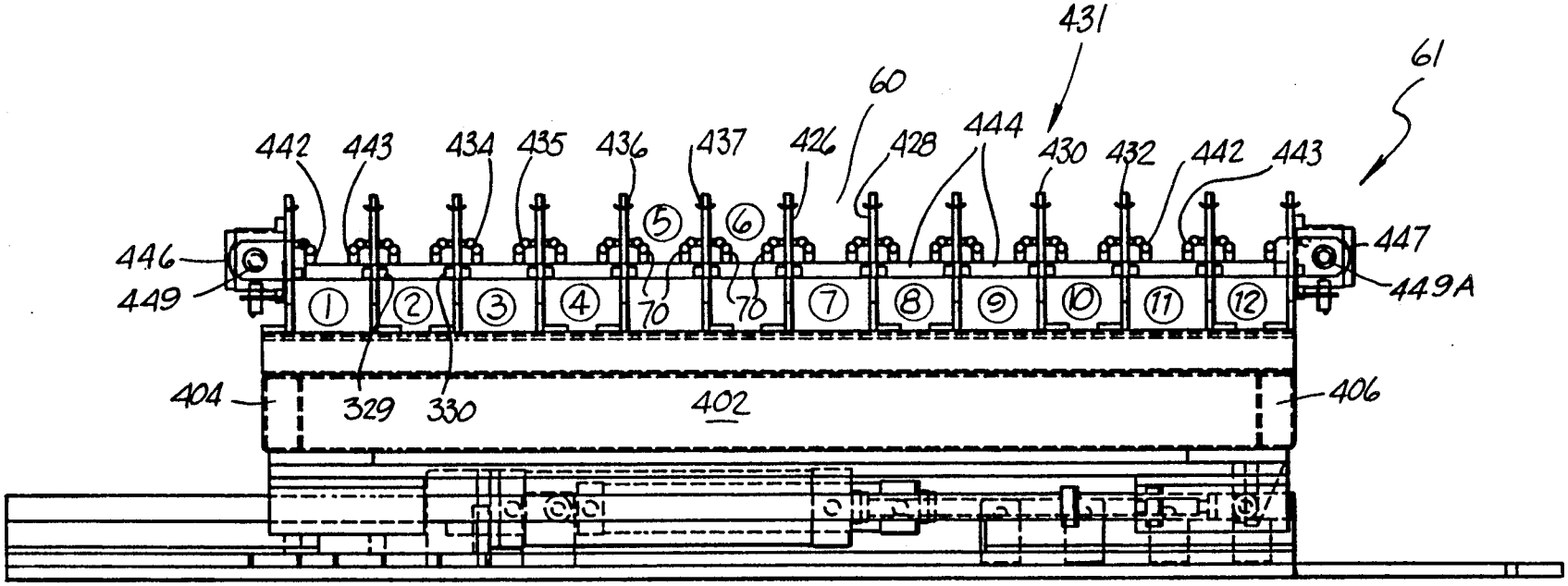
FIG. 15 is an end view of the shuttle tray assembly of FIG. 14.

As shown in FIGS. 14 and 15, the shuttle tray means 61 comprises a carriage platform 402, having frame portions 404, 406, 408, 410, and reciprocably supported for lateral movement by fixed rail means 412, 413 and movable slide means 414, 416. Rail means 412, 413 are mounted on a plate member 418 which also supports a drive cylinder means 420 and a pair of stop cylinder means 422, 424 for controlling movement of the shuttle tray means. Each of the twelve trough means 60 are formed by fixed vertical side plate members 426, 428 having elongated guide bar members 329, 330 fixed thereon in alignment with guide bar members 318, 319 and uppermost guide rails 431, 432 to support the stacker units during transfer of the stacks of end members to the trough means 60. The end members are slidably supported between the plate members by lower elongated guide rails 434, 435 and flexible side guide rail members 436, 437 mounted on the side plate members and being aligned with and corresponding to rail members 301, 302, and flap members 303, 304. The construction and arrangement is such as to enable the stacker jaw apparatus to be moved into the spaces (troughs) 60 between the plate members 426, 428 and located relative to the guide rails 434, 435 in the same manner illustrated in FIG. 10.

When the stacker units are in position in the troughs 60, cylinders 310, 311 (FIGS. 9A and 9B) are deactuated and the lower jaw member is pulled downwardly to the retracted position by return spring means 333. During downward movement of the lower jaw member, the ends engage and are supported by rail members 434, 435 to fill the trough with the stack of ends. Then, the stacker units are retracted by actuation of cylinder 340 (FIGS. 9A and 9B) and movement along bars 318, 319, 320, 321, 329, 330 to the original position at the stacking station. The stacker units are returned to the stacking station before the rail members 301, 302 are filled with end members which continue to advance along the rail members 301, 302 during the transfer of stacks of end members to the shuttle tray. The three stacker units are operated simultaneously.

When the carriage is fully extended as shown in FIG. 15, the three stacker units 54, 55, 56 are initially aligned with troughs 1, 5 and 9 (circled numerals FIG. 15). When troughs 1, 5 and 9 have been filled, the stacker units are retracted to be refilled and the carriage is moved to a second position whereat the stacker units are aligned with the next set of troughs 2, 6 and 10. The process is repeated by moving the carriage to a third position in alignment with troughs 3, 7 and 11 and then to a fourth position in alignment with troughs 4, 8 and 12 until all troughs have been filled. In the final situated fourth position of the carriage, the twelve troughs are aligned with the twelve compartments on the tray means 30 at the loading station 34. After the troughs have been emptied, the carriage is returned to the first position.

Extendable and retractable end guide and lift rod means 70 (FIGS. 6D and 14) are provided on the front end of the shuttle tray carriage 402 to enable the end members to be lifted over the adjacent end wall portion 154 (FIG. 6C) of the tray means as the stacks of end members are transferred to the tray compartments 31. There are twelve sets of lift rods 442, 443 (as illustrated in FIGS. 6D and 15) which are mounted on a cross plate member 444 actuated by power cylinder means 446, 447 mounted on opposite sides of the carriage. There are two rod members between each set of plate members 426, 428. The rod members have a cross-sectional configuration and spacing corresponding to the cross-sectional configuration and spacing of the slots in the end walls of the tray as shown in FIG. 6D. The upper surfaces 448 (FIG. 14) of the rod members are rounded and located closely adjacent the guide rails 434, 435 so as to be tangent to and to engage the rim of the end members. The lift rods are fixedly mounted on cross-plate member 444 which are connected to the power cylinders by slide rods 449, 449A, FIG. 15, and by adjustable coupling means 452. The position of lift rod members 442, 443 is sensed by proximity sensors 450, 451 to prevent operation of the shuttle tray means unless the rod members are in the proper retracted position. The apparatus may be reversely operated to unload stacks of ends from a loaded tray in a depalletizer system. The lift rod members are inserted through the tray slots to lift the adjacent end of the stack over the tray abutment surfaces as the stacks are pushed out of the tray compartments as hereinafter described.

PUSHER MEANS

Figure 11:
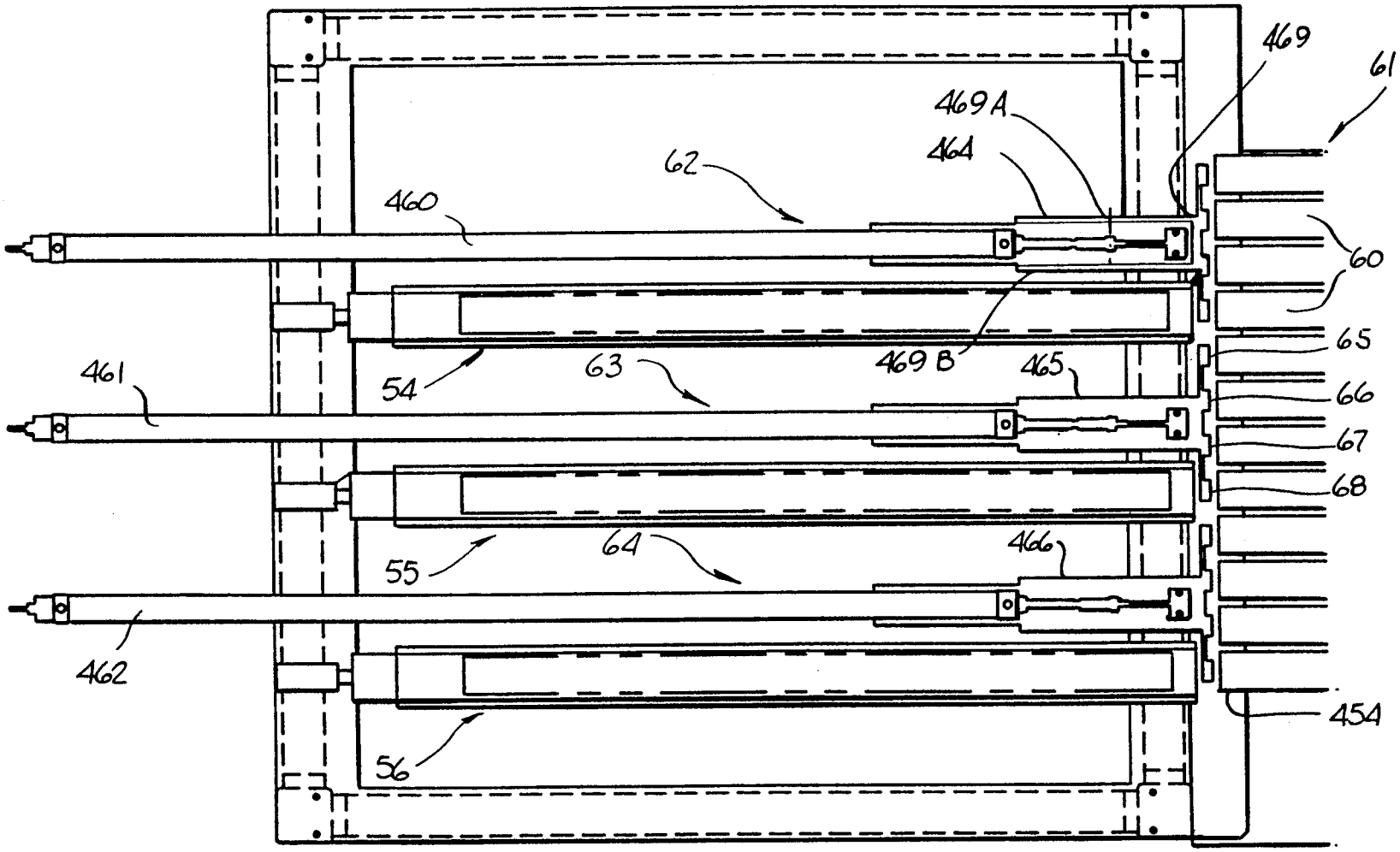
FIG. 11 is a plan view of the pusher assembly of the palletizer system of FIG. 1.
Figure 12:
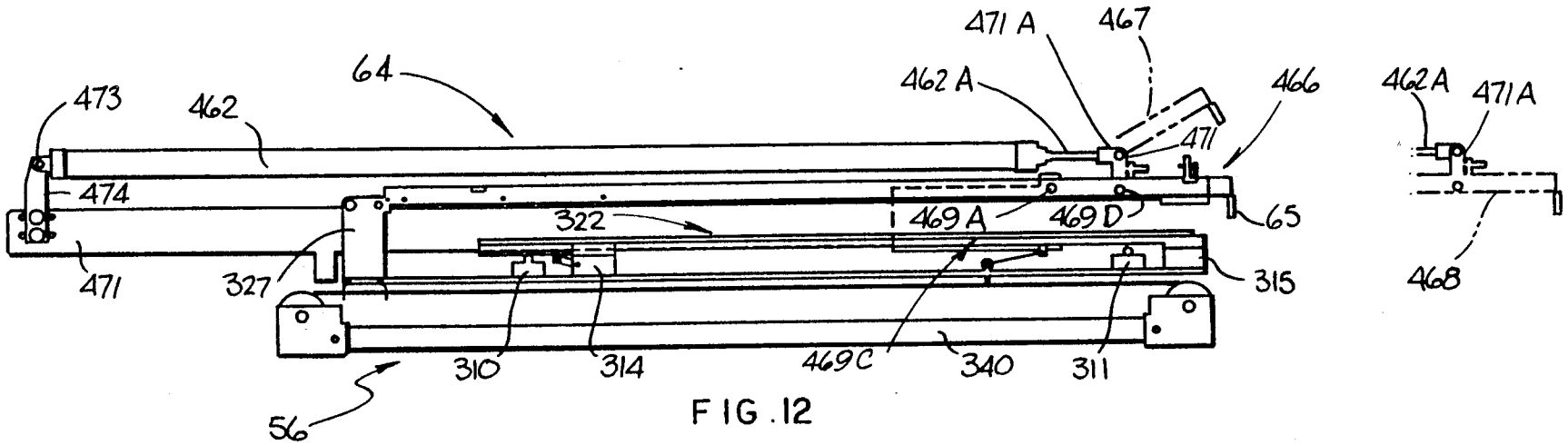
FIG. 12 is a side elevational view of the pusher assembly of FIG. 11.
Figure 13:
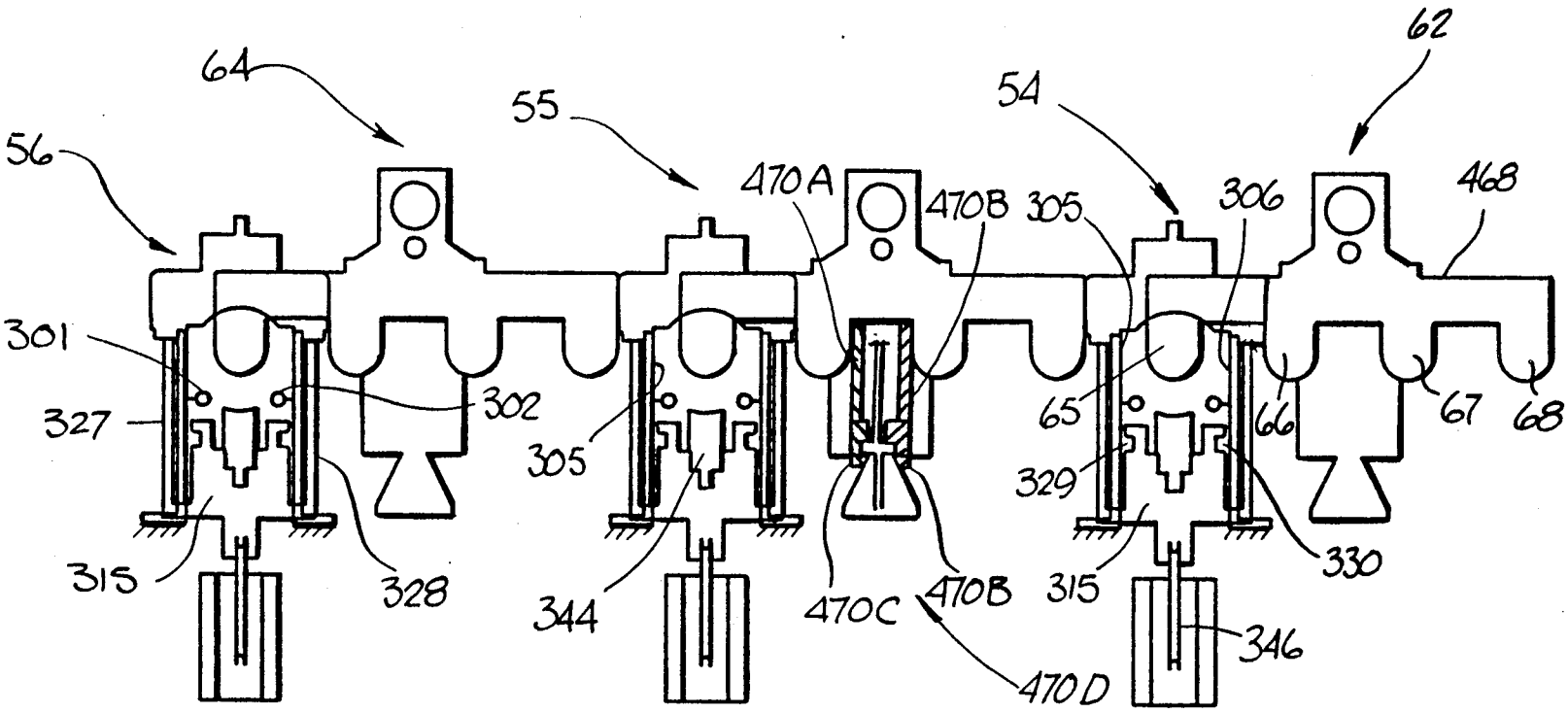
FIG. 13 is an end view of the pusher assembly of FIG. 11.
Figure 13A:
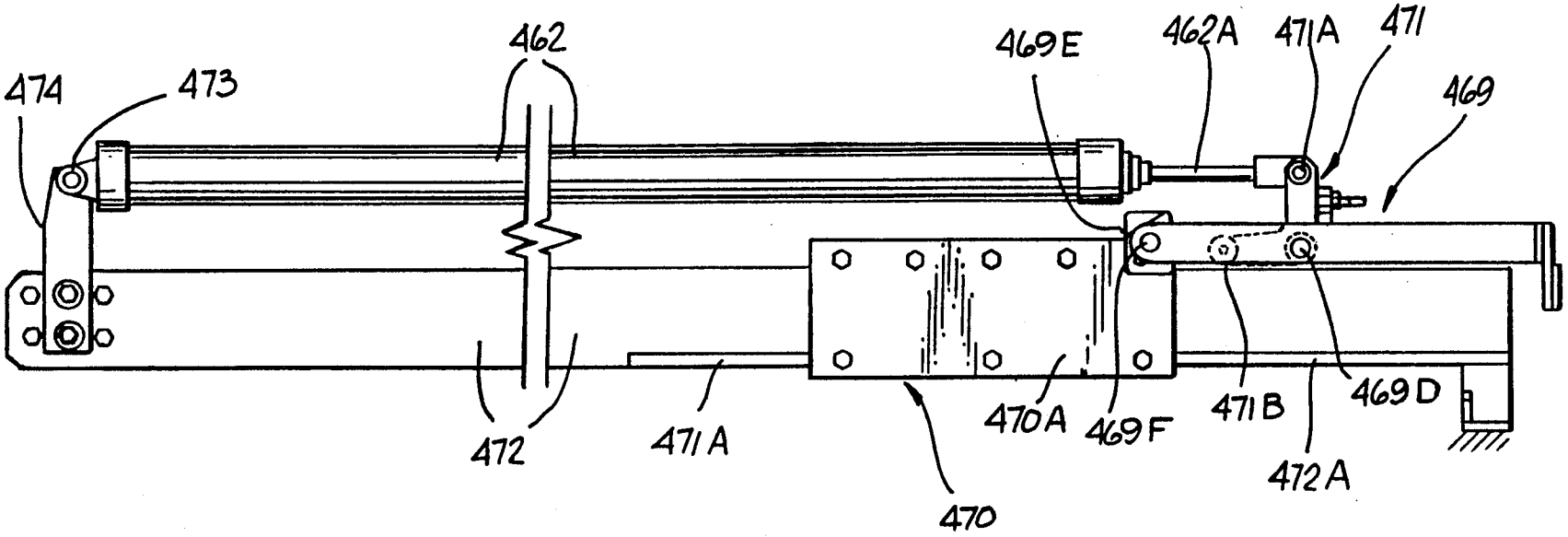
FIG. 13A is a side elevational view of one pusher unit of the pusher assembly of FIG. 13.
Figure 13C:
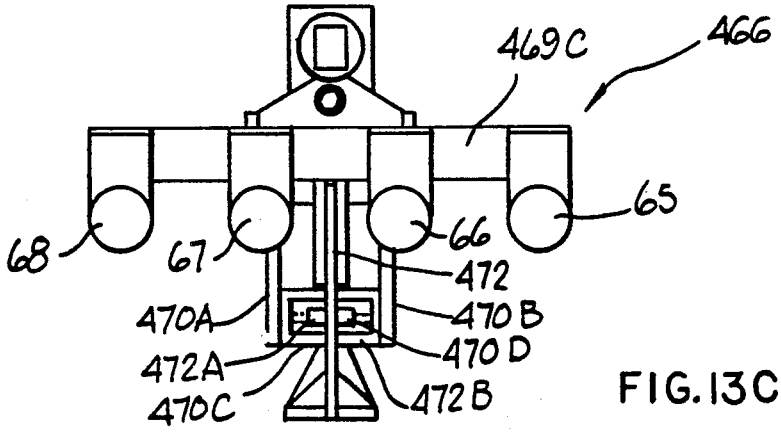
FIG. 13C is an end view of the pusher unit of FIG. 13.
Figure 13B:
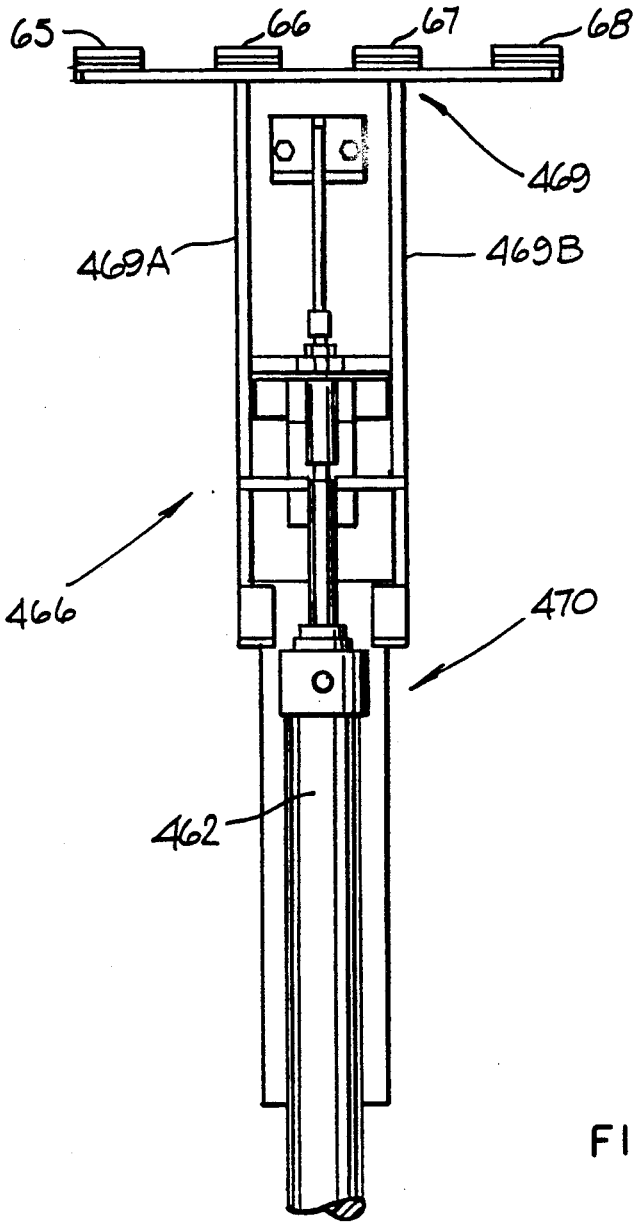
FIG. 13B is a top view of the pusher unit of FIG. 13.

As shown in FIGS. 11–13, the pusher means 62, 63, 64 are mounted on the same framework as and in juxtaposition to the stacker units 54, 55, 56. Each pusher means comprises a power cylinder unit 460, 461, 462 for moving an associated push head unit 464, 465, 466 between a retracted upwardly inclined position shown in phantom lines in FIG. 12 at 467, a horizontal position shown in solid lines in FIG. 12, and an extended horizontal position shown in phantom at 468 in FIG. 12. Each head unit has four circular pusher head plates 65, 66, 67, 68 made of rubber and having a diameter slightly smaller than the diameter of the end members. The pusher head plates are fixedly mounted on a pivotal bracket means 469 (FIGS. 13A, 13B, 13C) comprising parallel side plate members 469A, 469B and a cross plate member 469C. Side plate members 469A, 469B are pivotally connected to a slide means 470 at 469F and to a connecting link means 471 at 469D. Link means 471 is pivotally connected to the power cylinder rod 462A at 471A and has a cam roller 471B which causes upward pivotal movement of bracket means 469 when the cylinder rod 462A is moved rearwardly from the position shown in FIG. 13A. An inclined stop surface 469E limits upward pivotal movement.

Slide means 470 comprises a pair of spaced parallel downwardly extending plate members 470A, 470B located on opposite sides of a central fixed plate member 472 having guide bar members 472A, 472B fixed thereon. Oppositely facing shaped guide members 470C, 470D with plastic guide shoes are mounted on plate members 470A and 470B and receive guide bar members 472A, 472B. Guide bar members 472A, 472B are aligned with and terminate adjacent the guide bar members on the shuttle tray so that the slide means 470 is slidably supported on corresponding guide bar members on one of the support plate members on the shuttle tray.

The rear end of each power cylinder is pivotally supported at 473 on a bracket 474 adjustably mounted on the rear end of support plate 472 so as to avoid binding during movement.

In operation, after all the tray compartments have been filled by the stacker means, the power cylinders 460, 461, 462 are simultaneously actuated to move the pusher units from the retracted upwardly inclined position to a lowered horizontal position, and then to and through each of the shuttle tray troughs to push the twelve stacks of ends into the tray compartments as previously described. The apparatus may be reversely operated to provide back-stop means in a depalletizer system when stacks of ends are moved into the troughs on the shuttle tray means from the loaded end member tray holding means 30.

STOPPER MEANS AND SWEEPER MEANS

As shown in FIG. 3C, releasable stop means 69 is provided at the end of each shuttle tray trough to engage the adjacent end member to hold the stacks of end members in position in the trough means until the pusher means are operated and to provide an abutment during movement of the stacks. Brush means 72 may be provided to sweep the end compartments in the tray means as the pusher means move forwardly to load the stacks of ends onto the tray means.

Figure 22:
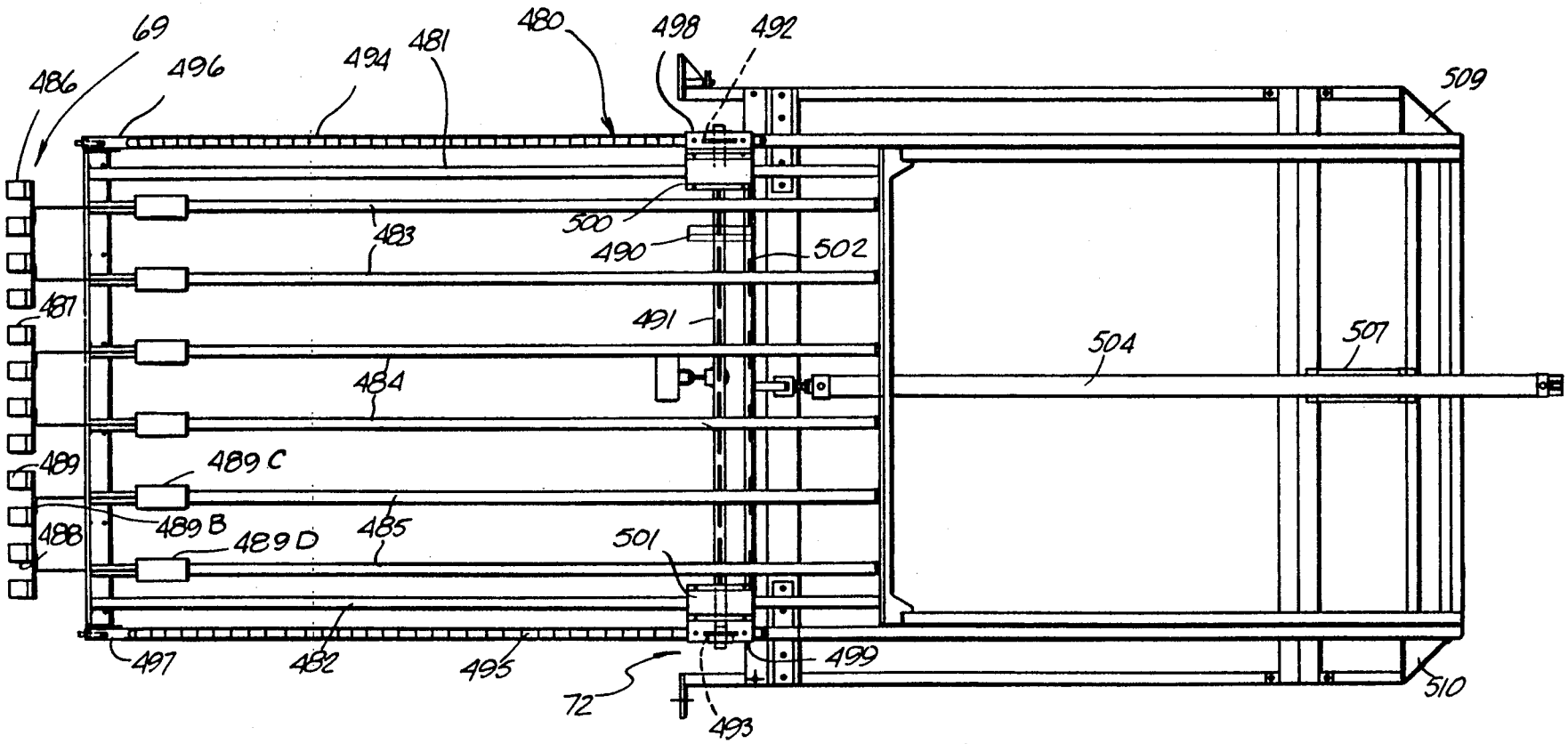
FIG. 22 is a plan view of the backstop and sweeper assembly.
Figure 23:
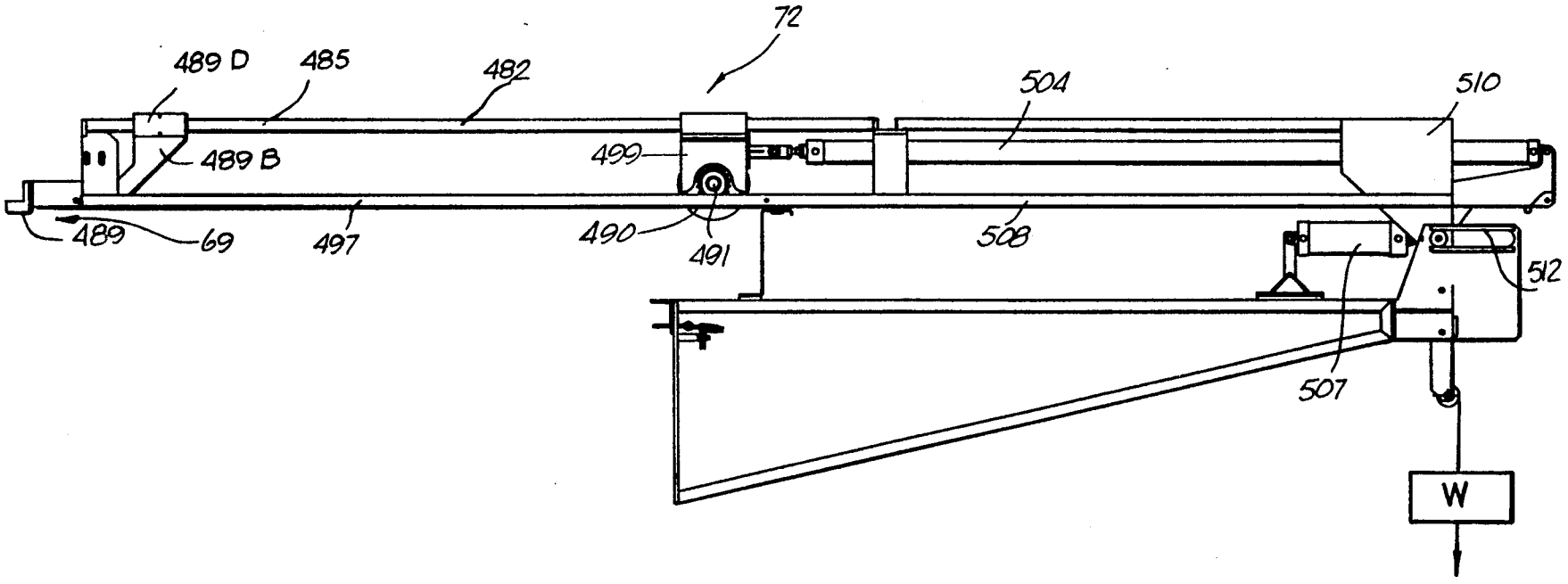
FIG. 23 is a side view of the apparatus shown in FIG. 22.

As shown in FIGS. 22 and 23, the stopper means 69 and sweeper means are mounted on a support frame means 480 having outer and inner sets of guide rails 481, 482; and 483, 484 and 485. Three stopper units 486, 487, 488 are slidably supported on the inner guide rails 483–485. Each stopper unit has four rubber stopper blocks 489 fixedly mounted on a bracket 489B slidably supported by frictional bushings 489C, 489D which release upon application of force during operation of the pusher apparatus. The stopper blocks are located in front of and in alignment with the shuttle tray openings to abut the front end portion of the stacks of end members in troughs 60 in the shuttle storage table 61. As the stacks of end members are pushed out of the troughs and into the tray compartments, the stopper blocks 489 remain in abutting contact with the front end portions of the stacks of end members to hold the stacks together during movement into the tray compartments. The stop block units are pushed to the retracted position adjacent the sweeper means 72 by the stacker units and remain there until after a tray has been filled and removed from the loading station.

Figure 24:
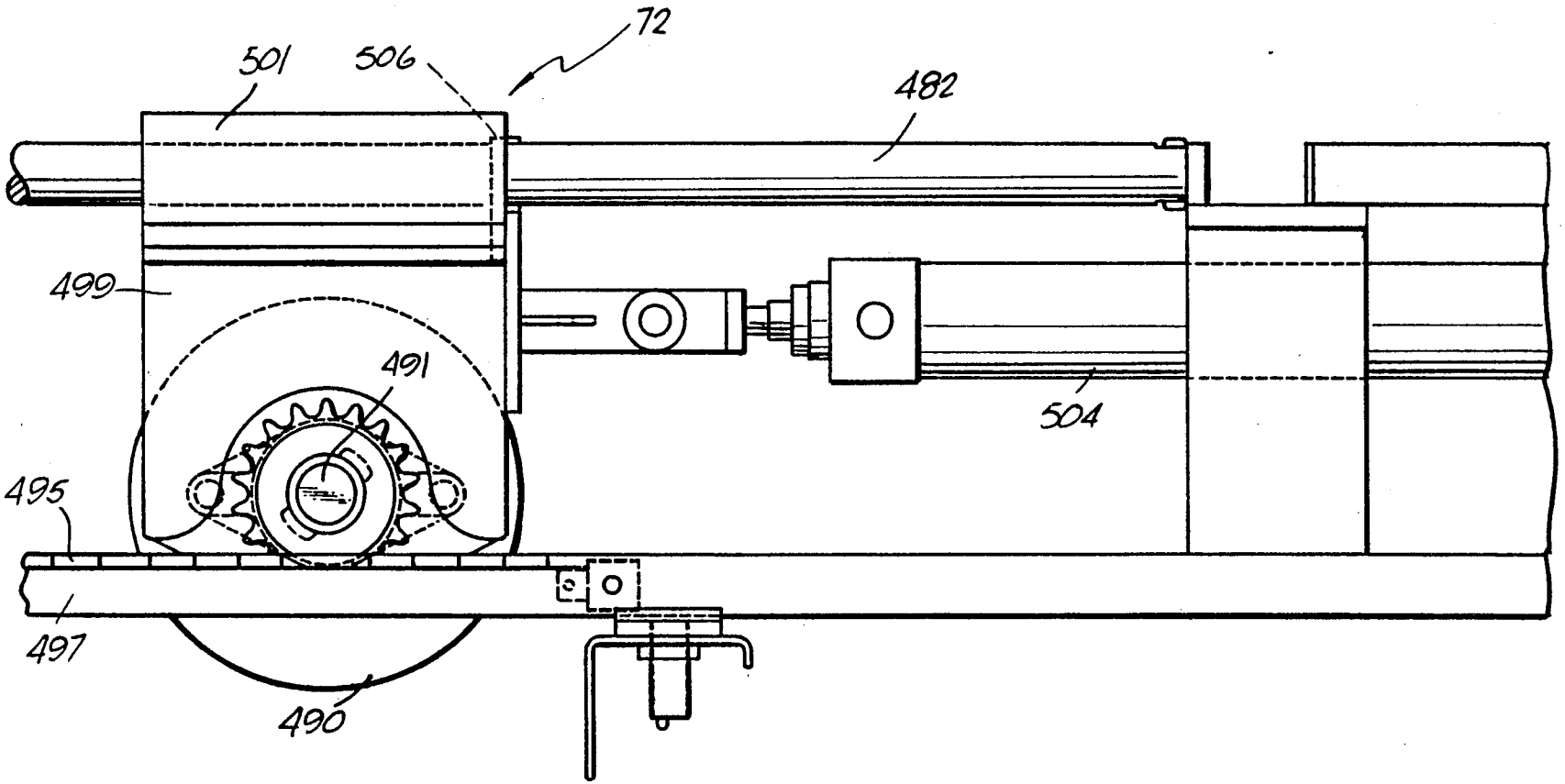
FIG. 24 is an enlarged partial side view of a portion of the apparatus of FIG. 23.
Figure 25:
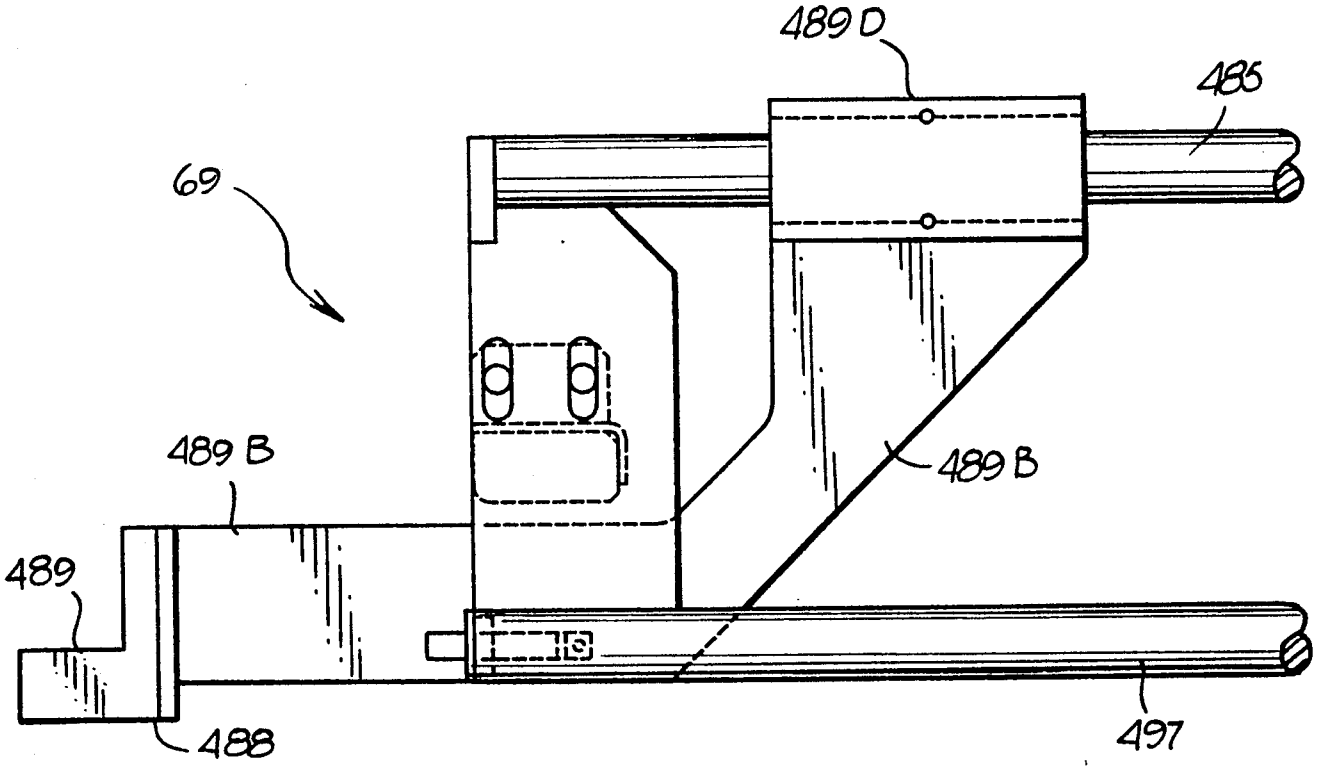
FIG. 25 is an enlarged partial side view of a portion of the apparatus of FIG. 23.

The sweeper means 72 comprises twelve rotary brush members 490 mounted on a rotatable shaft 491 having drive sprockets 492, 493 at each end which are driven by fixed chain members 494, 495 mounted on side rail members 496, 497. Drive sprockets 492, 493 have one way clutch mechanisms so as to be rotatable only in one direction of movement along the chain members. Drive sprockets are mounted on support brackets 498, 499 slidably supported by bushing members 500, 501 on rails 481, 482. The brackets are connected by transverse connecting plate member 502 so as to be movable together. An air cylinder 504 is centrally connected to the connecting plate member 502 to cause movement of the sweeper units from a retracted position on one side of the loading station to an extended position on the other side of the loading station adjacent the shuttle tray means. Rubber stop members 506 (FIG. 24) may be provided on plate member 502 to cushion the return movement. The entire framework may be moved rearwardly a small distance sufficient to clear the stopper units 486, 487, 488 from the shuttle tray by actuation of a power cylinder 507. In addition, the entire framework 508 may be pivotally mounted by brackets 509, 510 and cam roller devices 512 for upward pivotal movement against a weight W to enable access for maintenance, repair and the like.

In operation, the sweeper units 490 are located in the extended position adjacent the stopper units when an empty tray is placed on the tray carrier at the loading station. Then, the power cylinder 504 is actuated to retract the sweeper units and the brushes enter the tray compartments. The brushes are rotated by engagement with the fixed chain to sweep in the direction of travel the compartment surfaces and sweep away any dirt or objects that might be in the compartments. The stopper units remain in the extended position and are returned to the retracted position by the movement of the stacks of end members during the loading operation. When the power cylinder is actuated, the sweeper units are returned to the extended position and push the stopper units back to the extended position.

When the apparatus is used as a depalletizer, the back-up means 486, 487, 489 are fixedly connected to the drive mechanism 502, 504 so as to provide a pusher means for pushing the stacks of end members out of the tray compartments 31 and into the shuttle tray troughs 60. The push rod means of the palletizer system acts as a back-up means as the stacks of ends are pushed out of the tray compartments into the shuttle tray troughs 60. The sweeper mechanism is not included in the depalletizer apparatus.

TRAY CARRIAGE CONVEYOR MEANS

As shown in FIGS. 17–21, the tray carriage conveyor means comprises spaced parallel support bracket means 520, 521 which support track members 248, 250. Chain members 257, 258 are driven by a motor means 522, a shaft means 524, and sprocket means 526, 527; and are supported by idler chain sprocket wheel units 528, 530, 532 and 534 mounted along the support bracket means. Each chain is suitably connected to the tray carriage means 70 as shown at 536, 537 in FIG. 17 to cause reciprocating movement back and forth along the track means 248, 250.

ELEVATOR MEANS

As shown in FIGS. 1, 2C, 3C, each of the elevator means 77, 81 comprises a horizontal elevator platform means formed by spaced side plate members 550, 551 which are located on opposite sides of the associated conveyor means 82, 82A to enable relative movement therebetween. The side plate members are connected and supported by a cross brace member 552 extending between spaced vertical support post members 554, 556 and slidably supported relative thereto by roller means on the platform means and track means 558, 560 on the vertical post means. The platform means is moved upwardly and downwardly by spaced vertical chain means suitably supported by sprocket means 566, 568 (FIG. 3C) and driven by motor means 570, 572 through drive sprocket means 74, 576 mounted on cross-shaft means 578. The motor means 70, 572 and the position of the elevator platform means is controlled by a conventional rotary shaft controller unit in a conventional manner.

OPERATION

In operation of the palletizer system, a pallet of empty tray members is formed by placing a plurality of empty tray members in vertically stacked nesting relationship on a pallet support member. The pallet of stacked empty tray members on a pallet is located beneath a tray loading station and moved vertically upwardly toward the loading station until an uppermost empty pallet member is located next adjacent a tray holding and carrier means at the loading station. An uppermost empty tray member is engaged with the tray holding device by upward movement of the tray member. The tray holding device is actuated to separate and remove the uppermost empty tray member from the stack of empty tray members which is lowered to a position beneath the tray holding device. All compartments of the uppermost empty tray member are simultaneously filled with end members to provide a loaded tray member supported by the tray holding device. The loaded tray member and the tray holding device are moved laterally away from the loading station toward a loaded tray palletizing station whereat a pallet of vertically stacked multiple loaded tray members is formed by sequentially placing, one at a time onto a pallet member and/or the loaded tray members supported by the pallet member, a series of loaded tray members received from the loading station. The full pallet of vertically stacked loaded tray members is removed from the palletizing station and the processing sequence is continuously repeated to continuously sequentially load tray members with end members at the loading station and continuously sequentially palletize loaded tray members at the palletizing station.

In the operation of the de-palletizing system, a palletized load of stacked full tray members is placed upon an elevator means beneath an unloading station having a tray holding and carrier means. The elevator means and the tray holding and carrier means are of the same construction and design and operate in the same manner as used for the palletizer system. The uppermost loaded tray is associated with the tray holding and carrier means by upward and downward movement of the elevator means. Then the stacks of end members in the compartments 31 of the tray member 30 are removed by (1) inserting lift and guide rod means 70, and (2) actuating a pusher means to push the stacks of end members upwardly and outwardly of the compartments 31 along the guide and lift rod means 70 onto guide and support rail means in the troughs 60 of the shuttle tray means 61 while the opposite end portions of each stack means are held by a stop means 69. Then the stacks of end members in the shuttle tray means are removed by actuating the upper and lower jaw mechanisms of one or more stacker means 54–56 to grip, lift, and laterally move the stacks of end members in the shuttle tray troughs 60 from the troughs to a stack unloading station whereat the stacks are released by actuation of the jaw mechanism and placed upon guide rail means aligned with one or more can end feed track means associated with one or more end feed means.

COVERED TRAY SYSTEM

FIGS. 26 A–H and 31A show a presently preferred alternative tray means 600 having a cover means 602 for covering end members in the tray compartments. The cover means comprises a sheet of flexible plastic material such as polyethylene having a plurality of elongated relatively narrow width attachment portions 604, 605 fixed to rib portions 606, 607 of the tray body by suitable means such as welding, and elongated unattached flexible cover portions 608, 609 therebetween having generally semi-cylindrical cross-sectional configurations which are larger than the diameter of the can end members so as to provide sufficient clearance therebetween to enable insertion and removal of the can end members. The cover portions are flexibly movable between a collapsed, stowed position 609B, FIG. 31A, within the compartments and an outwardly extended covering position 609A above the compartments.

The tray means 600 have a quadrilateral peripheral configuration defined by relatively short length opposite parallel side wall portions 610, 611 and relatively long length opposite parallel side wall portions 612, 613 surrounding a plurality (e.g. 12) of elongated parallel rows of can end holding compartment means 614 separated by parallel rib portions 606, 607. Each can end compartment 614 comprises a horizontal bottom rib portion 616 having vertically extending side wall portions 617, 618 connected by a bottom wall portion 620 to provide an elongated generally U-shaped slot 622. Side wall portions 617, 618 are connected to the bottom wall portions 620 by curved connecting portions 623, 624, FIG. 31A. The compartments have arcuate curved side wall portions 626 628 for slidably supporting the stacks of can end members. The length of the can end compartments is such as to receive and hold substantially equal numbers of end members in stacked relationship to provide a plurality of substantially equal length rows of stacks of end members. Can end member insertion and removal opening means are provided in at least one end portion of each compartment means. Preferably, the insertion and removal means are provided at both end portions so can end members may be inserted and removed from either side of the tray unit.

Figure 26A:
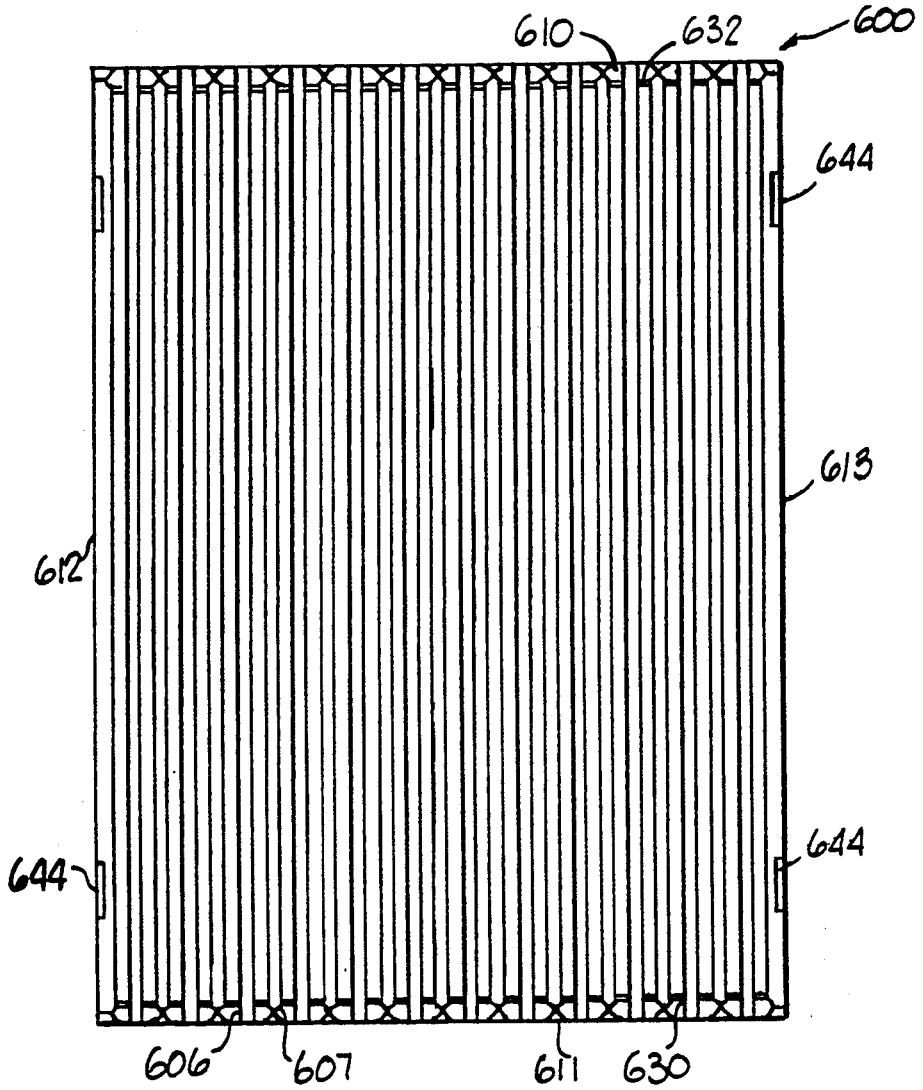
FIG. 26A is a plan view of an alternative tray unit.
Figure 26C:
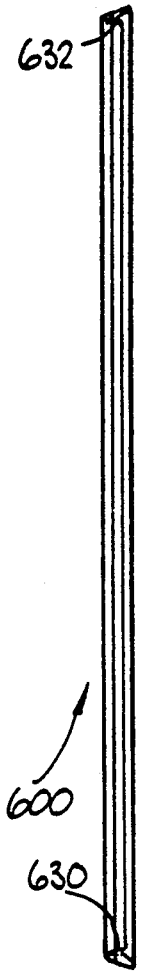
FIG. 26C is a side view of the tray unit of FIG. 26A.
Figure 26B:
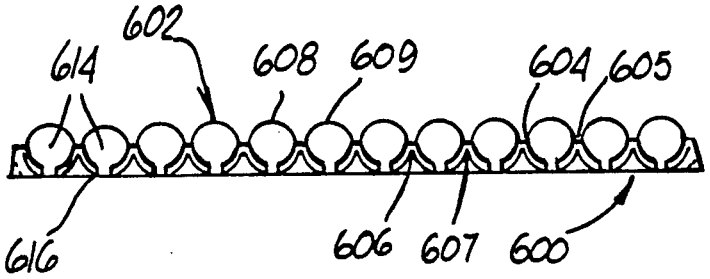
FIG. 26B is an end view of the tray unit of FIG. 26A.
Figure 26D:
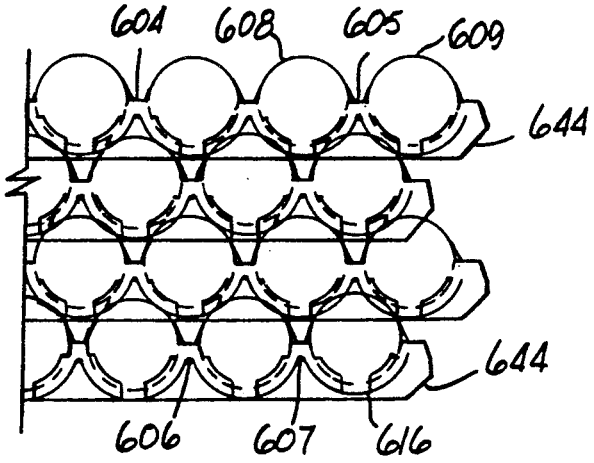
FIG. 26D is a partial end view of a stack of the tray units shown in FIGS. 26A-C.
Figure 26E:
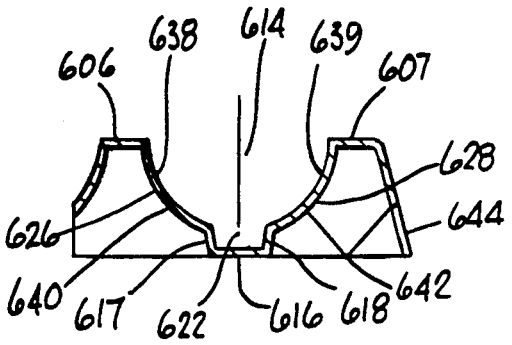
FIG. 26E is a cross-sectional view of a portion of the tray unit shown in FIG. 26A.
Figure 26F:
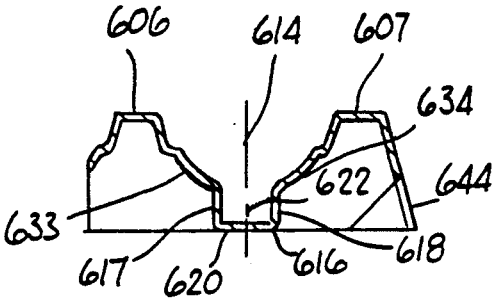
FIG. 26F is a cross-sectional view of another portion of the tray unit shown in FIG. 26A.
Figure 26G:
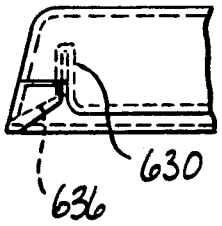
FIG. 26G is a side view of a portion of the tray unit shown in FIG. 26A.
Figure 26H:
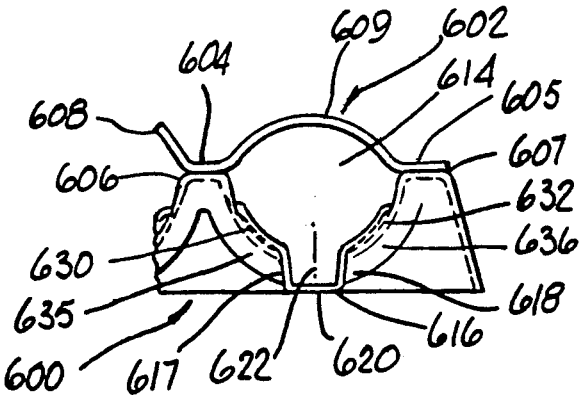
FIG. 26H is an end view of a portion of the tray unit shown in FIG. 26A.
Figure 30A:
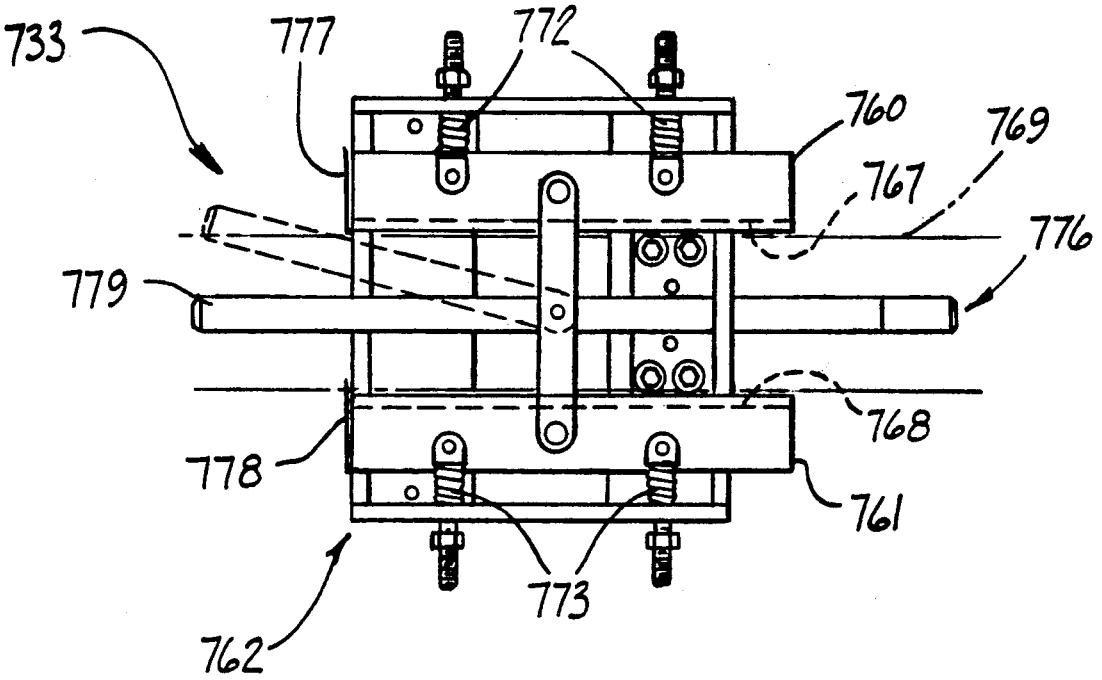
FIG. 30A shows a plan view of a portion of the unloading apparatus of FIGS. 29.
Figure 31A:
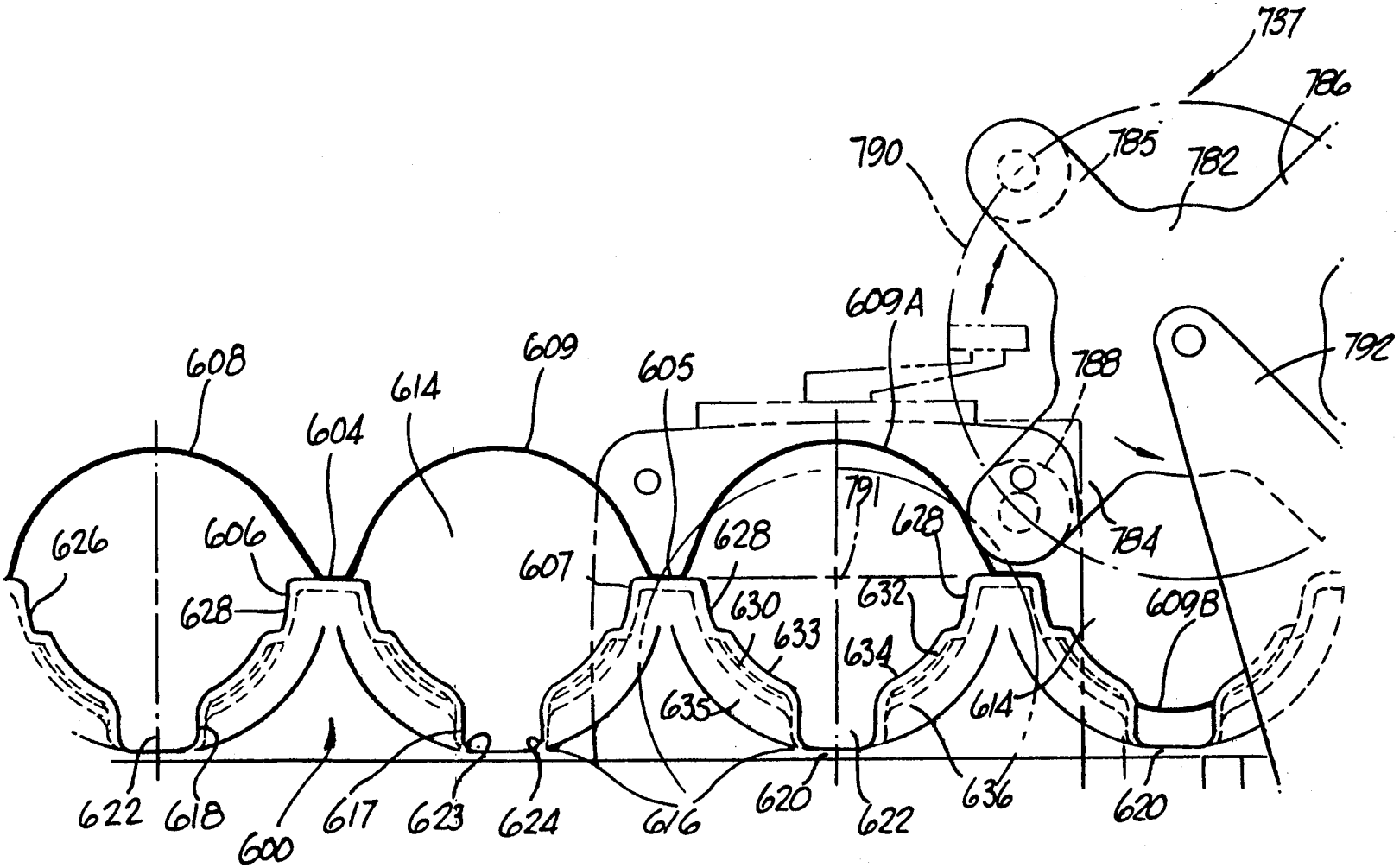
FIGS. 31A-D show an enlarged end elevational view of a covered tray unit at an unloading station.
Figure 31B:
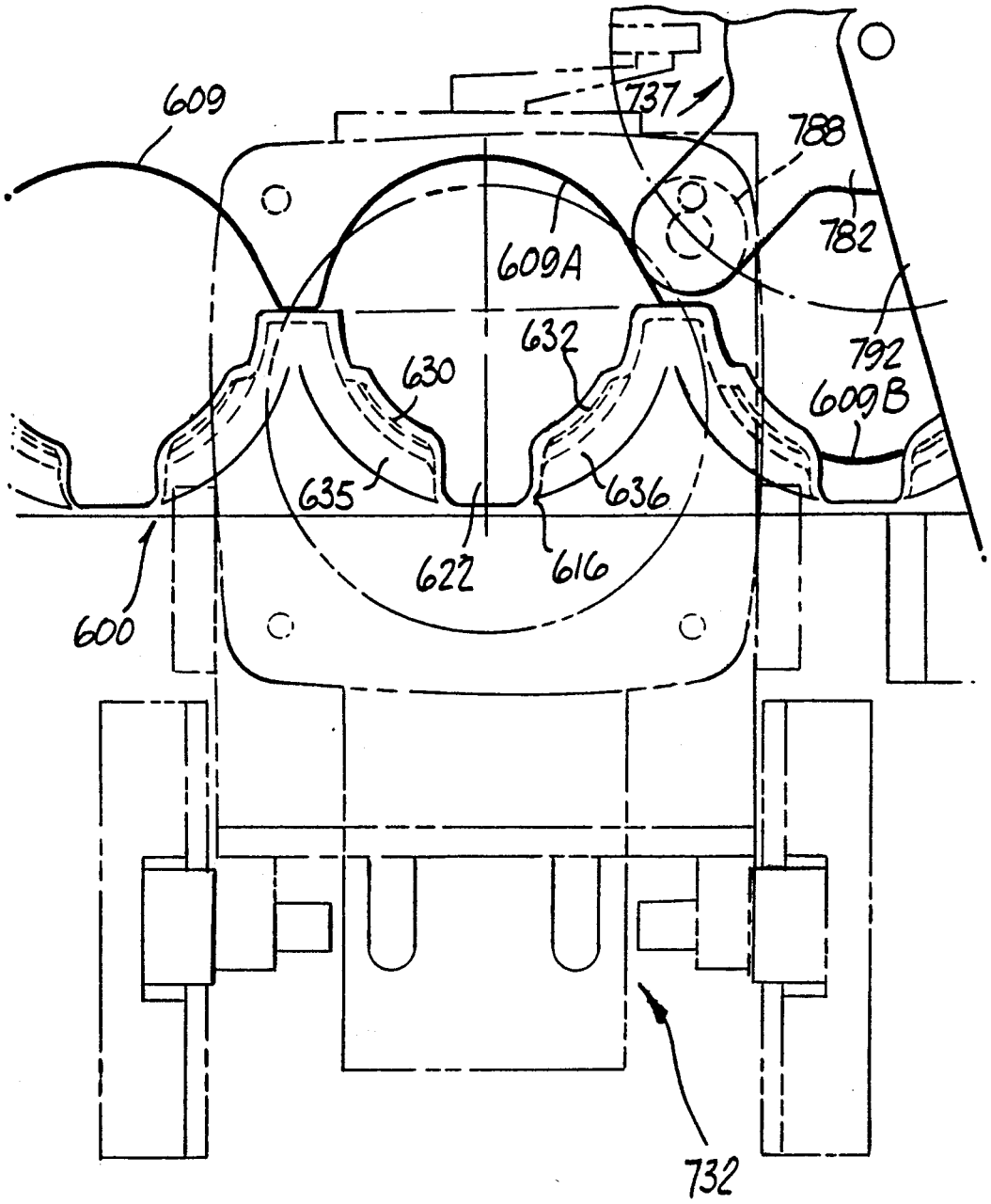
Figure 31C:
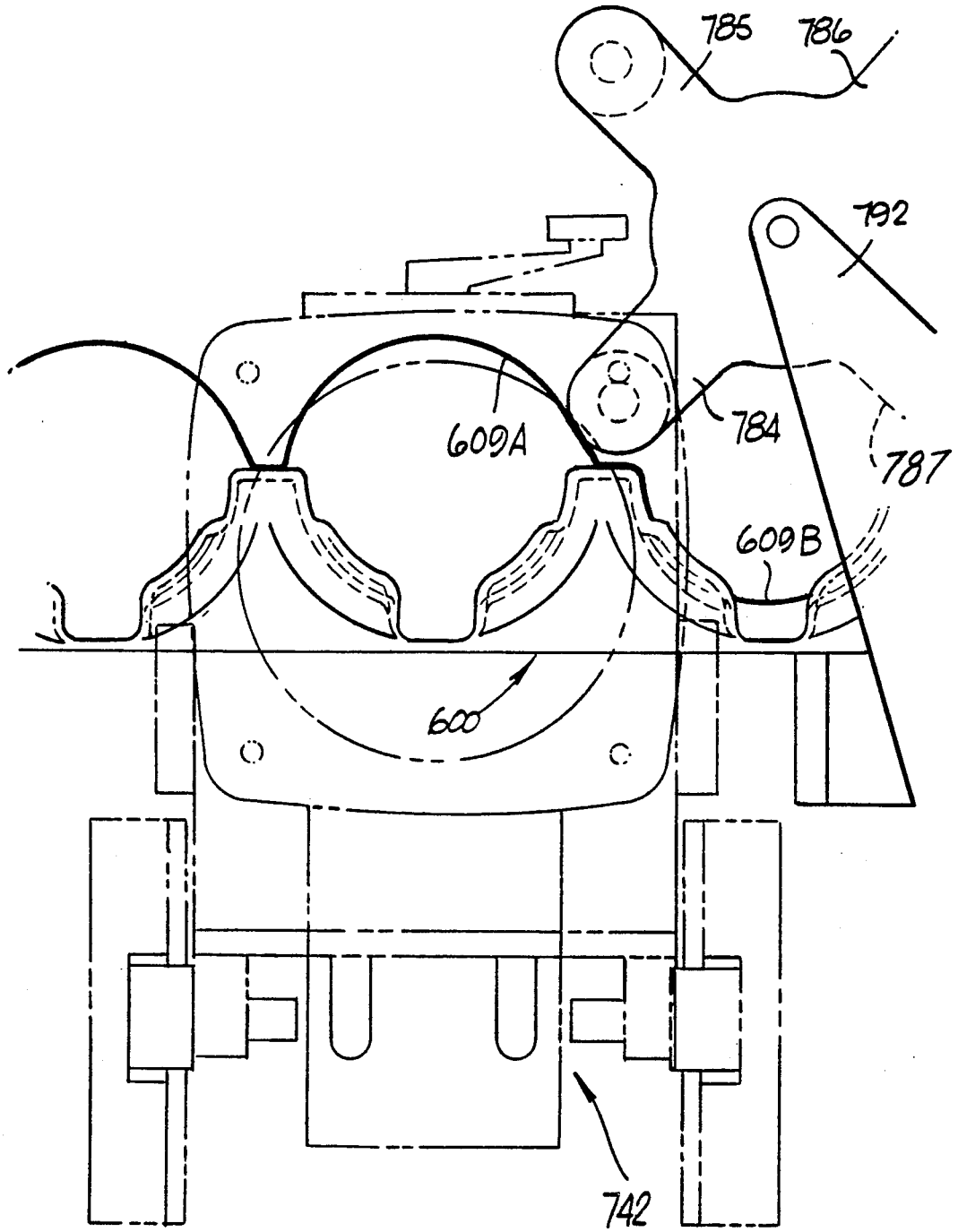
Figure 31D:
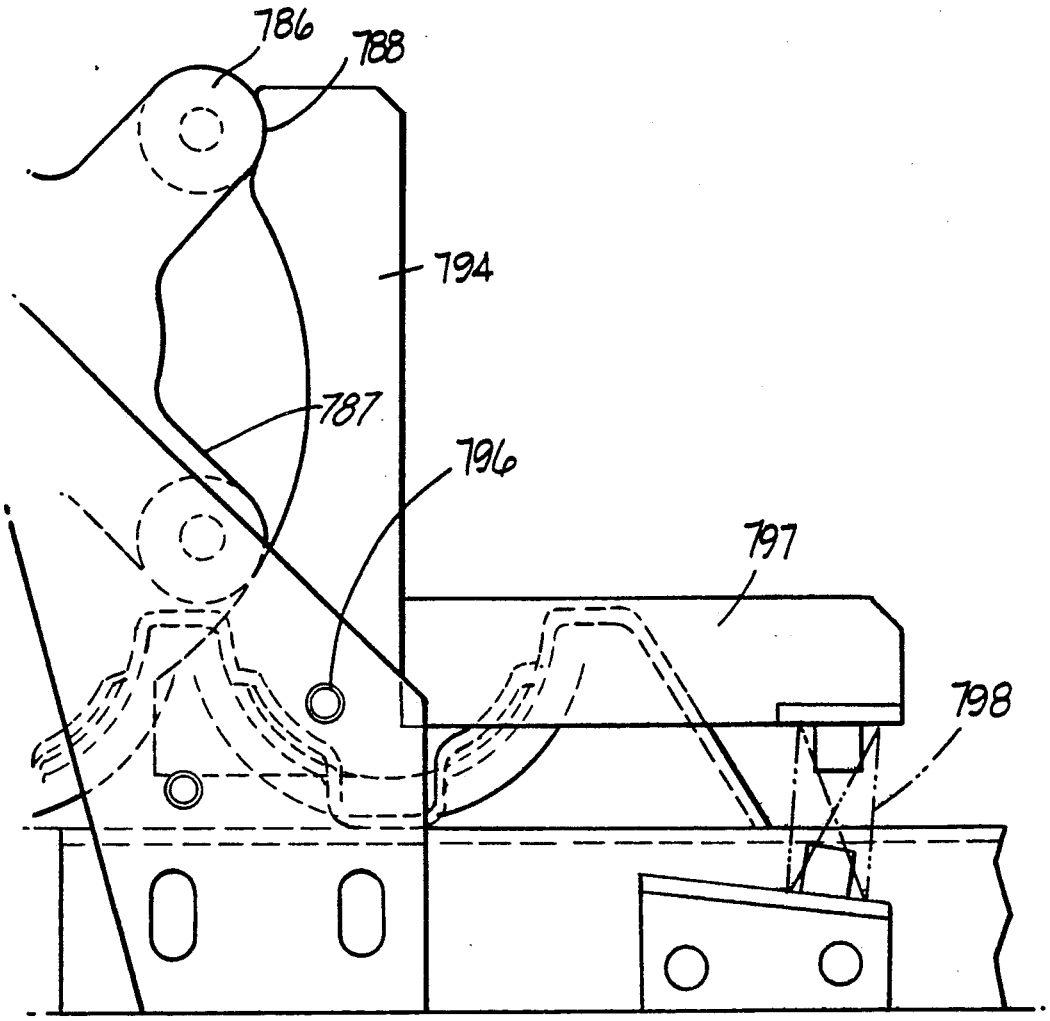

As illustrated in FIGS. 26F–H, the opposite end wall portions of each compartment 614 are provided with abutment means in the form of arcuate abutment wall portions 630, 632 having arcuate upper surfaces 633, 634, FIG. 31A, of shorter circumferential length and lesser radius than arcuate surfaces 626, 628. In addition, the cover portions 608, 609 may be provided with suitable interior ribs and grooves (not shown) adjacent the abutment wall portions to engage and retain can end members of a short-length stack which might not completely fill a compartment means. Upwardly inclined conical wall portions 635, 636 on opposite sides of slots 622 extend from the bottom of the tray to surfaces 633, 634 to guide end members therealong. End guide and lift rod means 776, FIGS. 30A & B, are received in slots 622 whereby the adjacent end portion of each stack may be lifted above the adjoining abutment wall portions 630, 632 during unloading of the stacks of end members. Curved wall portions 626, 628 provide upwardly facing arcuate support surfaces 638, 639, FIG. 26E, which have a radius approximately equal to the radius of the can end members supported in the tray compartments; and provide downwardly facing arcuate abutment surfaces 640, 642 which are tangent to an arc having a radius equal to the radius of the can end members supported in the tray compartments of the next lower tray. Thus, filled trays may be nested and stacked one upon another with upper trays being supported by the end members in lower trays as illustrated in FIG. 26D. The side wall portions of trays are provided with suitable indentations and/or openings 644 to provide gripping or handle means to enable manual and/or automatic machine handling of the tray units.

In operation, in order to load a tray unit with can end members, an empty tray with the cover in a collapsed stowed position is moved into loading position in alignment with at least one row of a stack of can end members in a stack support trough device. A cover lifting means is actuated to enter one end of the can end supporting compartment beneath the collapsed cover portion and travel the length of the compartment and raise the cover to the raised can end member covering and holding position whereat a substantially cylindrical tunnel is formed. The tunnel is defined in part by arcuate support surfaces provided by the tray member and the cover member. Then, a stack loading means is operated to push one or more stacks of can end members into each compartment means.

The tray unit includes a can end member guide and supporting ramp means to guide the can end members over the abutment means into the compartments. In the presently preferred embodiment, the ramp means comprises spaced semi-conical surfaces extending upwardly from the front edge of the tray to the top surfaces of the abutment means. The stack loading means further comprises a pusher means for abutably engaging and pushing against the rear end of the stack of ends and causing the stack of ends to move into the aligned tray compartment. The stack loading means further comprises a stack retaining means for abutably engaging the front end of the stack of ends and holding the stack of ends in stacked relationship during movement into the compartment.

The stack loading pusher means and retaining means are moved in unison until the front end of the stack is aligned with the abutment means at the front end of the compartment and the rear end of the stack is beyond the abutment means at the rear end of the compartment. Then, the pusher means and the retainer means are retracted while leaving the stack held in abutting supported engagement in the compartment. After all the compartments have been filled with a stack of end members, the tray may be moved to another location such as a palletizing station whereat loaded trays are stacked upon one another.

The construction and arrangement of the trays is such as to enable stacking of the tray units with a minimum of vertical distance between adjacent trays and with maximum stability. Vertically adjacent tray units are laterally offset so that the rows of stacks of end members in each tray unit are located between the rows of stacks of end members in the next adjacent upper and lower tray units. The palletized tray units may be wrapped with a stretch wrap or other film by conventional equipment to form a sealed unitary palletized load.

In order to unload end members from a loaded tray unit, the loaded tray unit is moved into an unloading position in alignment with suitable end member receiving apparatus. A stack unloading means is operated to push each stack of end members from each compartment of the tray unit.

The stack unloading means comprises a lifting means to engage the front end of the stack of ends and lift the ends above the adjacent abutment means in the end wall of the tray unit. The stack unloading means further comprises a pusher means for abutably engaging and pushing against the rear end of the stack of ends to cause the stack of ends to be moved as a unit onto the lifting means and out of the compartment. The stack unloading means further comprises a stack end retaining means for abutably engaging the front end of the stack of can ends and holding the stack of can ends in stacked relationship during movement out of the compartment.

The stack unloading pusher means and retainer means are moved in unison until the stack of can ends has been removed from the tray compartment and located in proper relationship with the end member receiving apparatus; and then releasably removed from engagement with the stack of end members.

A cover closing means is provided to move the cover means from the open position to the closed position after the stack of end members has been removed from the tray unit. In the preferred embodiment, the cover closing means comprises a rotatable cam-operated starwheel device having arm members with elongated roller devices engageable with each cover segment to force each cover segment into abutting engagement with the curved support surfaces of each associated compartment.

The covered tray system may be adapted for manual, semi-automatic and fully automatic operation. The tray units may be transported by hand or by semi-automatic or fully automatic mechanisms as previously described.

Figure 27A:
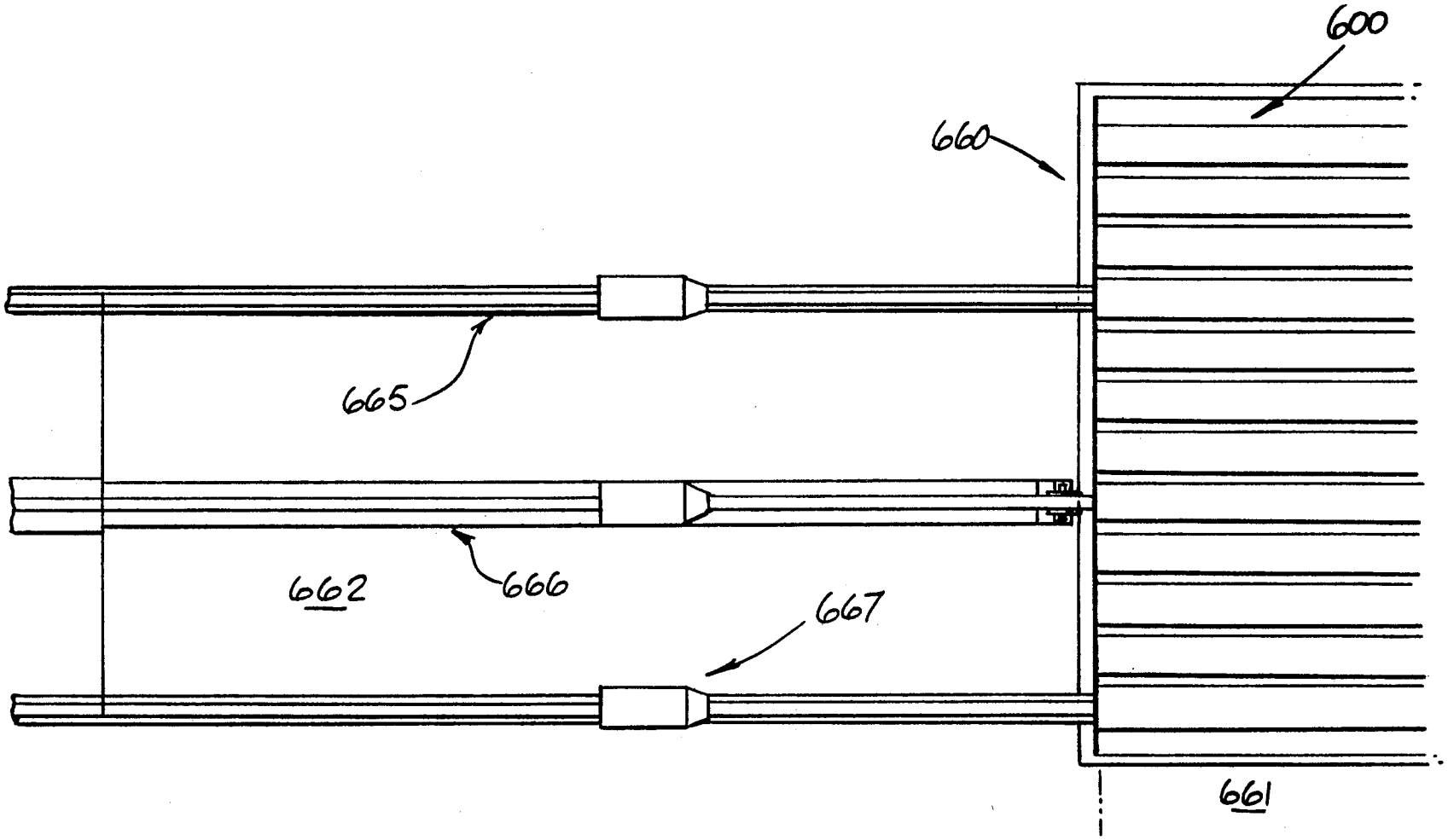
FIGS. 27A & 27B show a plan view of can end loading apparatus for a tray unit of the type shown in FIGS. 26A-H.
Figure 27B:
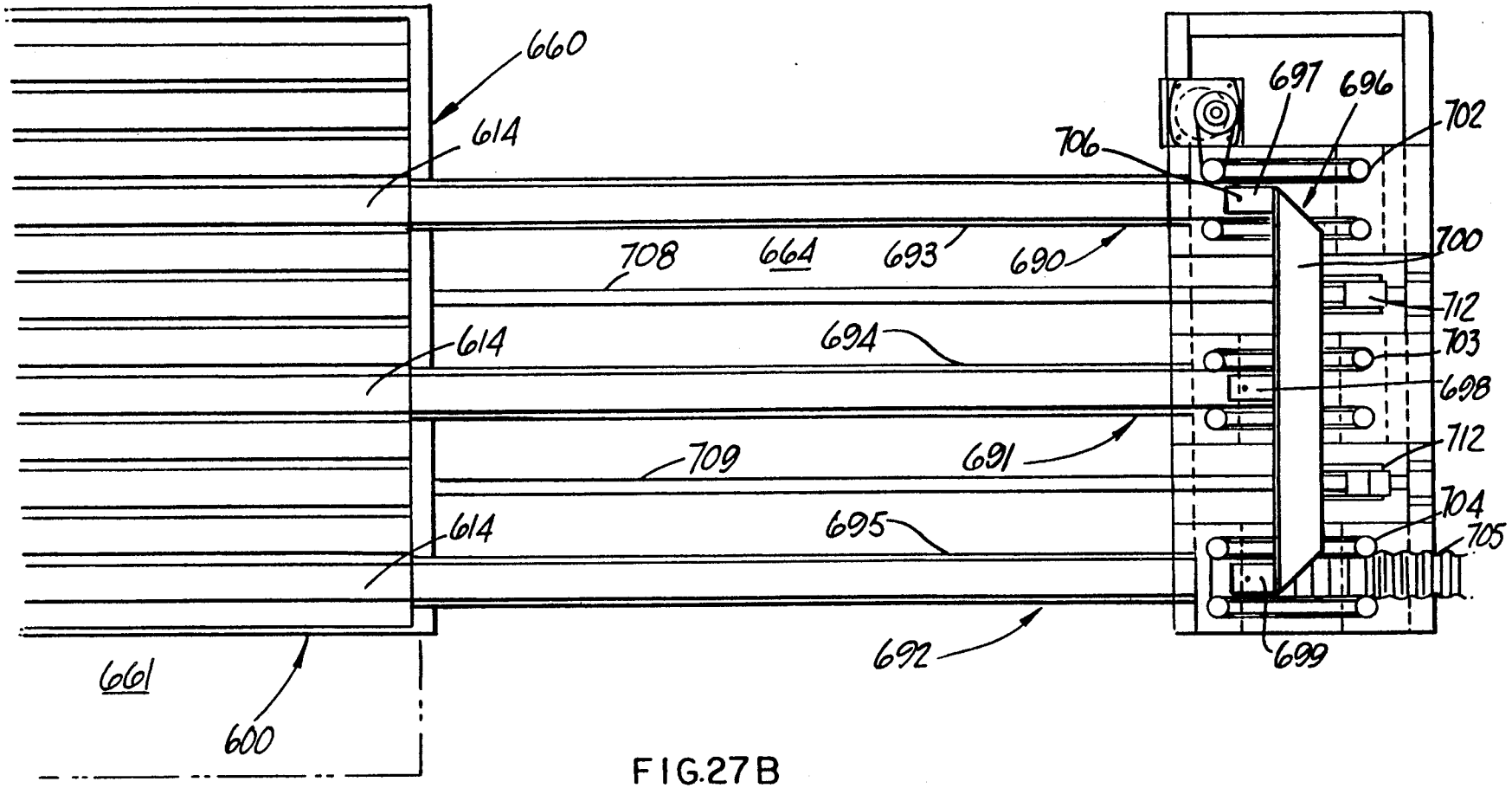
Figure 28A:
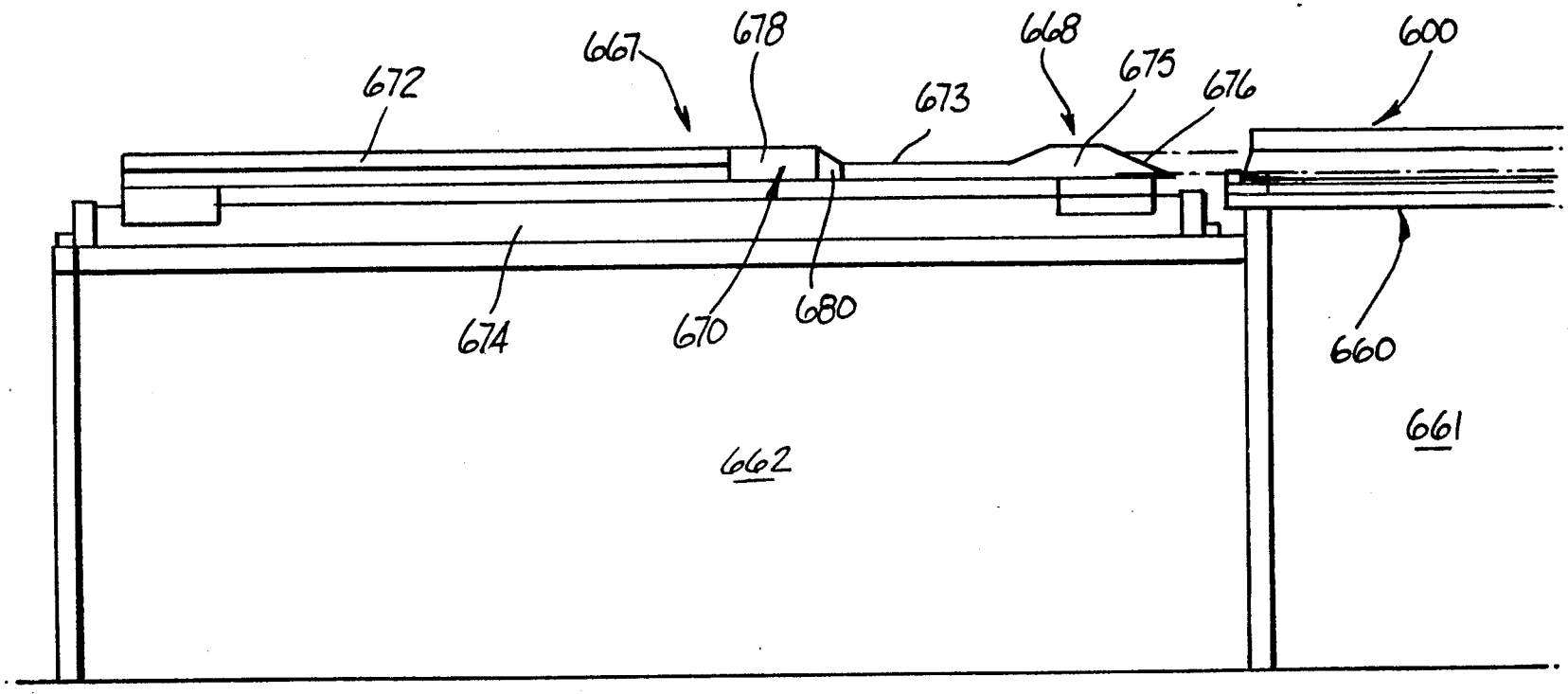
FIGS. 28A & 28B show a side elevational view of the loading apparatus of FIGS. 27A & 27B.
Figure 28B:
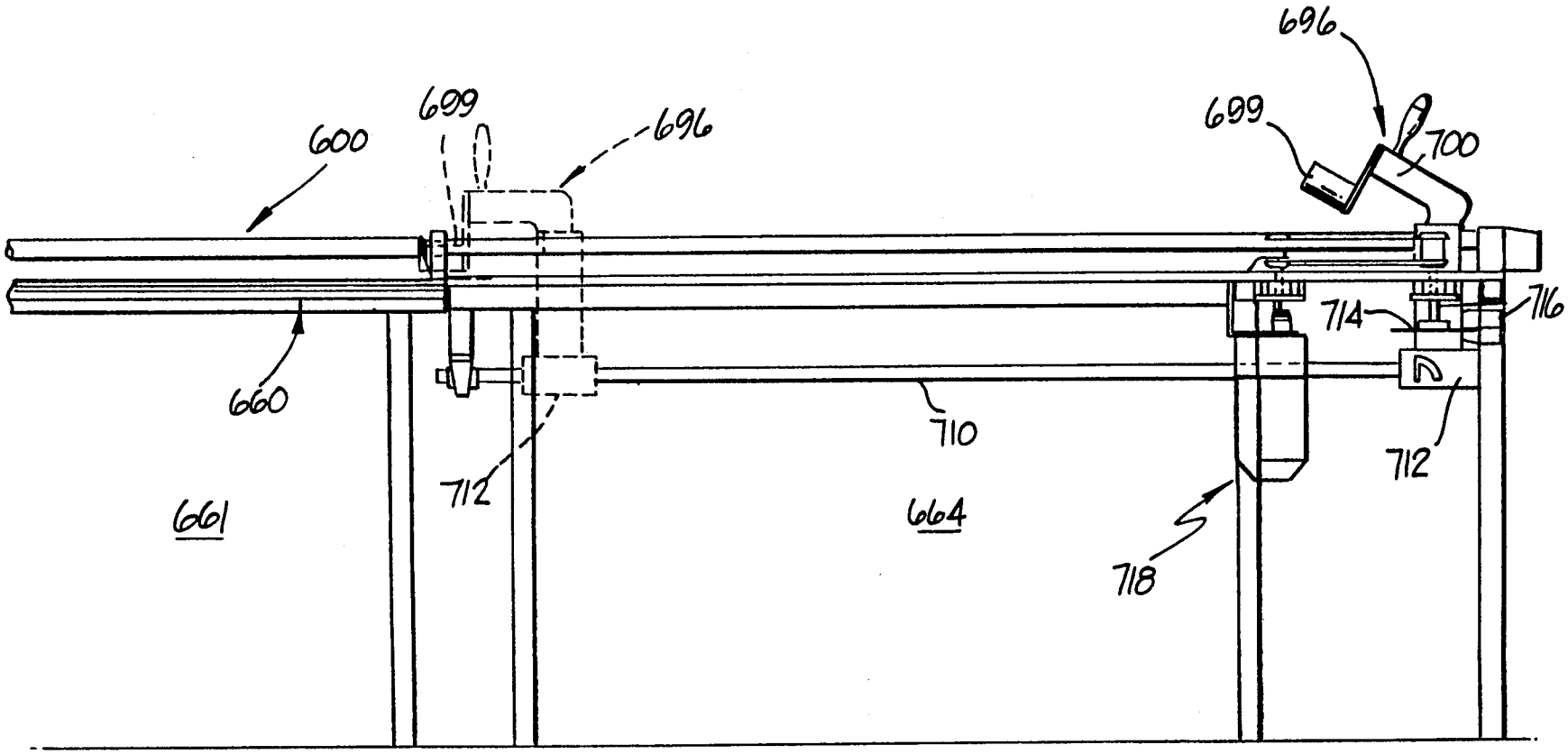
Figure 29A:
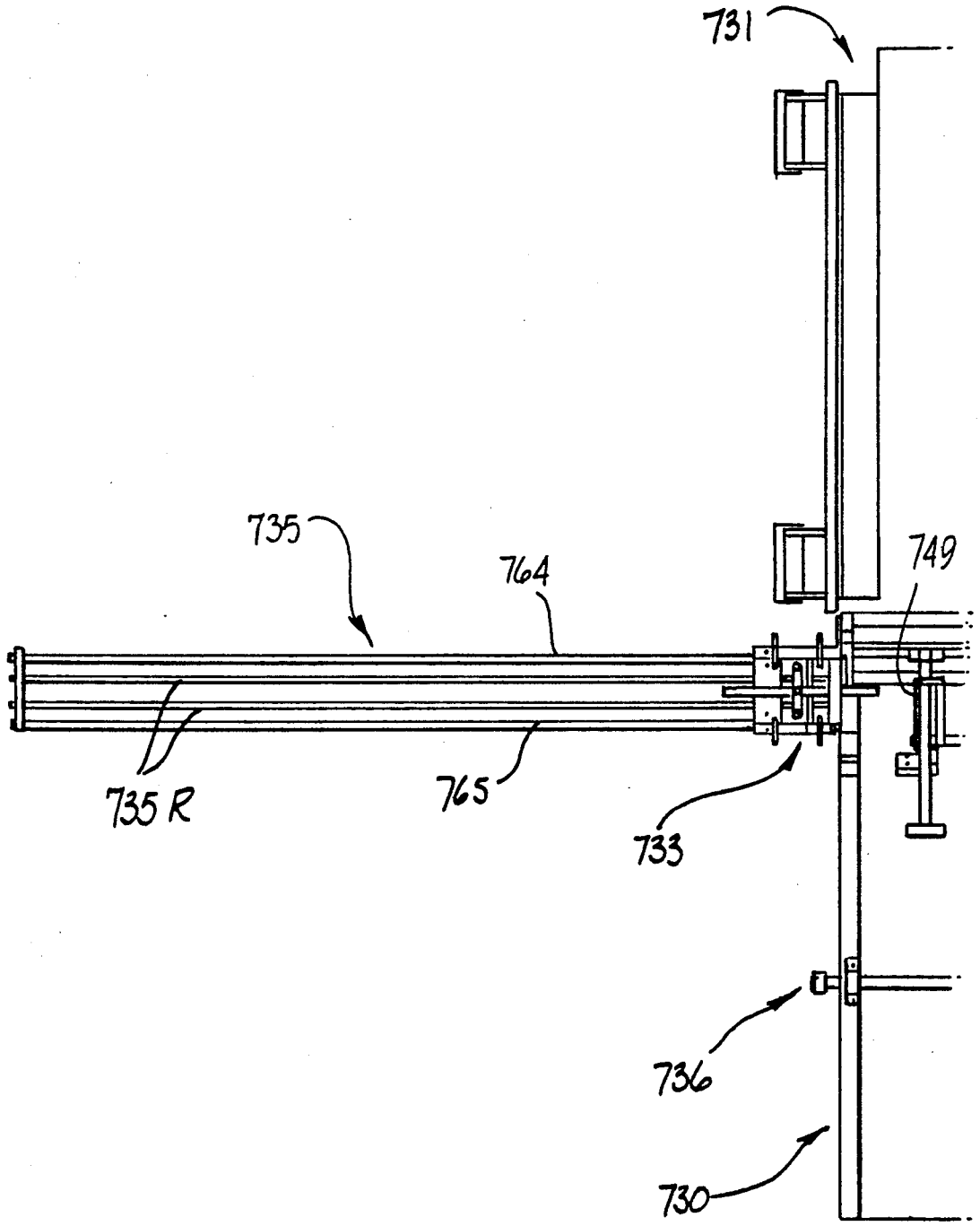
FIGS. 29A-C show a plan view of a can end unloading apparatus.
Figure 29B:
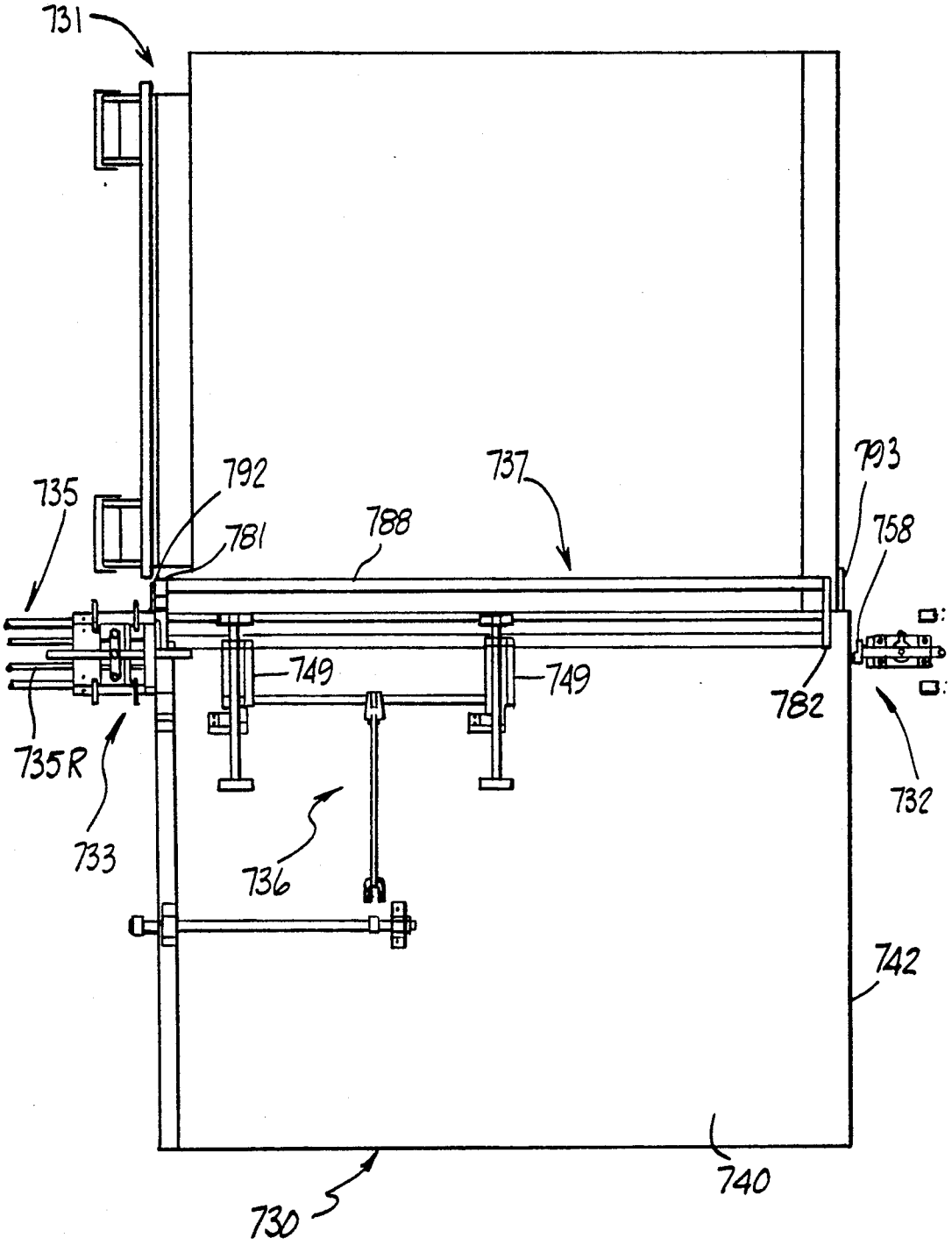
Figure 29C:
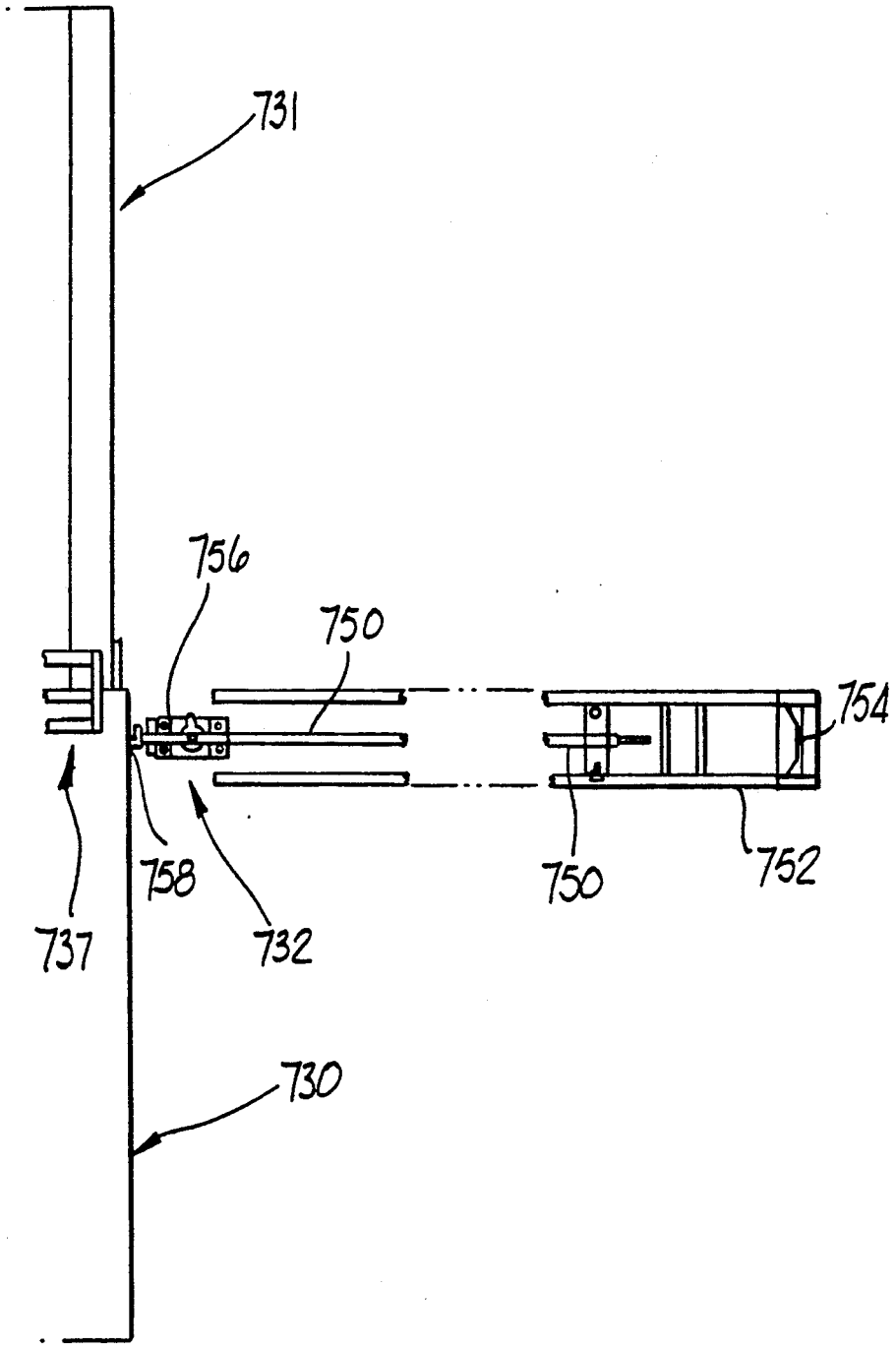
Figure 29D:
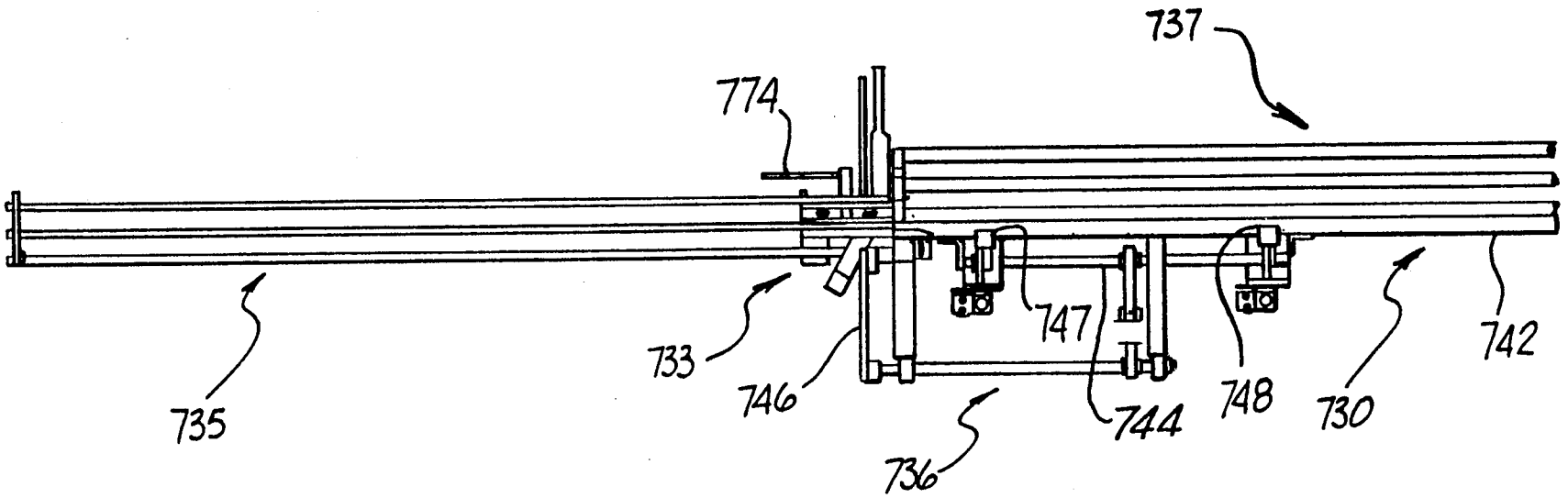
FIGS. 29D-F show a side elevational view of the unloading apparatus of FIGS. 29A-C.
Figure 29E:
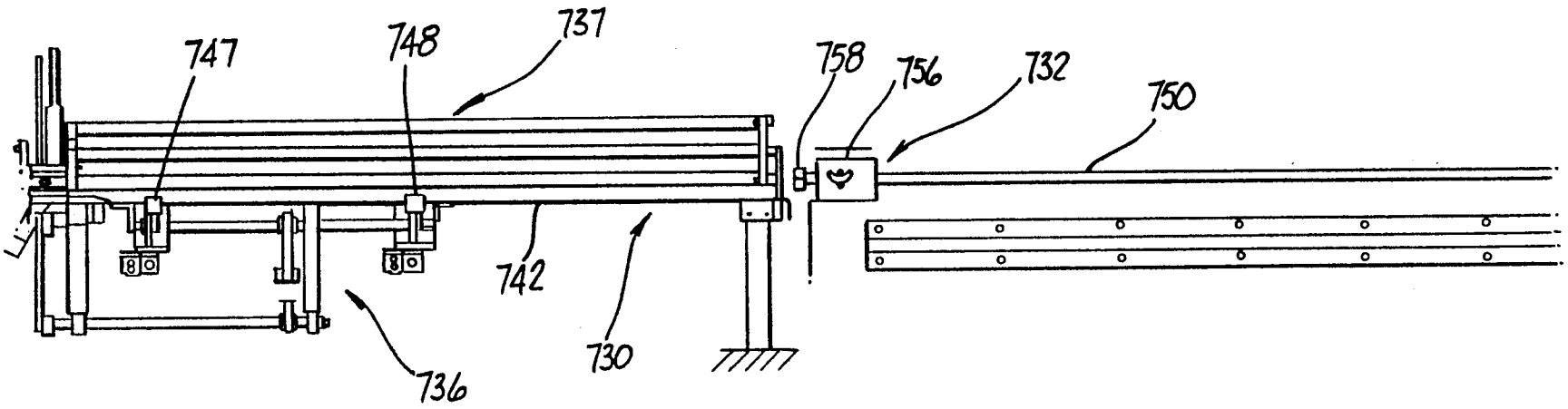
Figure 29F:
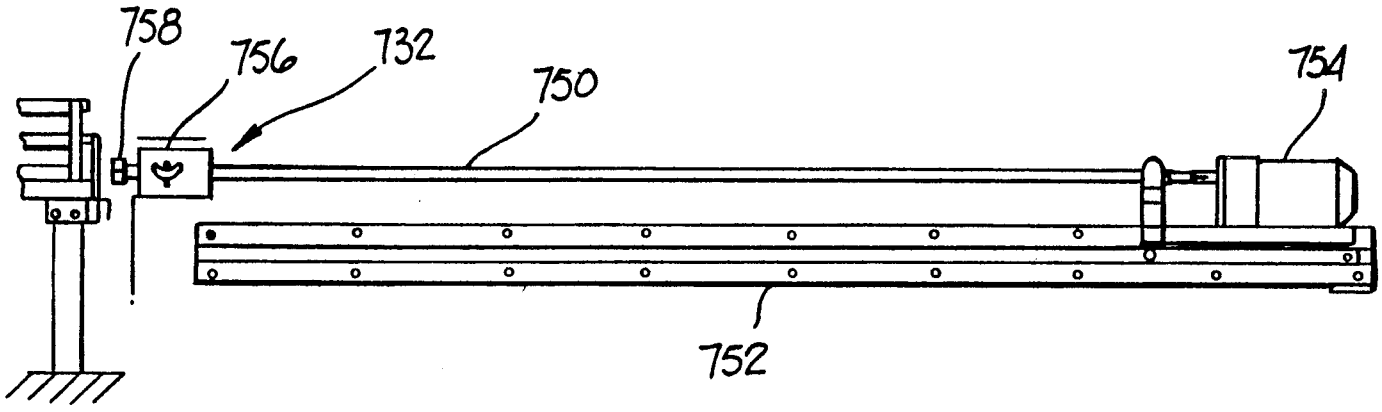

In FIGS. 27A & B and 28A & B, a covered tray unit 600 is shown on a tray carrier means 660 in loading position at a loading station 661 having indexing apparatus for moving the tray unit relative to associated end stack handling apparatus stations 662, 664. Station 662 comprises three tray opening and stack retaining units 665, 666, 667 which are sequentially alignable with every fourth compartment on the tray unit. Each unit 665, 666, 667 comprises a cover opening means 668 and a stack retaining backstop means 670 slidably mounted on guideways 672, 673 and operable by power cylinder means 674 between an extended position and a retracted position. The cover opening means 668 comprises a head member 675 having an inclined front end portion 676, and a central body portion having a width approximately equal to the diameter of the tunnel provided by the cover in the open position. The backstop means 670 comprises a cylindrical member 678 having a front end portion 680 with a configuration adapted to nest within the profile of an end member abutted thereagainst. In operation, the cover opening means is moved beneath the collapsed cover portions and followed by the backstop means. When the cover opening means has completely opened the collapsed cover portions, the backstop means is moved forwardly of the cover opening means so that abutment surface 680 is located in front of inclined surface 676.

Station 664 comprises three can end supply units 690, 691, 692 which are respectively alignable with the tray compartments. Each unit comprises a conventional end supporting track means 693, 694, 695 for slidably supporting can end members; and a stack pusher means 696 having a cylindrical pusher unit 697, 698, 699 associated with each track means. The pusher means comprises a pivotally mounted support bracket 700 which is manually movable between a raised position and a lowered position. Each unit further comprises a belt-type can end counter and separator means 702, 703, 704, to which a supply of can end members 705 is fed onto each of the track means until a stack of end members of appropriate length is located thereon. A sensor means 706 is associated with each separator means to determine when the track means is filled and to stop further feeding to create a gap in the supply string and permit the pusher units to be lowered behind each stack of end members. In the lowered position, the pusher units are moved forwardly on guide rod means 708, 709 with a power assist being provided by a conventional rolling ring drive unit 712 (of the type referred to on page 40) connected to a rotatable rod means 710 driven by a motor unit (not shown). The can end member separator means comprises a cog wheel which is stopped by a disk brake 714 and brake actuation caliper means 716. The end separator belts are continuously driven by a motor means 718. Can end members may be manually pushed into the belt separation units or automatic feed apparatus may be provided.

FIGS. 29A–E, 30A–C and 31A–D show manually operable tray unloading apparatus with an associated cover closing apparatus. The apparatus comprises an indexable loaded tray holding table means 730 for holding a loaded tray unit as illustrated in FIGS. 29A–E; an empty tray holding table means 731 for supporting an empty tray unit; a pusher means 732 reciprocably operable between retracted and extended positions to sequentially push a stack of can end members out of each compartment means; a stack back-up and support means 733 for holding the front end portion of a stack of can end members during removal from a compartment means; a can end member lifting rod means 776 associated with the can end member stack backup and holding means 733 for lifting the can end members over the abutment means; a stack holding track means 735 for receiving a stack of can end members after removal from a tray compartment means; a manually operable table indexing means 736 for moving the loaded tray supporting table means to sequentially align adjacent tray compartment means with the pusher means and the holding means; and a cover closing means 737 for closing the cover portions after removal of the stack of can end members.

Tray holding means 730 comprises a flat horizontal table apparatus 740 which supports the tray unit for slidable indexing movement on the table 740 toward empty tray holding table means 731. The tray unit is connected to an indexing mechanism 744 (FIG. 290) operable by a lever mechanism 746 through U-shape gripper devices 747, 748 engageable with tray bottom rib portions 616 through table slots 749.

Pusher means 732 comprises a rotatable drive rod member 750 axially slidably mounted on a frame 752 and connected to a drive motor unit 754. A push head unit 756 includes ring elements which are selectively connectable to the rotating drive rod member by a conventional mechanically operated remote control unit (not shown) to cause axial movement of the rotating rod. Such drive apparatus is described in the Uhing Rolling Rigg Drive catalog of Amacoil, Inc., the disclosure of which is incorporated herein by reference. The rod includes a cylindrical thrust bearing 758 adapted to abuttingly engage and push against the rear can end member of the stack of can end members in the compartment means of the tray unit.

Figure 30B:
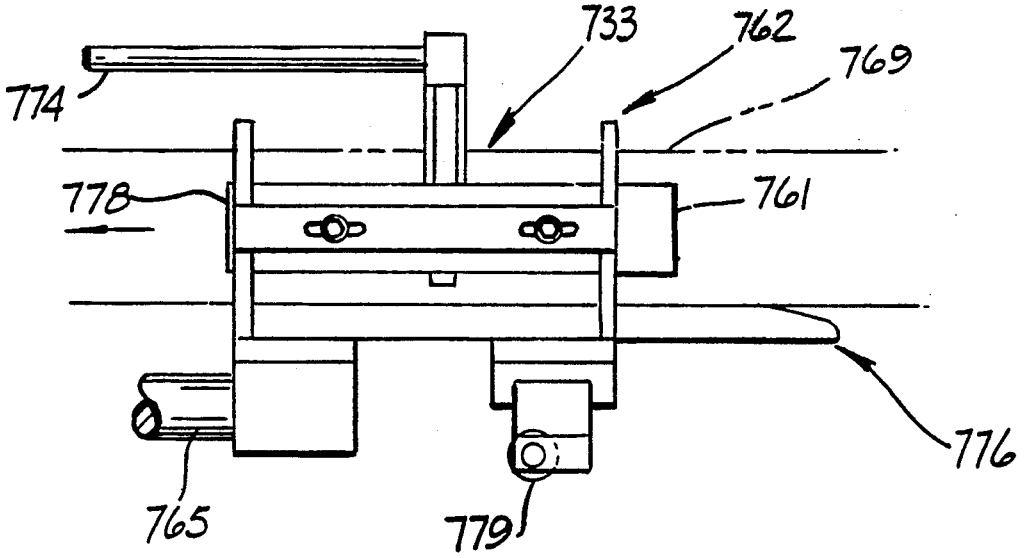
FIG. 30B shows a side elevational view of the apparatus shown in FIG. 30A.

FIGS. 30A–B show the stack backup and support means 733; and the lifting rod means 776. A pair of plastic can end support block members 760, 761 are mounted on a carrier means 762 which is slidably supported by guide rail means 764, 765, FIG. 29A. Block members 760, 761 have arcuate inner side surfaces 767, 768, FIG. 30A, corresponding to and engageable with the cylindrical peripheral surfaces of the stack of can end members illustrated at 769. The block members are mounted for lateral inward and outward displacement relative to the front end portion of a stack of end members against the bias of spring members 772, 773. A lever mechanism 774 is provided to open the block members against the bias of the spring members. A can end member lifting rod means 776 with a tapered nose portion is mounted on the carrier means 762 and constructed and arranged to enter compartment slot means 622 and lift the can end members over the abutment means at the end of each compartment. Each clamping block member has resilient knife-type end abutment members 777, 778 having an inner portion extending into abutting holding engagement with the end portion of the can end member stack being removed from a compartment.

In operation, the carrier means is moved toward a full compartment of a tray unit until lifting rod means 776 enters the slot 622 and lifts the adjacent portion of the stack of can ends over the end wall abutment means. The stack of can end members is then pushed out of the compartment along the upper surface of lift rod means 776 until the front end of the stack engages the restraint knife members 777, 778. Then the carrier means 762 is pushed along the guide rail means as the stack of ends is pushed out of the compartment. Carrier means 762 includes a roller brake mechanism 779 to provide sufficient resistance to movement to keep the stack together. When the stack of ends is clear of the compartment and located at an appropriate discharge location relative to track rail members 735R, FIG. 29A, the lever 774 is actuated to open and disengage the block members and the restraint knives from the stack of can end members to discharge the stack on the track means. The carrier may then be moved rearwardly relative to the stack of can ends for engagement with another stack of end members in the next tray compartment when the tray has been indexed.

FIGS. 31A–D show the cover collapsing means 737 adjacent stack unloading pusher means 732 and tray unit 600 being unloaded thereby. The cover collapsing means 737 comprises star-wheel units 781, 782, FIG. 29B, having radial arm portions 784, 785, 786, 787, FIGS. 31A–D. Each arm carries an elongated rod-type roller element 788 which sequentially engages adjacent open cover portions 609A and forces the open cover portions radially inwardly into abutting engagement with the associated curved support surfaces of the associated tray compartments at 609B, FIG. 31A, as the tray units are indexed from left to right in FIGS. 31A–D. The roller elements travel along an arc 790 having a radius such as to force the cover portions into an over-center position relative to the central axis 791 of the tunnel formed thereby in the open position of the cover. The starwheel is rotatably mounted on support bracket means 792, 793 and is positively located relative to each tray cover portion by an indexing cam means 794 pivoted to the bracket means at 796 and biased to a roller contact position by a lever arm 797 and spring means 798.

ADVANTAGES

In general, the present invention provides the following advantages:

(1) The tray configuration is such that the stacks of can end members can be directly laterally generally horizontally conveyed over an abutment means in a sidewall of the tray unit into the compartments of the tray rather than being set into the compartments by vertical downward movement from above. This feature provides a lower cost system since no robotic apparatus is involved in transferring ends; faster operation since ends do not have to be lifted and transferred from compartment to compartment; and a lower cost tray since requirements for robotic pickup are less critical.

(2) The tray unit is also constructed and arranged to provide very stable nesting of both empty tray units and full tray units and the tray units may have a peripheral means to greatly reduce the opportunity for entry of foreign material, but still allow for some air movement within the stack to enable curing of ends having solvent-based liners.

(3) The trays can be more easily handled in and out of the system than paper-wrapped ends due to the fixed dimensions of the trays which facilitate automation.

(4) The trays are made of polyethylene and there is virtually nothing that will stick to it so as to improve cleanliness.

(5) One system provides a can end member drive which maintains a constant stack drive into a stacker/-segmenter. The stacker/segmenter is designed to not only cut off the correct length of ends, but also firmly grabs the ends so that it can accelerate quickly without losing any ends. The can end feed stop means 307 is adjustable and the gripping device moves up and forward for clean cut off at the rear end of the stack.

(6) A shuttle table may be used to accept a stack of ends and shuttles laterally in a predetermined manner until twelve stacks are accumulated. A stack of ends is about 600 ends so the available time between shuttles is about 60 seconds at a feed rate of 600 ends per minute. There is approximately one minute available to extend and return the stacker clamping apparatus which is operable within 5 to 10 seconds. At four cycles to fill the shuttle, the available time for tray and pallet changes is about 4 minutes. This is the reason for the shuttle rather than direct feed into the tray, to provide ample time to move trays and change pallets.

(7) Three pushers may be employed with a shuttle table and act essentially in unison to transfer a complete shuttle full of ends to the plastic tray.

(8) If an uncovered tray unit is used, the backstop is brought into position at the end of the shuttle by the sweep. The pushers, in conjunction with the back-stop, trap the ends between until they are completely contained in the tray. Also, as the pushers move forward, they push the sweeping brushes ahead to clear out any foreign debris that could be in the tray.

(9) In an automated system, a tray frame may be provided to securely hold the tray unit on all four sides, separate tightly stacked trays; and convey full trays to the pallet filling elevator. It is also designed to accept overtravel of the empty tray elevator.

(10) Elevators may be provided to receive and discharge pallets at 90 degrees for pallet stacking and destacking. Two speed drives and encoders may be used to enhance elevation accuracy at tray pickup and drop positions.

(11) In the automated system, a pallet stacker is positioned between the elevators to receive empty pallets from the tray elevator and also feed empty pallets to the full pallet elevator. The machine, at 1800 ends per minute, uses pallets at 75 minute intervals and every third pallet is from the tray elevator, so five pallets in the stacker should last an entire eight hour shift

(12) Additional advantages of the covered tray and covered tray system include reduction in the thickness of each tray unit and an increase in the number of tray units and stacks of ends which can be included in a pallet of a given size For example, a pallet of 130 thousand ends carried by the uncovered tray unit system of the present invention can be increased to 216 thousand units by use of the covered tray unit system. The covered tray system promotes cleanliness of the can end members by covering the stacks of end members in the compartments in the loaded tray condition and also, by covering the compartments in the empty tray condition. The use of a collapsible cover enables stacking of more empty tray units per pallet size and a reduction in the cost of transportation of empty tray units The use of a translucent cover sheet enables the can end manufacturer and user equipment operators to be able to visually inspect at any time each load of end members on each tray unit.

It is intended that the appended claims be construed to include alternative embodiments and modifications of the disclosed embodiments of the invention except insofar as limited by the prior art.

What is claimed is:

1. A system for receiving can end members from a supply of can end members and loading can end members on a plurality of empty tray units to provide a plurality of loaded tray units and for transporting unloaded tray units to a processing station and the system comprising:

a tray loading station for loading can end members on an empty tray unit;

a plurality of tray units, each tray unit having a quadrilateral peripheral configuration and being made of molded plastic material and comprising:

four peripheral side wall portions;

a central wall portion located between and integrally connected to said side wall portions; and a plurality of parallel equally spaced equal length elongated compartment means of identical cross-sectional configuration extending between one pair of opposite side wall portions and parallel to another pair of opposite side wall portions for receiving and holding a stack of can end members;

each of said compartment means comprising:

laterally spaced upwardly outwardly extending opposite wall portions having side surfaces for supporting engagement with peripheral portions of an horizontally extending stack of can end members located in said compartment means;

stack insertion and removal opening means in said one pair of opposite side wall portions for enabling horizontal movement therethrough of a stack of can end members during insertion in and removal from said compartment means of a stack of can end members;

stack abutment means in each of said one pair of opposite side wall portions at opposite ends of said compartment means for supporting retaining engagement with opposite end portions of the stack of can end members received therein; and a lifting tool access slot means associated with said stack abutment means and extending through one of each of said one pair of opposite side wall portions for enabling insertion into said compartment means of a lifting tool device to engage and lift can end members above said stack abutment means for removal of the stack of can end members by horizontal movement through the stack insertion an removal opening means;

stack forming means adjacent said tray loading station for forming a plurality of substantially equal-length individual stacks of multiple can end members approximately equal in length to the length of said compartment means;

tray holding means at the loading station for receiving and holding one empty tray unit at a time; and can end member stack loading means at said loading station for laterally horizontally moving a stack of can end members through said insertion and removal opening means into each of the compartment means on the empty tray unit and filling each of the compartment means with a stack of can end members to provide a loaded tray unit.

2. The system as defined in claim 1 and further comprising:

a tray unloading station for unloading a loaded tray unit;

can end member stack unloading means at said unloading station for laterally horizontally removing a stack of can end members from each of said compartment means through said insertion and removal opening means;

lifting means associated with said can end member unloading means for insertion into each of said compartment means through said slot means for engagement with and lifting of a lower portion of the stack of can end members into alignment with the insertion and removal opening means to enable removal of the stack of can end members from said compartment means.

3. The invention as defined in claim 1 and further comprising:

a full tray palletizing station for stacking loaded tray units one on top of the other; and tray stacking means at said palletizing station for placing loaded tray units one at a time in vertically stacked relationship to provide a pallet of multiple stacked loaded tray units.

4. The invention as defined in claim 1 and wherein said loading means further comprising:

a shuttle tray mean for receiving and holding said individual stacks of can end members prior to transfer to an empty tray unit.

5. The invention as defined in claim 4 and wherein said shuttle tray means comprising:

a number of troughs equal to the number of compartment means on said tray units.

6. The invention as defined in claim 5 and wherein said shuttle tray means comprising:

an indexing means to align various ones of said troughs with said can end member stack forming means.

7. The invention as defined in claim 6 and further comprising:

pusher means for simultaneously pushing all the stacks of can end members from the shuttle tray means into all of the associated compartment means.

8. The invention as defined in claim 7 and further comprising:

extendable and retractable stopper means for holding the end portion of each stack of end members opposite said pusher means during transfer of the stack of end members to said compartment means.

9. The invention as defined in claims 1 or 8 and further comprising:

guide and support surface means associated with said insertion and removal opening means for guiding and supporting said stacks of can end members during insertion into said compartment means.

10. The invention as defined in claim 8 and further comprising:

extendable and retractable guide rod means on said shuttle tray means for guiding and supporting said stacks of can end members during transfer between said shuttle tray means and said compartment means.

11. The invention as defined in claim 8 and further comprising:

transfer means for moving said tray holding means back and forth between said loading station and an unloading station whereat a loaded tray unit is removed from said tray holding means.

12. The invention as defined in claim 11 and further comprising:

an empty tray elevator means for delivering an empty tray unit to said tray holding means; and a loaded tray elevator means for receiving and removing a loaded tray unit from said tray holding means.

13. The invention as defined in claim 1 and further comprising:

a loaded tray palletizing station for stacking loaded tray units one on top of another on a pallet member;

a plurality of pallet members for supporting and transporting tray units to and from the loading station and the loaded tray palletizing station;

an empty tray unit supply elevator means for supplying empty tray units to the tray loading station and supporting a pallet member with a plurality of stacked empty tray units mounted on the empty tray pallet member for sequentially transporting the empty tray pallet member and the stack of empty tray units thereon toward the loading station;

said tray holding means receiving and holding one empty tray unit at a time received from the stack of empty tray units on the empty tray pallet member; and loaded tray conveyor means for moving a loaded tray unit from the tray loading station to another processing station.

14. The invention as defined in claim 13 and further comprising:

a loaded tray palletizing elevator means at the loaded tray palletizing station for supporting a pallet member having a plurality of loaded tray units mounted in stacked relationship thereupon;

loaded tray stacking means at said loaded tray palletizing station for placing loaded tray units one at a time in vertically stacked relationship on the loaded tray palletizing elevator means to provide a pallet of multiple stacked loaded tray units; and loaded tray pallet conveyor means for removing a pallet of multiple stacked loaded tray units from the loaded tray palletizer elevator means.

15. The invention as defined in claim 1 and wherein said tray units further comprising:

cover means in the form of a sheet of plastic material mounted above said compartment means for covering the stacks of end members in said compartment means.

16. The invention as defined in claim 15 and wherein said cover means further comprising:

a plurality of separate parallel covering portions located above and extending over each of said compartment means and separated by a plurality of narrow width attachment portions fixedly connected to said tray unit.

17. A system for handling can end members comprising:

tray means having a plurality of parallel-spaced, elongated can end holding compartments extending from one side of said tray means to an opposite side of said tray means for holding a plurality of spaced parallel rows of elongated stacks of can end members;

cover means permanently mounted on said tray means for covering said can end holding compartments and can end members supported therewithin and being movable between a collapsed stowed position within said can end holding compartments when no can end members are present in said can end holding compartments and a raised open position in upward spaced relationship to and covering can end members located in said can end holding compartments;

opening and closing means for moving said cover means between said collapsed stowed position and said open can end member covering and holding position;

can end member loading means for loading can end members into said can end holding compartments when said cover means is in said open can end member covering position; and can end member unloading means for removing can end members from each of said can end holding compartments when said cover means is in said open can end member covering position.

18. The invention as defined in claim 17 and wherein said tray means further comprising:

a plurality of tray units, each tray unit having a quadrilateral peripheral configuration and being made of molded plastic material and comprising:

four peripheral side wall portions;

a central wall portion located between and integrally connected to said side wall portions; and a plurality of parallel equally spaced equal length elongated compartment means of identical cross-sectional configuration extending between one pair of opposite side wall portions and parallel to another pair of opposite side wall portions.

19. The invention as defined in claim 17 and further comprising:

a tray loading station for loading can end members on an empty tray unit;

tray holding means at the loading station for receiving and holding one empty tray unit at a time;

loading means at said loading station for laterally moving can end members into the compartments on the empty tray unit held by the holding means and filling the compartments with can end members to provide a loaded tray unit.

20. The invention as defined in claim 17 and wherein each of said can end holding compartments in said tray units further comprising:

a pair of laterally spaced uppermost rib portions;

a central lowermost rib portion located between said uppermost rib portions;

an upwardly facing slot in said lowermost center rib portion;

an upwardly facing curved segmental wall portion extending upwardly between each of said uppermost rib portions and said central lowermost rib portion for supporting said can end members thereon in upwardly spaced relationship to said slot;

an upper curved surface on each curved wall portion; and a downwardly facing curved surface on each curved wall portion for supportively engaging can end members on a tray means located therebelow.

21. The invention as defined in claim 17 and each compartment comprising:

a pair of opposite end wall portions;

a pair of laterally spaced uppermost upwardly facing rib portions, each of the pair located on opposite sides of said compartment; and a central lowermost downwardly facing rib portion located between said uppermost upwardly facing rib portions and defining an upwardly facing slot extending between the uppermost rib portions.

22. The invention as defined in claim 21 and further comprising:

an arcuately curved central side wall portion extending laterally between each of said uppermost rib portions and said downwardly facing rib portion.

23. The invention as defined in claim 22 and wherein each central side wall portion has an arcuate curved inner side surface extending the length of the compartment and providing abutting supporting engagement for the end members of a stack of end members located therein.

24. The invention as defined in claim 22, wherein each end wall portion of each compartment comprising:

an arcuately curved end wall portion having a lesser radius than the radius of said curved central side wall portion.

25. The invention as defined in claim 17, each compartment comprising:

a pair of opposite end wall portions; and a pair of elongated laterally spaced side wall portions extending the length of the compartment between said opposite end wall portions.

26. The invention as defined in claim 17 including a pair of longitudinally spaced end wall portions, one end wall portion being located at one end of said compartment and the other end wall portion being located at the other end of said compartment.

27. A tray unit for receiving a plurality of stacks of can end members for transporting a plurality of stacks of can end members to a processing station and comprising:

four peripheral side wall portions;

a central wall portion located between and integrally connected to said side wall portions;

a plurality of parallel equally spaced equal length elongated compartment means of identical cross-sectional configuration extending between one pair of opposite side wall portions and parallel to another pair of opposite side wall portions for receiving and holding a stack of can end members;

each of said compartment means comprising:

laterally spaced upwardly outwardly extending opposite wall portions having side surfaces for supporting engagement with peripheral portions of an horizontally extending stack of can end members located in said compartment means;

stack insertion and removal opening mean in said one pair of opposite side wall portions for enabling horizontal movement therethrough of a stack of can end members during insertion in and removal from said compartment means of a stack of can end members;

stack abutment means in each of said one pair of opposite side wall portions at opposite ends of said compartment means for supporting retaining engagement with opposite end portions of the stack of can end members received therein; and a lifting tool access slot means associated with said stack abutment means and extending through each of said one pair of opposite side wall portions for enabling insertion into said compartment means of a lifting tool device to engage and lift can end members above said stack abutment means for removal of the stack of can end members by horizontal movement through the stack insertion and removal opening means.

28. The invention as defined in claim 27 and further comprising:

cover means permanently mounted on said tray unit for covering said can end holding compartment means and can end members supported therewithin and being movable between a collapsed stowed position within said can end holding compartment means when no can end members are present in said can end holding compartment means and a raised open position in upward spaced relationship to and covering can end members located in said can end holding compartment means.

29. The invention as defined in claim 27 and each compartment means further comprising:

a pair of laterally spaced uppermost upwardly facing rib portions located on opposite sides of said compartment means; and a central lowermost downwardly facing rib portion located between said uppermost upwardly facing rib portions.

30. The invention as defined in claim 29 and further comprising:

an arcuately curved central side wall portion extending laterally between each of said uppermost rib portions and said downwardly facing rib portion and extending longitudinally between said one pair of opposite side wall portions.

31. The invention as defined in claim 30 and wherein each central side wall portion having an arcuate curved inner side surface extending the length of the compartment means and providing abutting supporting engagement for the end members of a stack of end members located therein.

32. The invention as defined in claim 31, wherein said stack abutment means comprising:

an arcuately curved end wall portion having a lesser radius than the radius of said curved central side wall portion.

* * * * *